US011648435B2

(12) United States Patent
Baluch

(10) Patent No.: US 11,648,435 B2
(45) Date of Patent: May 16, 2023

(54) EXERCISE MACHINE AND METHODS OF USE FOR STRENGTHENING THE LUMBOPELVIC COMPLEX

(71) Applicant: Daniel Baluch, Hypoluxo, FL (US)

(72) Inventor: Daniel Baluch, Hypoluxo, FL (US)

(73) Assignee: Origins & Insertions LLC, Hypoluxo, FL (US)

( * ) Notice: Subject to any disclaimer, the term of this patent is extended or adjusted under 35 U.S.C. 154(b) by 16 days.

(21) Appl. No.: 17/088,162

(22) Filed: Nov. 3, 2020

(65) Prior Publication Data

US 2021/0170217 A1 Jun. 10, 2021

Related U.S. Application Data

(60) Provisional application No. 62/938,513, filed on Nov. 21, 2019.

(51) Int. Cl.
*A63B 21/062* (2006.01)
*A63B 21/00* (2006.01)
(Continued)

(52) U.S. Cl.
CPC ..... *A63B 21/0628* (2015.10); *A63B 21/012* (2013.01); *A63B 21/4033* (2015.10); *A63B 23/0233* (2013.01)

(58) Field of Classification Search
CPC ..... A63B 21/00047; A63B 21/0005; A63B 21/00054; A63B 21/00065; A63B 21/00069; A63B 21/00072; A63B 21/00178; A63B 21/06; A63B 21/062; A63B 21/0626; A63B 21/0628; A63B 21/063; A63B 21/0632; A63B 21/154; A63B 21/155; A63B 21/156;
(Continued)

(56) References Cited

U.S. PATENT DOCUMENTS 4,600,189 A * 7/1986 Olschansky ..... A63B 21/4047 482/142
4,621,807 A * 11/1986 Stramer ..... A63B 21/06 482/100
(Continued)

OTHER PUBLICATIONS

Andersson, "Epidemiological features of chronic low-back pain." The lancet 354.9178 (1999): 581-585.
(Continued)

*Primary Examiner* — Loan B Jimenez
*Assistant Examiner* — Zachary T Moore
(74) *Attorney, Agent, or Firm* — Smith Baluch LLP

(57) ABSTRACT

An exercise machine is used to train the low back core musculature and lumbopelvic complex. The exercise machine can also be used to provide stability to the lumbar spinal column. The exercise machine includes a stationary bench substantially parallel to the floor and a rotating bench that is capable of rotating at an angle α about an axis, wherein the axis is located between the stationary bench and the rotating bench. A resistance means is used to adjust the amount of force required to move a resistance bar away from the rotating bench, while performing at least one of: a plank, a side plank, a bird-dog, a superman, a lumbar extension, a glute bridge, a single leg raise, a dual-leg raise, a bent leg raise, or a resisted push-up.

17 Claims, 87 Drawing Sheets

(51) Int. Cl.
*A63B 21/012* (2006.01)
*A63B 23/02* (2006.01)

(58) Field of Classification Search
CPC ..... A63B 21/4029; A63B 23/0233; A63B 23/0238; A63B 23/0235
See application file for complete search history.

(56) References Cited

U.S. PATENT DOCUMENTS 4,733,860 A 3/1988 Steffee
4,768,779 A 9/1988 Oehman, Jr. et al.
4,802,462 A 2/1989 Reiss et al.
4,844,448 A * 7/1989 Niznik ..... A63B 21/4047 482/40
4,883,269 A * 11/1989 Shaver ..... A63B 21/0615 482/97
4,893,812 A * 1/1990 Dawson, Jr. ..... A63B 21/154 482/94
5,016,874 A * 5/1991 Boardman ..... A63B 21/0552 482/122
5,052,684 A 10/1991 Kosuge et al.
5,163,443 A * 11/1992 Fry-Welch ..... A61B 5/225 600/595
5,211,617 A * 5/1993 Millen ..... A63B 21/0455 482/127
5,277,684 A * 1/1994 Harris ..... A63B 21/4047 482/121
5,324,247 A 6/1994 Lepley
5,356,360 A * 10/1994 Johns ..... A63B 21/155 482/99
5,941,807 A 8/1999 Cassidy et al.
6,280,361 B1 * 8/2001 Harvey ..... A63B 24/00 482/4
6,283,897 B1 * 9/2001 Patton ..... A63B 21/4015 482/79
RE37,648 E * 4/2002 Fulks ..... A63B 21/00072 482/100
RE38,057 E 4/2003 Pandozy
6,599,198 B2 * 7/2003 Ettenhofer ..... A63B 69/04 472/105
6,719,672 B1 * 4/2004 Ellis ..... A63B 21/155 482/98
7,163,488 B2 * 1/2007 Anders ..... A63B 21/0783 482/4
7,537,551 B2 * 5/2009 Steffee ..... A63B 23/0482 482/100
7,833,144 B1 * 11/2010 Como ..... A63B 23/0458 482/142
8,202,205 B2 * 6/2012 Reade ..... A63B 21/0552 482/121
8,827,880 B2 9/2014 Goel et al.
10,434,365 B2 * 10/2019 Mack ..... A63B 21/0552
11,007,398 B2 * 5/2021 Neuhaus ..... A63B 23/03525
11,117,017 B2 * 9/2021 Rayman ..... A63B 21/4035
11,202,935 B2 * 12/2021 D'Alesio ..... A63B 26/003
2002/0052268 A1 * 5/2002 Morcillo-Quintero ..... A63B 23/12 482/92
2007/0049471 A1 3/2007 Huang
2009/0270231 A1 * 10/2009 Hall ..... A63B 23/10 482/79
2009/0312165 A1 * 12/2009 Rempe ..... A63B 26/003 482/146
2017/0239518 A1 * 8/2017 Porteros De Luz ..... A63B 23/0482
2018/0001131 A1 * 1/2018 Nevarez, Jr. ..... A63B 21/0552
2018/0369633 A1 * 12/2018 Baker ..... A63B 23/00
2019/0168062 A1 * 6/2019 Monti ..... A63B 21/025
2021/0299511 A1 * 9/2021 Miller ..... A63B 23/0233

OTHER PUBLICATIONS

Bergmark, "The local and the global systems; in stability of the lumbar spine." Acta Orthop Scand 60 (1989): 20-24.
Danneels et al., "Effects of three different training modalities on the cross sectional area of the lumbar multifidus muscle in patients with chronic low back pain." British journal of sports medicine 35.3 (2001): 186-191.
Hansen et al., "Anatomy and biomechanics of the back muscles in the lumbar spine with reference to biomechanical modeling." Spine 31.17 (2006): 1888-1899.
Luo et al., "Estimates and patterns of direct health care expenditures among individuals with back pain in the United States." Spine 29.1 (2004): 79-86.
O'Sullivan et al., "Evaluation of specific stabilizing exercise in the treatment of chronic low back pain with radiologic diagnosis of spondylolysis or spondylolisthesis." Spine 22.24 (1997): 2959-2967.
Panjabi, "The stabilizing system of the spine. Part II. Neutral zone and stability hypothesis." J Spinal Disord 5 (1992): 383-389.
Richardson et al., "Muscle control-pain control. What exercises would you prescribe?." Manual therapy 1.1 (1995): 2-10.
Wilke et al., "Stability increase of the lumbar spine with different muscle groups. A biomechanical in vitro study." Spine 20.2 (1995): 192-198.

* cited by examiner

09 Dual Straight Leg Raise

09 Dual Straight Leg Raise

09 Dual Straight Leg Raise

10 Thigh Bent Leg Raise

10 Thigh Bent Leg Raise

10 Thigh Bent Leg Raise

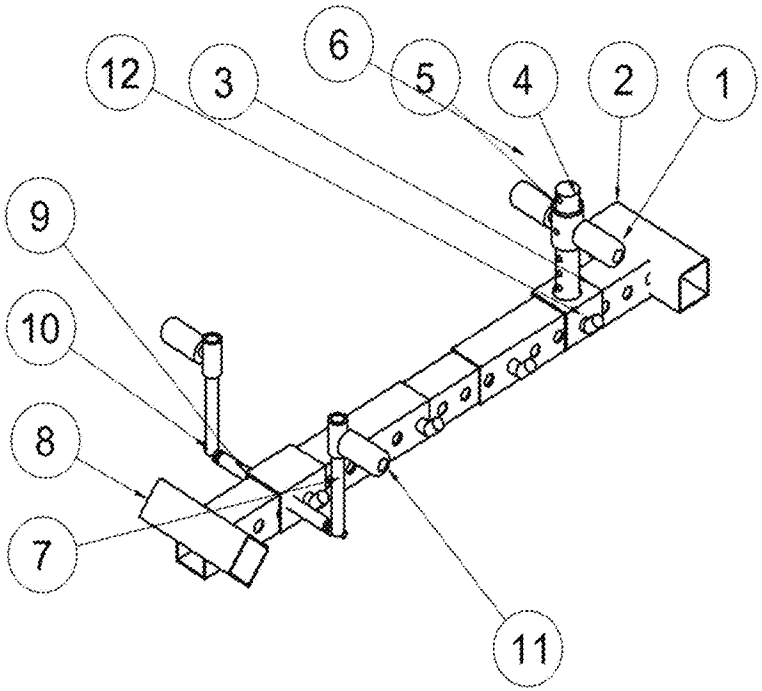

PARTS LIST

| ITEM | QTY | PART NUMBER | DESCRIPTION | MATERIAL |
|---|---|---|---|---|
| 1 | 1 | BACK BASE_1 | | STEEL |
| 2 | 1 | BACK BASE_2 | | STEEL |
| 3 | 1 | BACK BASE SLIDE BRACKET | | STEEL |
| 4 | 1 | BACK BASE SLIDE BRACKED PILLAR | | STEEL |
| 5 | 1 | BACK BASE_SLIDE HANDLE GUIDA | | STEEL |
| 6 | 2 | BACK BASE_SLIDE HANDLE GUIDE_GRIP_1 | | STEEL |
| 7 | 1 | CENTER EXTENSION | | STEEL |
| 8 | 1 | FRONT BASE FRAME ASSEMBLY | | STEEL |
| 9 | 1 | FRONT BASE SLIDE BRACKET | | STEEL |
| 10 | 2 | FRONT BASE EXTENSION ROD_2 | | STEEL |
| 11 | 2 | FRONT BASE SLIDE HANDLE | | STEEL |
| 12 | 4 | LOCK PIN | | STEEL |

FIG. 18L

EXERCISE MACHINE AND METHODS OF USE FOR STRENGTHENING THE LUMBOPELVIC COMPLEX

CROSS-REFERENCE TO RELATED APPLICATIONS

The present application claims a priority benefit to U.S. provisional application Ser. No. 62/938,513, filed on Nov. 21, 2019 entitled "EXERCISE MACHINE AND METHODS OF USE FOR STRENGTHENING THE LUMBOPELVIC COMPLEX," which is incorporated herein by reference in its entirety.

BACKGROUND

Low back pain affects 70-85% of the population at some point in their lives (Andersson Lancet 1999) with 30% of this group becoming chronic sufferers. Low back pain is the leading cause of disability in individuals under 50 years of age. In 1998, the health care costs associated with low back pain in the United States alone was over $90 billion (Luo Spine 2004).

The spinal column is supported by passive restraints such as the ribs, vertebrae, and joints as well as active restraints such as muscles and tendons. Throughout daily activities and various motions, it is up to these restraint systems to maintain spinal stability. When forces or movements exceed these restraints, the spine's intervertebral motion segments can fall outside of the neutral zone or physiologic threshold, exposing the spine to potential pain, deformity, or neurologic deficit resulting in spinal instability.

The muscles that act upon the spinal segment have the greatest influence on keeping the spine within the safe, neutral zone. There is a global muscle system composed of large torque-producing muscles such as the rectus abdominus, external oblique, and erector spinae that provide general trunk stabilization. However, it is the local muscle system made of the multifidus and transverse abdominus, through their attachments to the lumbar vertebrae, that have the greatest contribution to providing dynamic control to the lumbar motion segments, particularly in the neutral zone.

The lumbar core is comprised of the multifidus muscles and transverse abdominus. The lumbar multifidi are located along the lamina of the vertebrae, spreading caudolaterally to insert onto the mamillary processes. As such, the primary action of the multifidi is not to produce actual rotation, but rather to oppose the flexion effect of the abdominals as they produce rotation. The multifidi act as stabilizers controlling intersegmental motion rather than principal movers of the vertebral column through the previously mentioned counteraction effect.

The transverse abdominus is often referred to as the internal corset of the torso. It is the deepest abdominal muscular layer and raises intra-abdominal pressure when activated (Hansen Spine 2006). Via an agonist-antagonist mechanism, activation of the posterior lumbar musculature (i.e. multifidus) causes transverse abdominus co-activation; this leads to elevated circumferential muscular tone surrounding the lumbar spine, thereby providing increased spinal stability.

SUMMARY

The invention relates generally to an exercise machine and methods for strengthening the lumbopelvic complex.

In one embodiment, an exercise machine includes a stationary bench, a rotating bench, a resistance bar, and a load arm mechanism. The stationary bench is substantially parallel to a floor on which the machine is placed, and the rotating bench is capable of rotating at an angle $\alpha$ about an axis located between the stationary bench and the rotating bench. The angle $\alpha$ is about 180 degrees when the rotating bench is substantially parallel to the floor, and a decreases in magnitude as the rotating bench is rotated away from the floor. The angle $\alpha$ ranges from about 90 degrees to about 210 degrees, preferably from about 110 degrees to 200 degrees, more preferably from about 120 degrees to 190 degrees, more preferably from about 135 degrees to 180 degrees.

In another embodiment, the load arm mechanism is capable of providing at least one of linear or rotational adjustment of the resistance bar. The linear adjustment is capable of providing about 8 inches to about 34 inches, preferably about 10 inches to about 30 inches, more preferably about 12 inches to about 28 inches, more preferably about inches to about 26 inches of adjustment of the resistance bar. The rotational adjustment is capable of providing at least about 180 degrees of adjustment of the resistance bar.

In another embodiment, the resistance bar is capable of adjusting the amount of force required to move the resistance bar away from the rotating bench. The resistance means includes at least one of a weight stack, a resistance band, a guided weight resistance, or a friction-based resistance.

In another embodiment, the exercise machine may include one or more suspended slings attached to the machine. The exercise machine may also include at least one inflatable hemisphere disposed on the stationary bench or the rotating bench. The exercise machine may also include at least one swivel platform attached to the stationary bench or the rotating bench.

In another embodiment, the material of the exercise machine includes metal, plastic, wood, PCV, or steel.

In another embodiment, a method of using an exercise machine including a stationary bench, a rotating bench, a support structure attached to the stationary bench and the rotating bench, a resistance bar, a load arm mechanism attached to the support structure to provide linear and rotational adjustment of the resistance bar, and a resistance means to adjust the amount of force required to move the resistance bar away from the rotating bench, and where the method includes performing at least one of a plank, a side plank, a bird-dog, a superman, a lumbar extension, a glute bridge, a single leg raise, a dual-leg raise, a bent leg raise, or a resisted push-up.

In another embodiment, the method includes a resistance means including at least one of a weight stack, a resistance band, a guided weight resistance, or a friction-based resistance.

In another embodiment, the method is performed while at least one inflatable hemisphere is disposed on the stationary bench or the rotating bench. The method is performed while one or more swivel platform is attached to the stationary bench or the rotating bench.

All combinations of the concepts below (provided such concepts are not mutually inconsistent) are part of the inventive subject matter disclosed herein. In particular, all combinations of claimed subject matter appearing at the end of this disclosure are part of the inventive subject matter disclosed herein. The terminology used herein that also may appear in any disclosure incorporated by reference should be accorded a meaning most consistent with the particular concepts disclosed herein.

BRIEF DESCRIPTIONS OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIG. 18L is a schematic of the exercise machine identifying the components.

DETAILED DESCRIPTION

In General

Figure 1A:
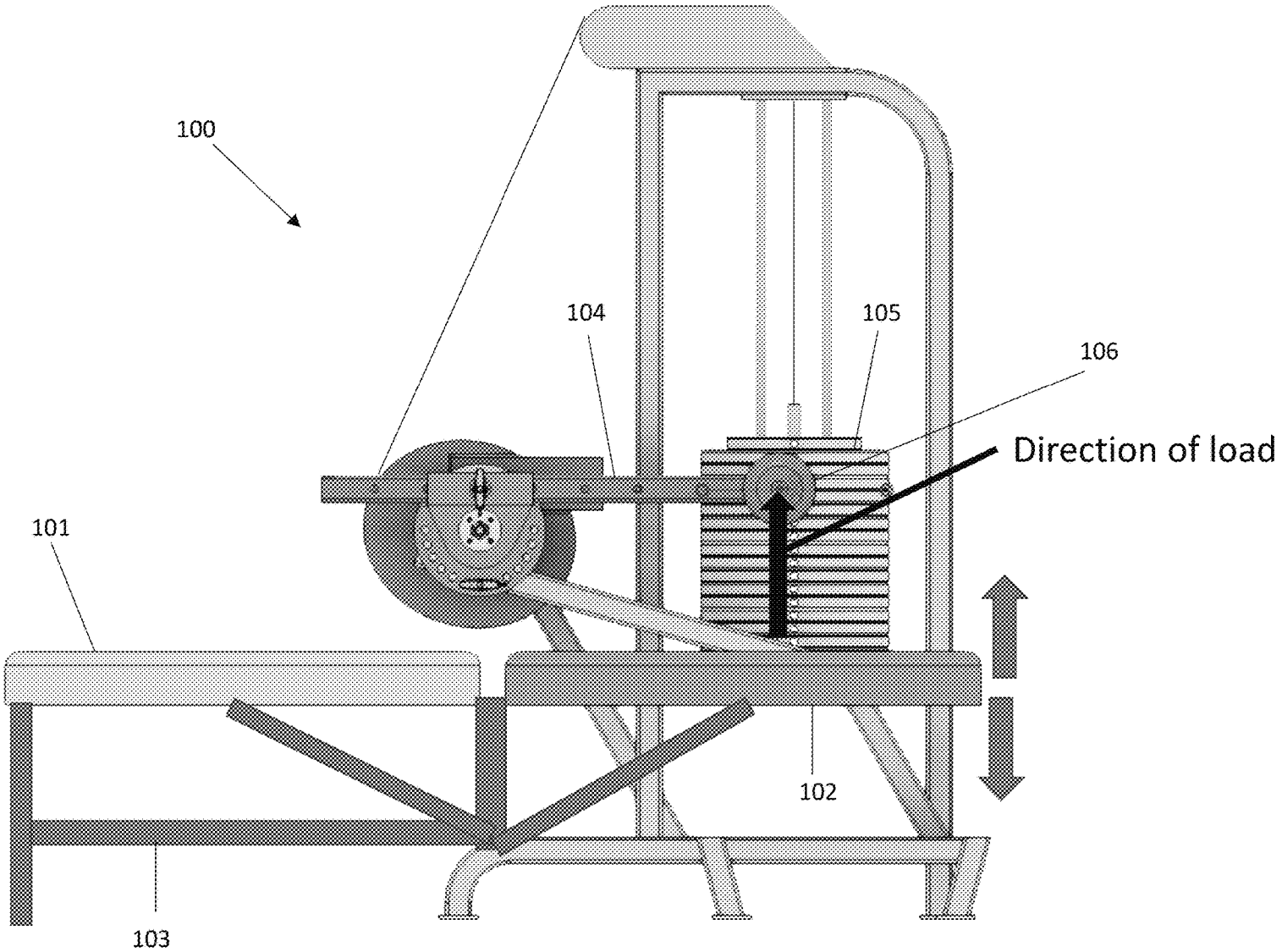
FIG. 1A is a schematic of the side view of an exercise machine.

An exercise machine as disclosed herein can be used to train the low back core musculature and lumbopelvic complex. The exercise machine can also be used to provide stability to the lumbar spinal column. The exercise machine can be used to train the lumbopelvic core muscles and progressively improve their strength through the use of added resistance. The exercise machine can allow the user to simulate a variety of core strengthening exercises including a plank, a glute bridge, a bird-dog, a leg raise (single-leg or dual-leg), or other exercises that target the core muscles.

Example 1

Components of the Exercise Machine

FIGS. 1A-1L show an exercise machine 100 that functions to train and strengthen the lumbopelvic core muscles. In one embodiment, the exercise machine includes a stationary bench 101, a rotating bench 102, a support structure 103, a load arm mechanism 104, a weight stack 105, and a resistance bar 106.

The stationary bench 101 provides a stable base for the user of the exercise machine 100. In one embodiment, the stationary bench 101 is substantially parallel to the floor on which the machine is placed. Preferably, the stationary bench 101 is elevated from the floor on which the machine is placed. The stationary bench 101 may be fixed using a support structure 103. The stationary bench 101 may have a padded top surface.

The rotating bench 102 is rotatable at an angle α relative to the stationary bench 101. The rotating bench 102 may have a padded top surface. The angle α provides rotation about an axis located between the stationary bench 101 and the rotating bench 102. The angle α of the rotating bench 102 relative to the stationary bench 101 can be adjusted. For example, when both the rotating bench 102 and the stationary bench 101 are substantially parallel to the floor, a is equal to about 180 degrees, as shown in FIGS. 1A and 1L. As the rotating bench 102 is rotated up away from the floor, a decreases. The angle α can range from about 90 degrees to about 210 degrees, preferably from about 110 degrees to about 200 degrees, more preferably from about 120 degrees to about 190 degrees, and particularly from about 135 degrees to about 180 degrees. FIG. 1J shows the exercise machine 100 where a is equal to about 135 degrees (180 degrees minus 45 degrees). FIG. 1K shows the exercise machine 100 where a is equal to about 195 degrees (180 degrees plus 15 degrees). The angle α can be adjusted in increments of about 5 degrees, about 10 degrees, about 15 degrees, about 20 degrees, about 25 degrees, about 30, or about 35 degrees. The stationary bench 101 can also be rotated about the axis between the stationary bench 101 and the rotating bench 102 to either increase or decrease the value of a. Adjusting the angle α, by changing the position of the rotating bench 102 and/or the stationary bench 101, allows the user to perform exercises at various angles, which modifies the level of difficulty and regions of muscle activation.

Figure 1B:
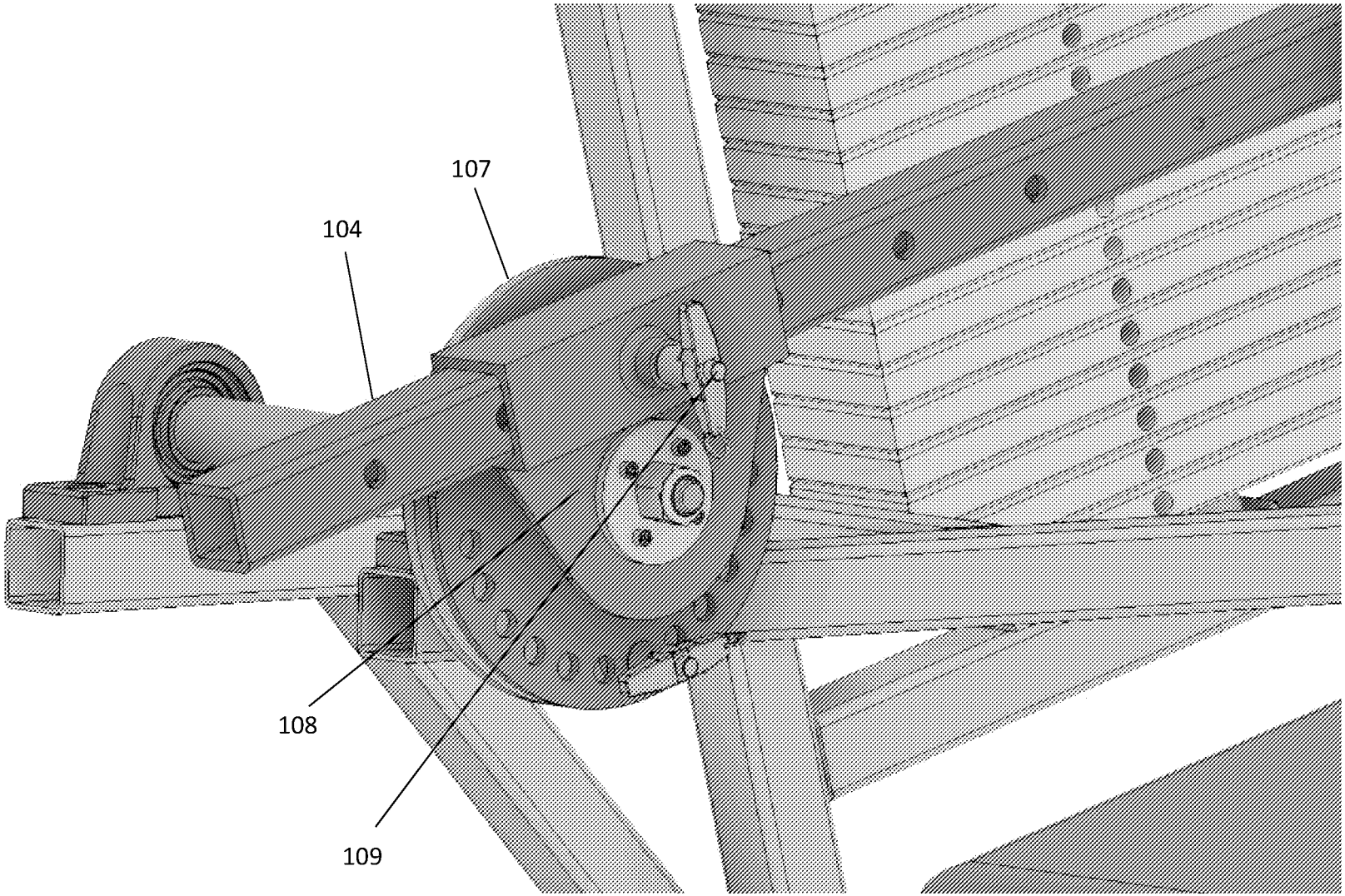
FIG. 1B is a schematic of the load arm mechanism.
Figure 1C:
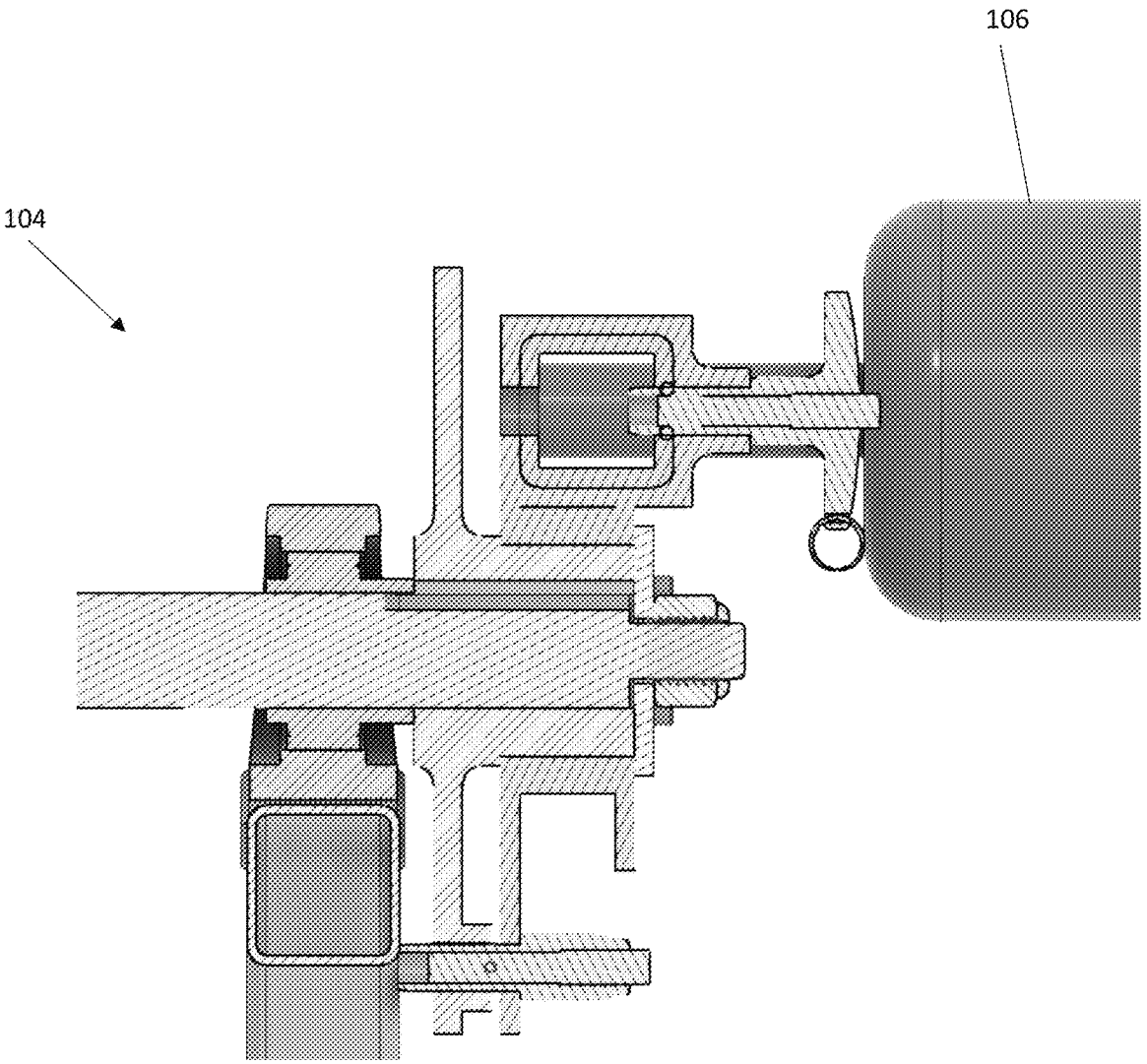
FIG. 1C is a cross-section of the load arm mechanism.
Figure 1D:
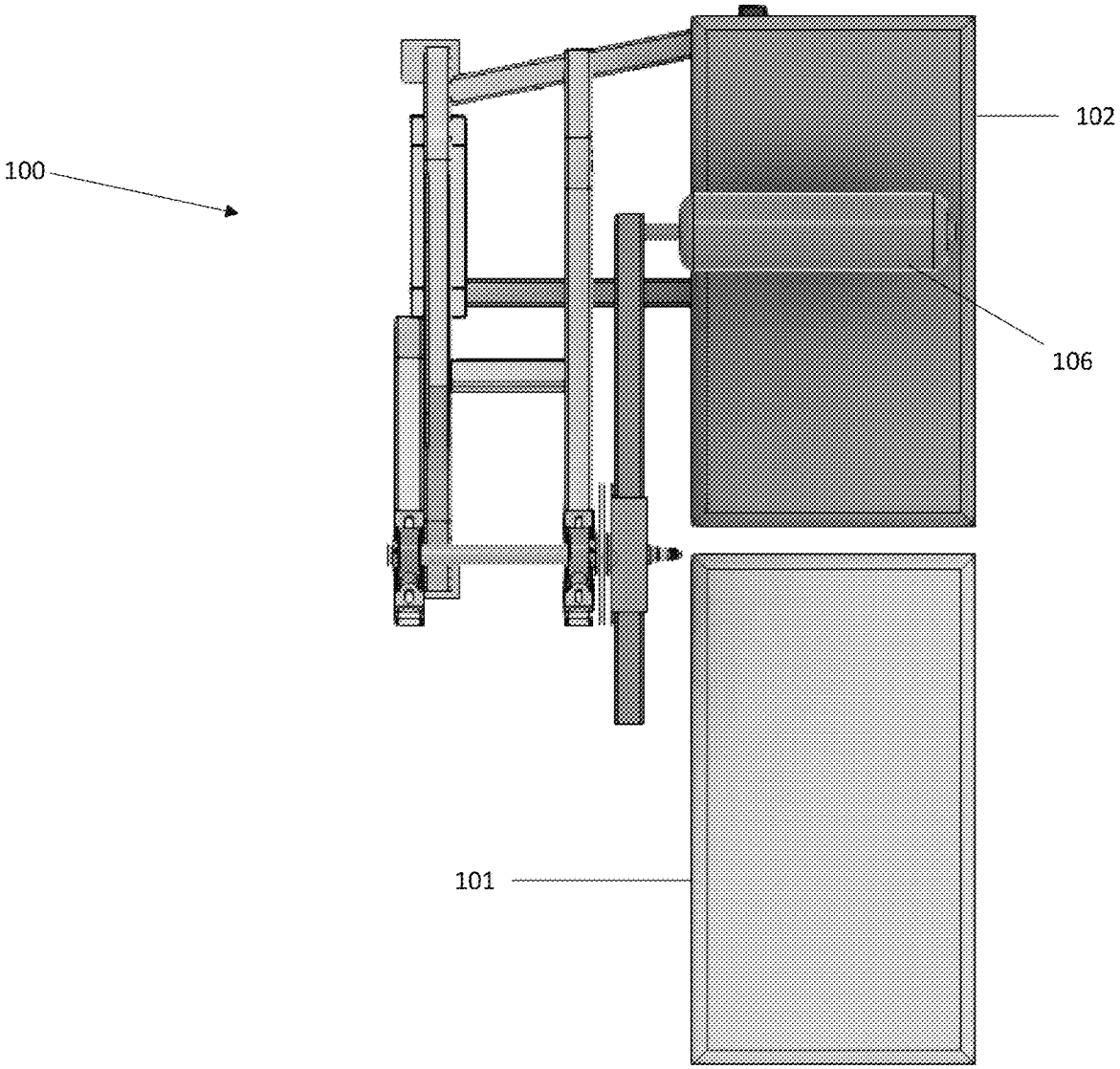
FIG. 1D is an aerial view of the exercise machine.
Figure 1E:
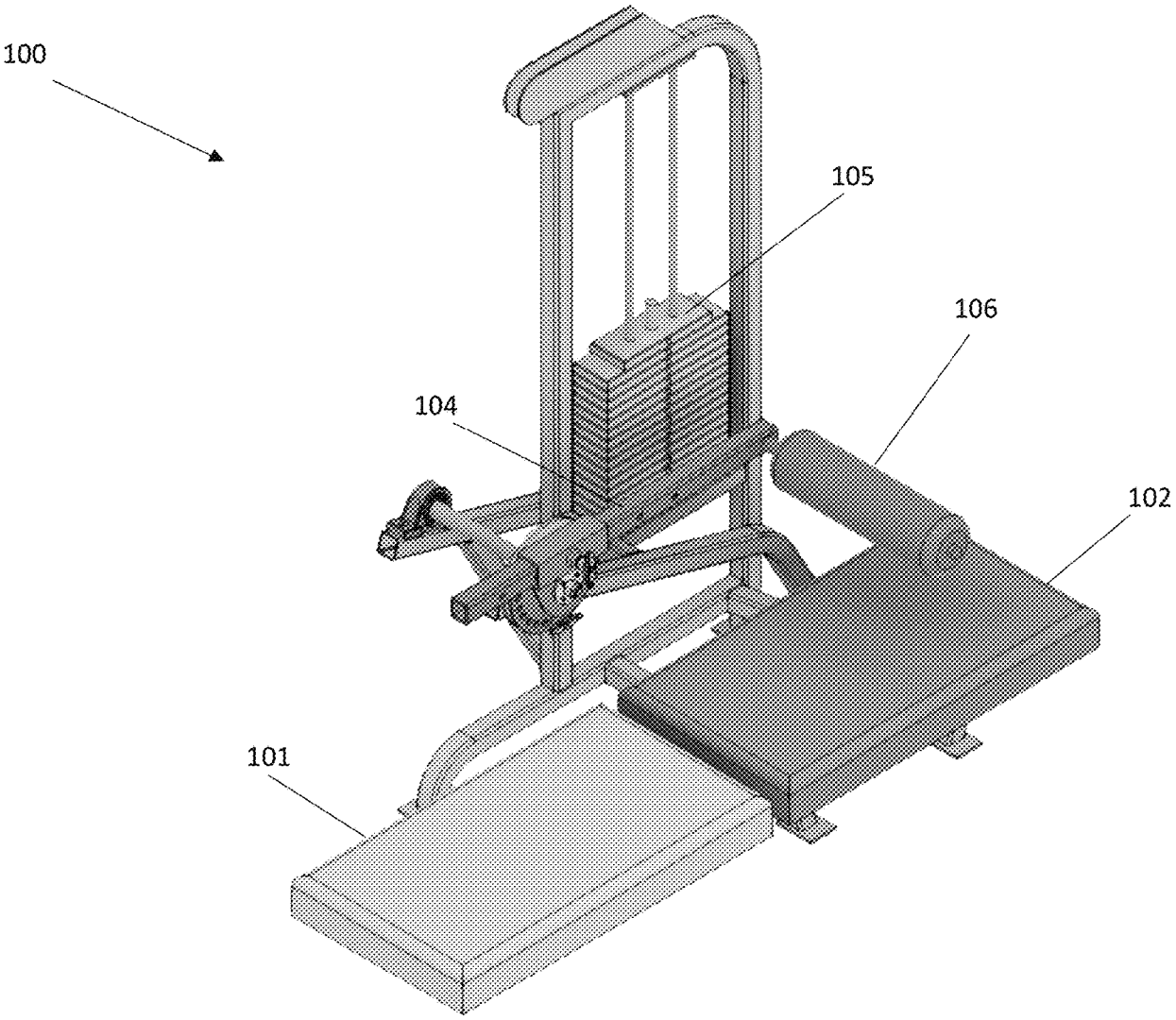
FIG. 1E is an isometric view of the exercise machine.
Figure 1F:
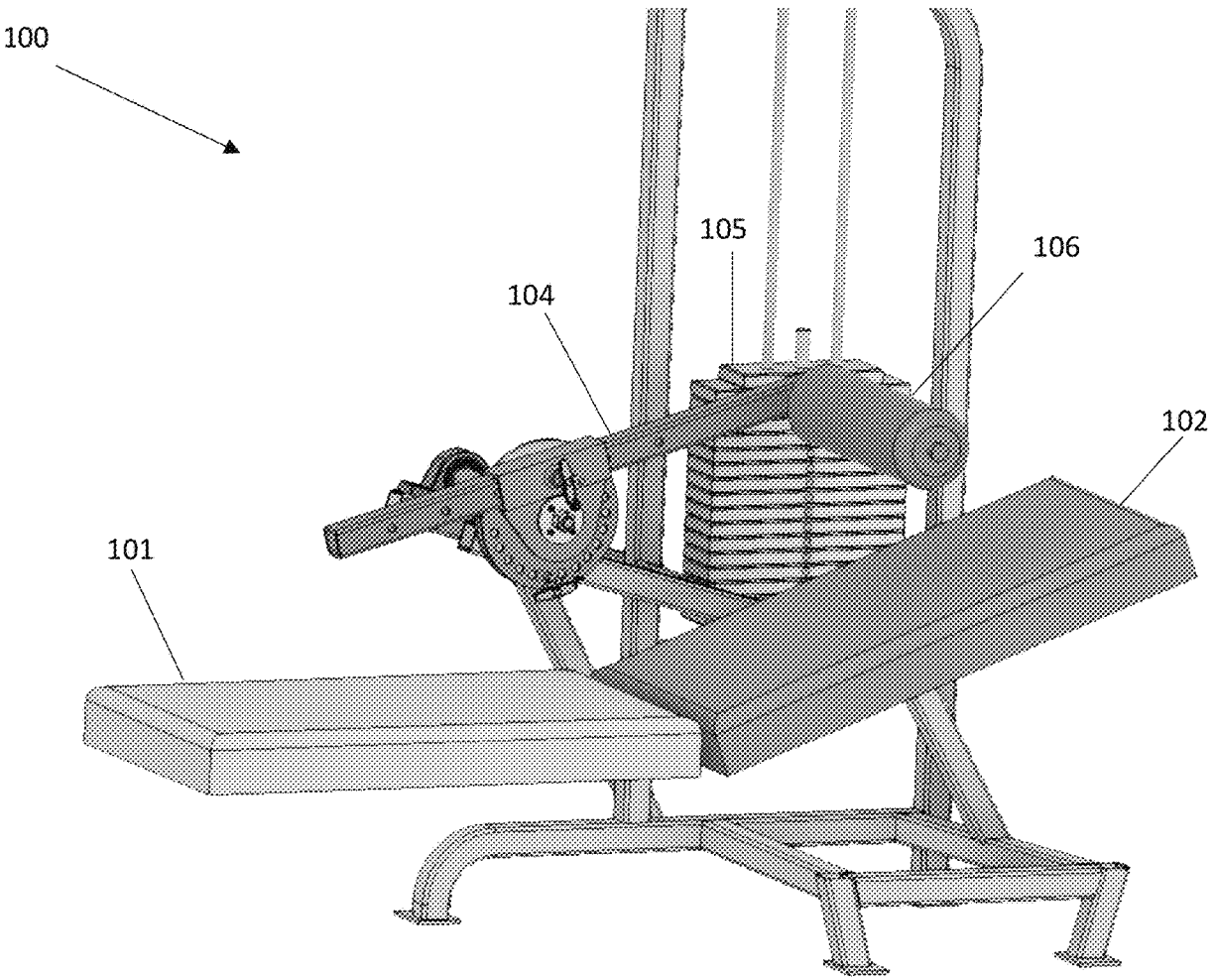
FIG. 1F is a schematic illustrating an upwards bench angular adjustment of the exercise machine.
Figure 1G:
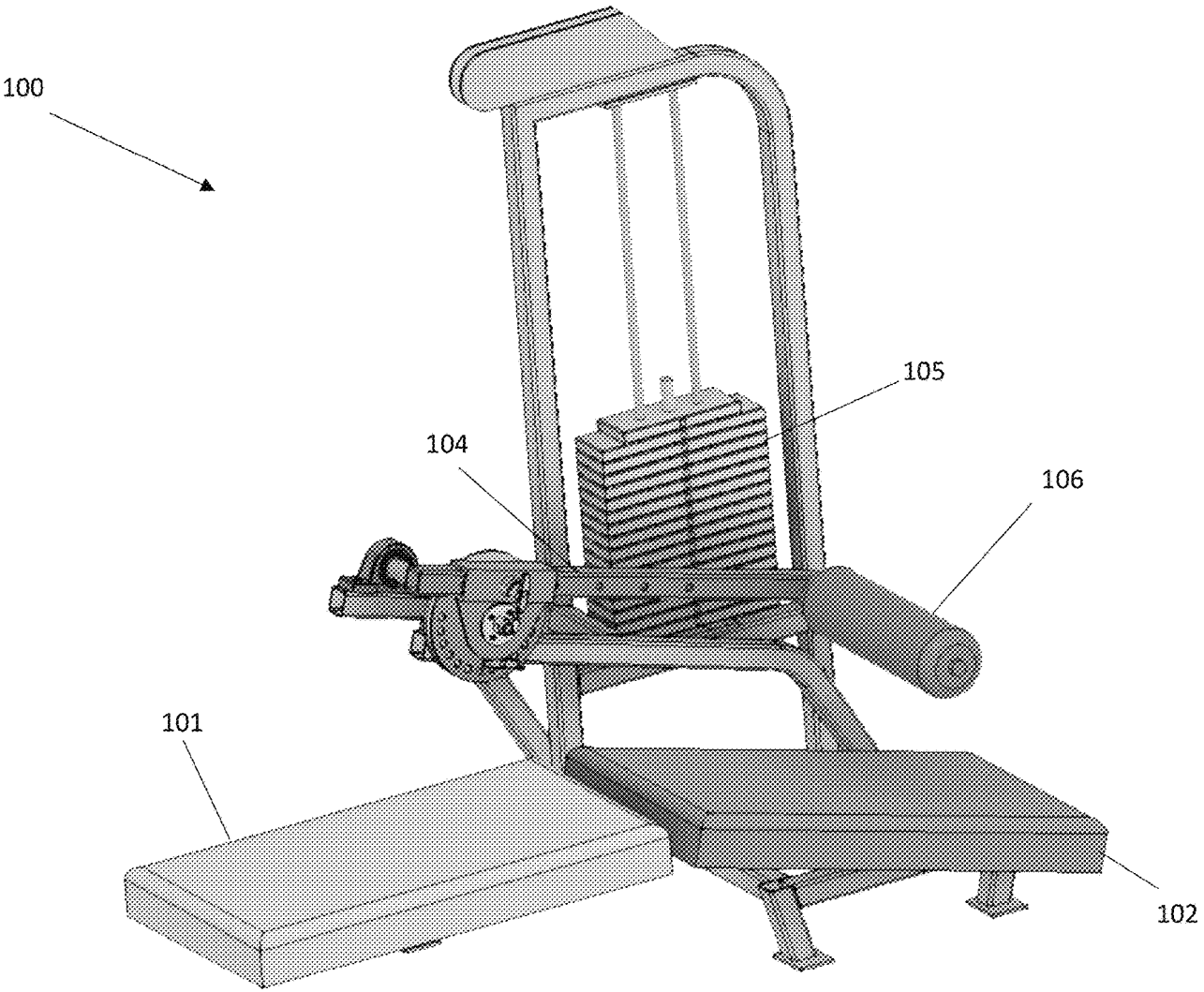
FIG. 1G is a schematic illustrating a downwards bench angular adjustment of the exercise machine.
Figure 1H:
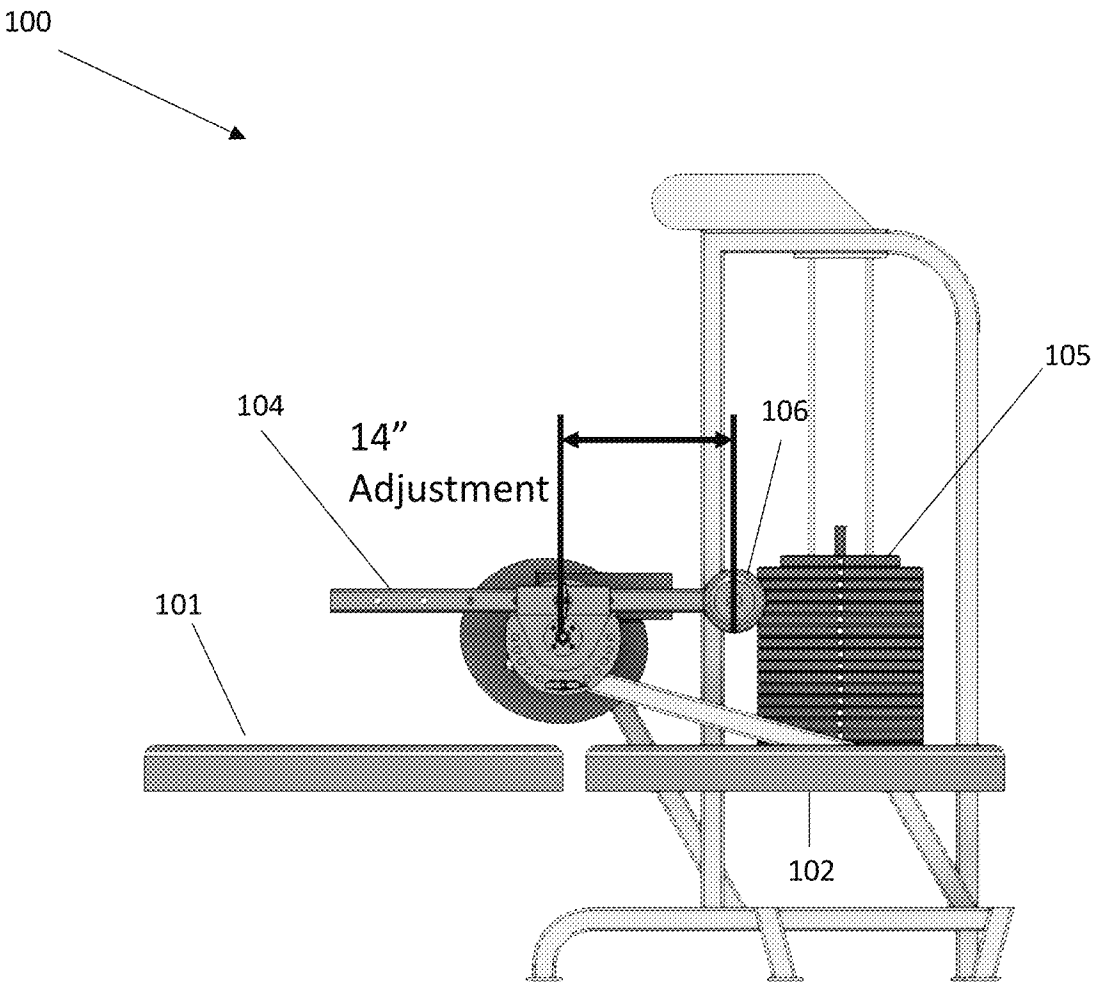
FIG. 1H is a schematic showing the swing arm at a 14-inch linear adjustment.
Figure 1I:
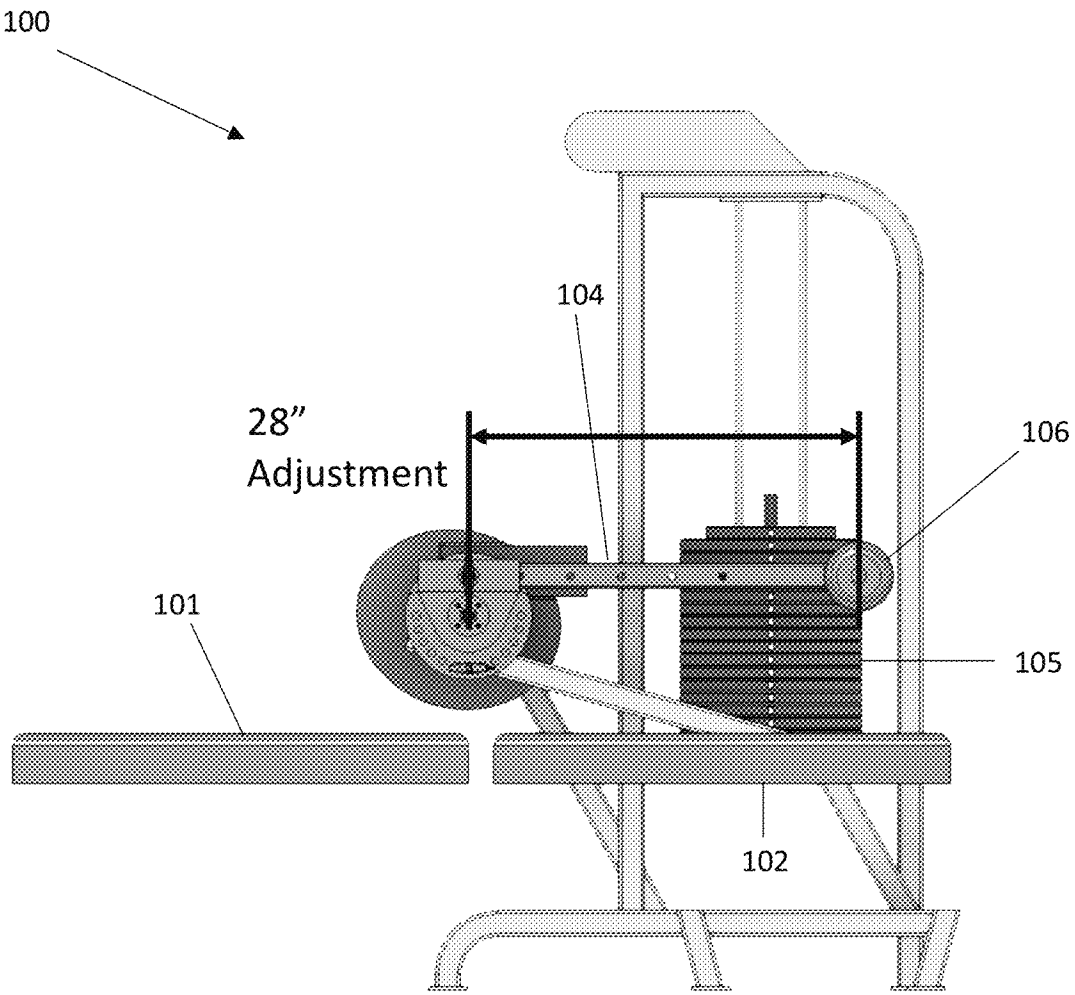
FIG. 1I is a schematic showing the swing arm at a 28-inch linear adjustment.
Figure 1J:
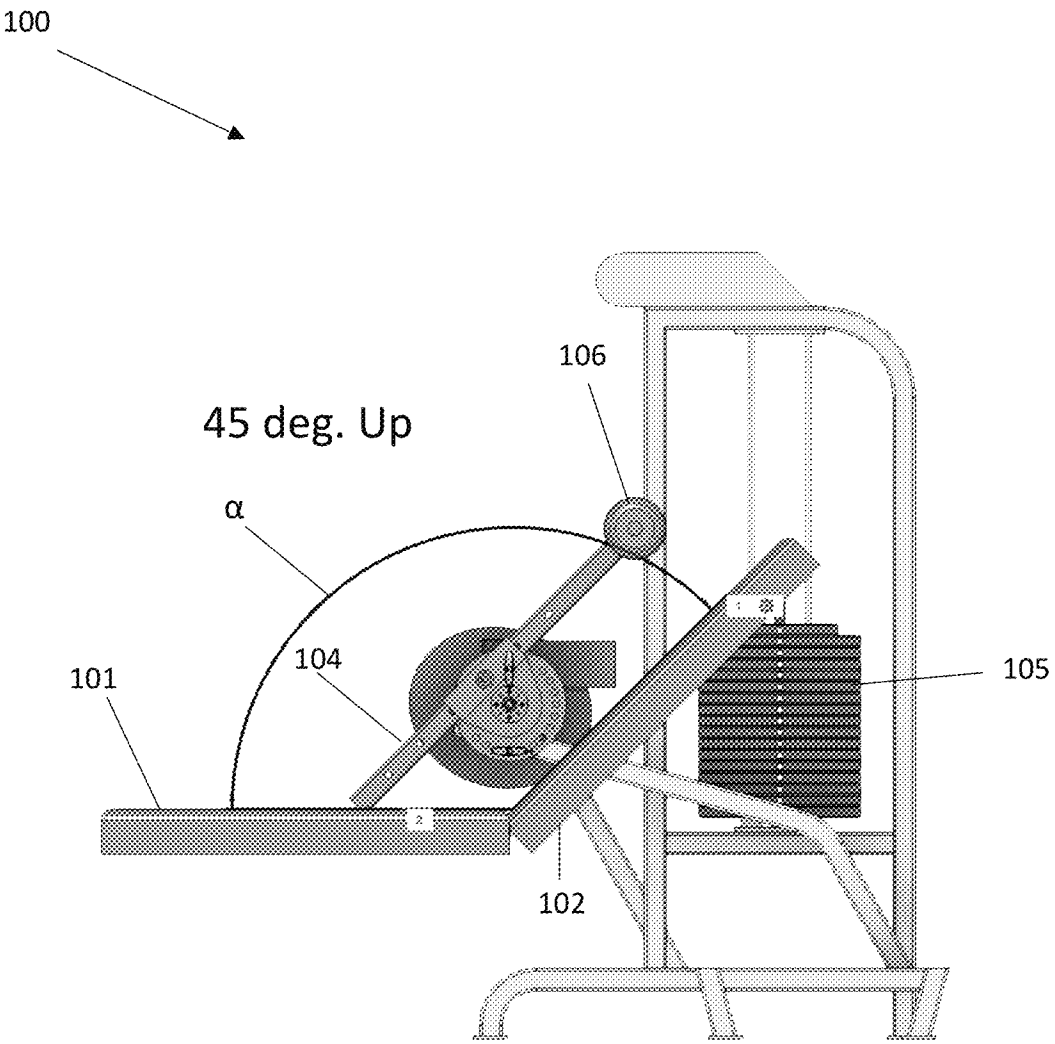
FIG. 1J is a schematic showing the upwards bench angular adjustment.
Figure 1K:
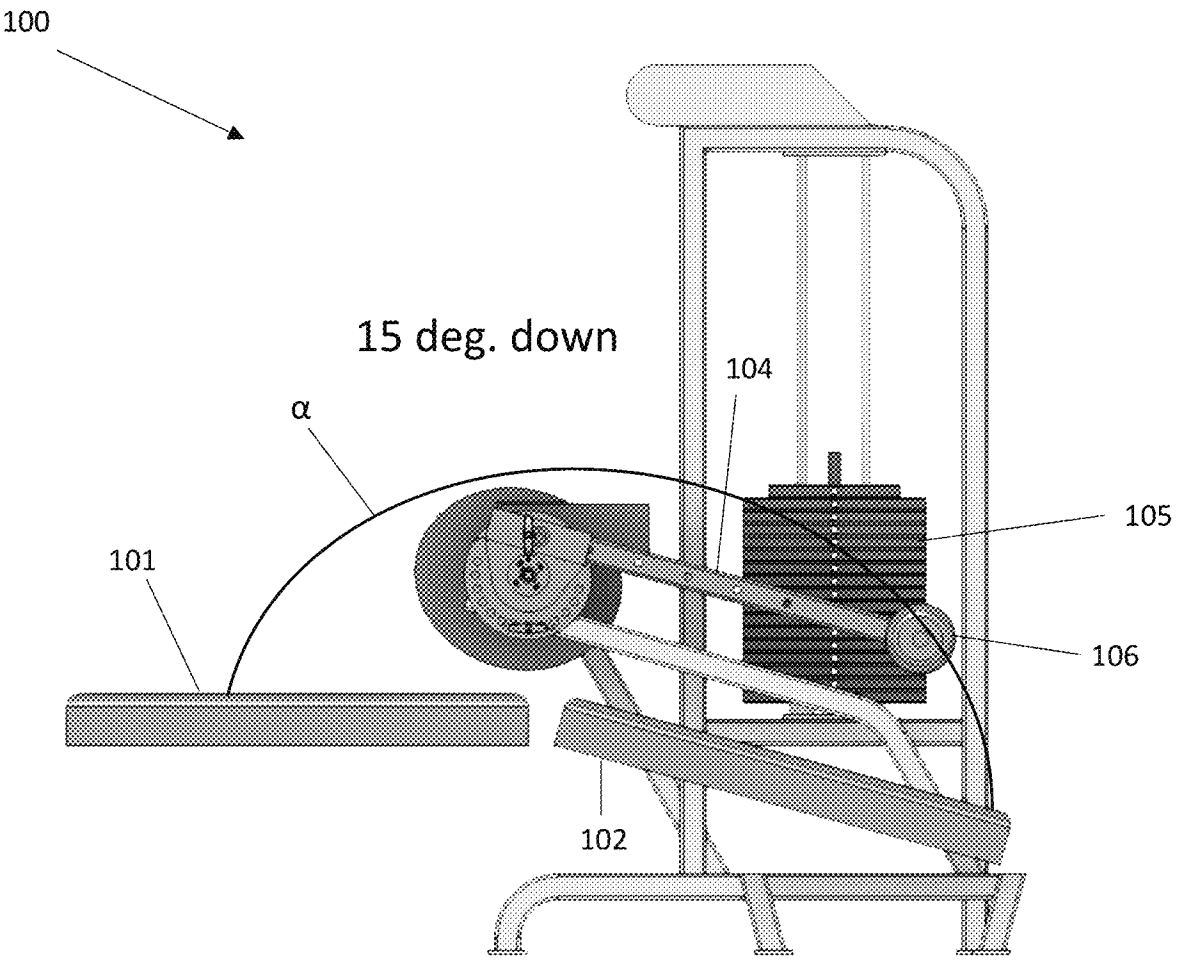
FIG. 1K is a schematic showing the downward bench angular adjustment.
Figure 1L:
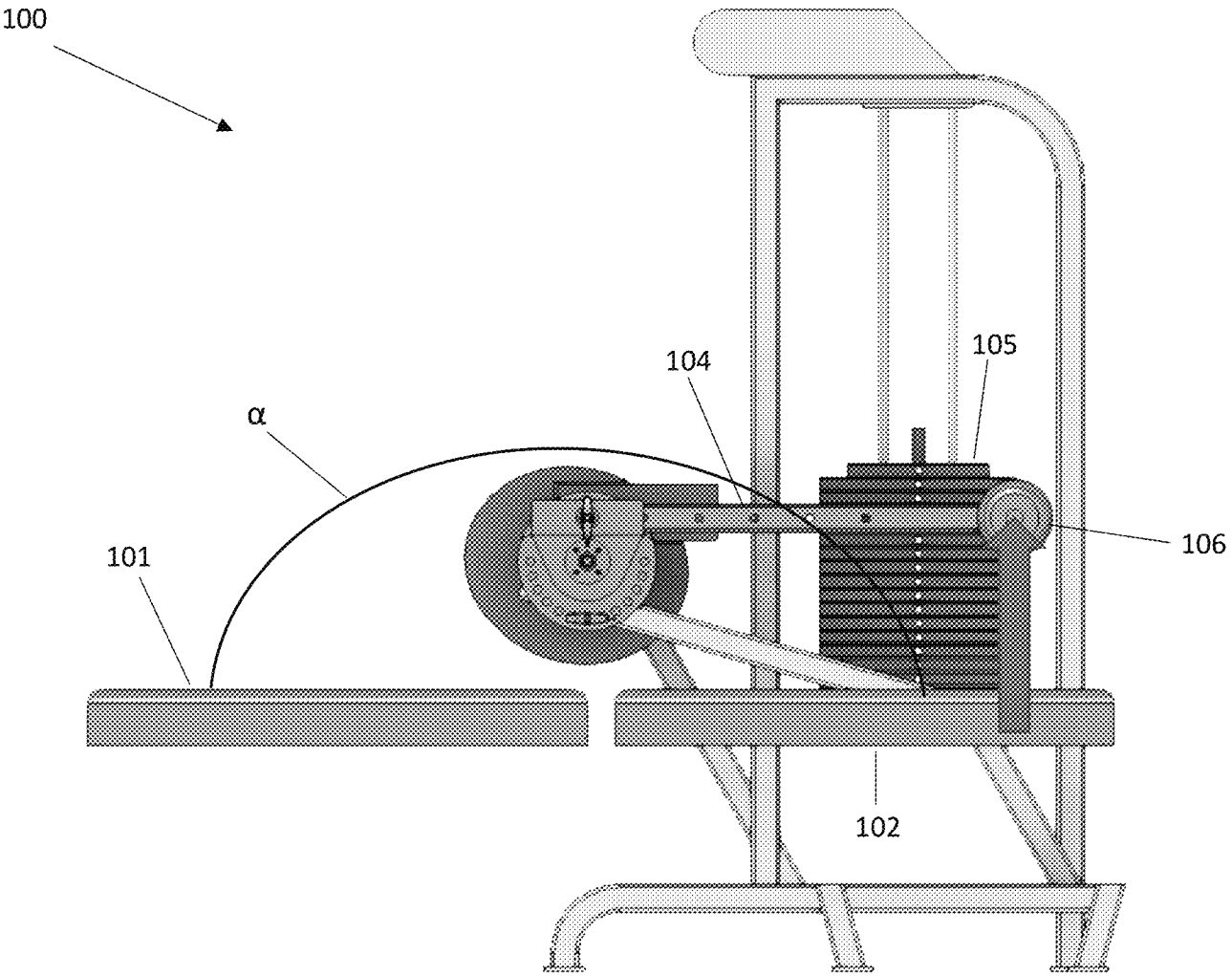
FIG. 1L is a schematic showing the exercise machine and swing arm load.

The load arm mechanism 104 includes a fixed plate 107, a rotating plate 108, and a concentric square tube 109, as shown in FIG. 1B. A cross section of the load arm mechanism 104 is shown in FIG. 1C. The resistance bar 106 is attached to the end of the load arm mechanism 104. The fixed plate 107 is fixed to the shaft of the load arm mechanism 104 using a keyed joint. The fixed plate 107 is connected to the weight stack 105.

The distance between the axis of rotation of the rotating bench 102 and the center of the rotating plate 108 can be between 12 inches and 24 inches, preferably between 14 inches and 20 inches, and more preferably between 16 inches and 18 inches.

The size of the exercise machine can be adjusted in length and/or width as necessary to accommodate user sizes and/or space constraints. The load arm mechanism 104 can be adjusted in both length and height, providing at least one of linear or rotational adjustment of the attached resistance bar 106. The rotating plate 108 can rotate freely and can be pinned into fixed positions at about 5 degrees, or about 10 degrees, or about 15 degrees, or about 20 degrees, or about 25 degrees, or about 30 degrees, or about 35 degrees to allow for angular adjustment of the load arm mechanism 104. The rotational adjustment can provide at least about 180 degrees of adjustment of the resistance bar 106. The rotating plate 108 can rotate up to 360 degrees, or at least 300 degrees, or at least 240 degrees, or at least 180 degrees, or at least 120 degrees, or at least 90 degrees, or at least 60 degrees, or at least 45 degrees. In order to accommodate a user at any angle of the rotating bench 102, the amount of angular adjustment of the load arm mechanism 104 is at least equal to, but preferably greater than, the amount of adjustment of angle α of the rotating bench. Preferably, the load arm mechanism 104 can be adjusted over a greater range of angles than the rotating bench can rotate. For any given a, load arm mechanism 104 is be adjustable to accommodate users of different size. Moreover, the load arm mechanism should be adjustable to accommodate the different exercises that are performed at each different a of the rotating bench. The minimum linear adjustment (FIG. 1H) is about 8 inches, preferably about 10 inches, or about 12 inches, or about 14 inches from the concentric square tube 109 to the resistance bar 106. The maximum linear adjustment (FIG. 1I) is about 34 inches, preferably about 32 inches, or about 30 inches, or about 28 inches, or most preferably about 28 inches from the concentric square tube 109 to the resistance bar 106. The concentric square tube can be pinned into fixed positions between about 5-inch and 15-inch increments or holes to allow for axial adjustment of the load arm mechanism 104. Preferably, there are between 5 and 15 increments or holes, and each increment or hole is spaced between about 1 inch to 2 inches from the next adjacent increment or hole. In one embodiment, there are 10 holes and each hole is spaced about 1 or 2 inches, such as 1.5 inches, from the next nearest hole.

Rotation of the load arm mechanism 104 allows for optimal placement of the resistance bar 106 against the user. The resistance bar 106 can be adjusted to account for the exercise being performed and for individual anthropometry. The load arm mechanism 104 can have a ratcheted system to move the resistance bar 106 closer to or farther away from the user when desired. The resistance bar 106 can be modified to consist of a belt, strap, or other mechanism capable of applying external load. The resistance provides a means to adjust the amount of force required to move the resistance bar 106 away from the rotating bench 102. The load arm mechanism 104 can also be removed to use the bench alone for basic exercises without externally applied load or resistance.

The weight stack 105 externally applies load to add incremental resistance when performing the exercises. The weight stack weighs about 260 pounds to 310 pounds, preferably about 270 pounds to 300 pounds, more preferably about 275 pounds to 290 pounds, and particularly about 285 pounds. Depending on the design of the weight stack, the user can have zero weight selected. The resistance may be increased or decreased by 1 pound, or 2.5 pounds, or 5 pound, or larger increments. For example, the resistance may be increased in 1 pound, or 2 pound, or 2.5 pound, or 5 pound, or 10 pound, or 15 pound, or 20 pound, or 25 pound, or 50 pound increments depending on the weights used in the weight stack. As the user trains the lumbopelvic core musculature, this additional resistance will help further strengthen and hypertrophy the intended muscles. Resistance can be added through various means including but not limited to a weight stack, resistance bands, guided weight resistance, friction-based resistance, or another tool used to increase resistance.

The load arm mechanism 104 and resistance bar 106 employ an elliptical cam with a major axis of about 12 inches to 20 inches, preferably about 14 inches to 18 inches, more preferably 15 inches to 17 inches, and particularly about 16 inches. The minor axis of the elliptical cam is about 10 inches to 18 inches, preferably about 12 inches to 16 inches, more preferably 15 inches to 13 inches, and particularly about 14 inches. The mechanical advantage is a function of the ratio between pulley/cam radius, and load arm radius. The weight stack weighs about 260 pounds to 310 pounds, preferably about 270 pounds to 300 pounds, more preferably about 275 pounds to 290 pounds, and particularly about 285 pounds. Table 1 lists the force and weight on the load or swing arm at various positions. The dynamic load analysis in Table 1 assumes that a 30-degree stroke is executed at constant acceleration over 0.5 seconds. The force ranges of Table 1 depend on the angle of the applied force relative to the axis of the load or swing arm.

Figure 30:
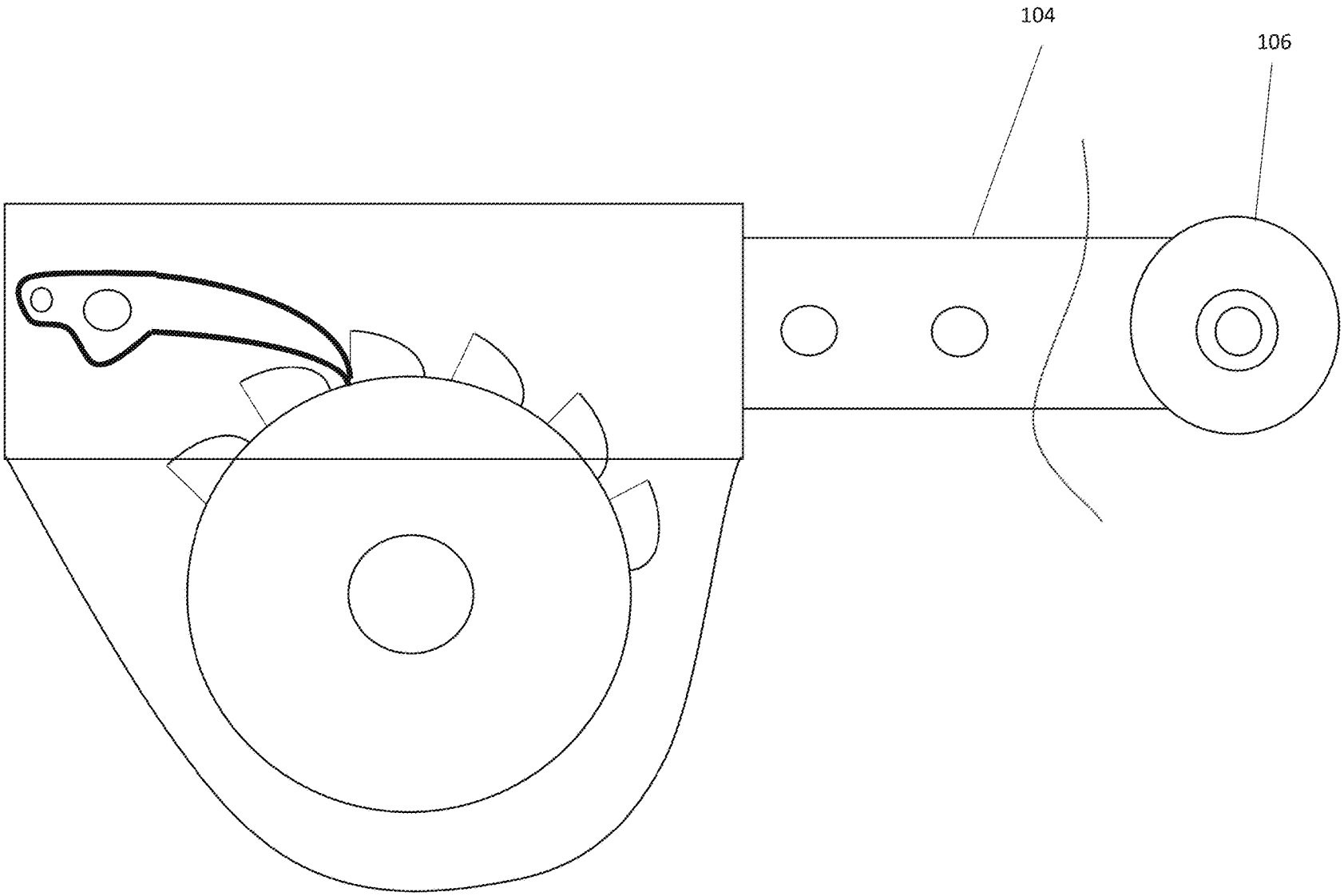
FIG. 30 is a sketch of the ratcheted pull-down and release system.

The resistance bar 106 can be vertically adjusted to allow for the user to position oneself beneath it. Alternatively, a ratcheted pull-down and release system may facilitate the vertical adjustment of the resistance bar 106. The ratcheted pull-down and release system would lower the resistance bar 106 until secure and then release the resistance bar 106 once pressed. The user would be able to pull load arm mechanism 104 down and lock it in incremental positions as it is lowered. This would more easily bring the resistance bar 106 to the desired start position of each exercise. A lever or pull cable would then allow the user to release the pawl and lift the resistance bar 106 to clear it out of the user's way. The ratcheted pull-down and release system may be beneficial if someone is using exercise machine 100 without any help or supervision or to simply adjustments for a variety of users. The ratcheted pull-down and release system mechanism is shown in FIG. 30.

TABLE 1

Load Arm Loads

| Force | Value (pounds) |
|---|---|
| Maximum Static Force Arm Extended | 75-100 |
| Maximum Static Force Arm Retracted | 150-200 |
| Maximum force required to accelerate an extended arm to full stroke in .5 seconds | 205 |
| Maximum force required to accelerate an extended arm to full stroke in .5 seconds | 440 |

Figure 2A:
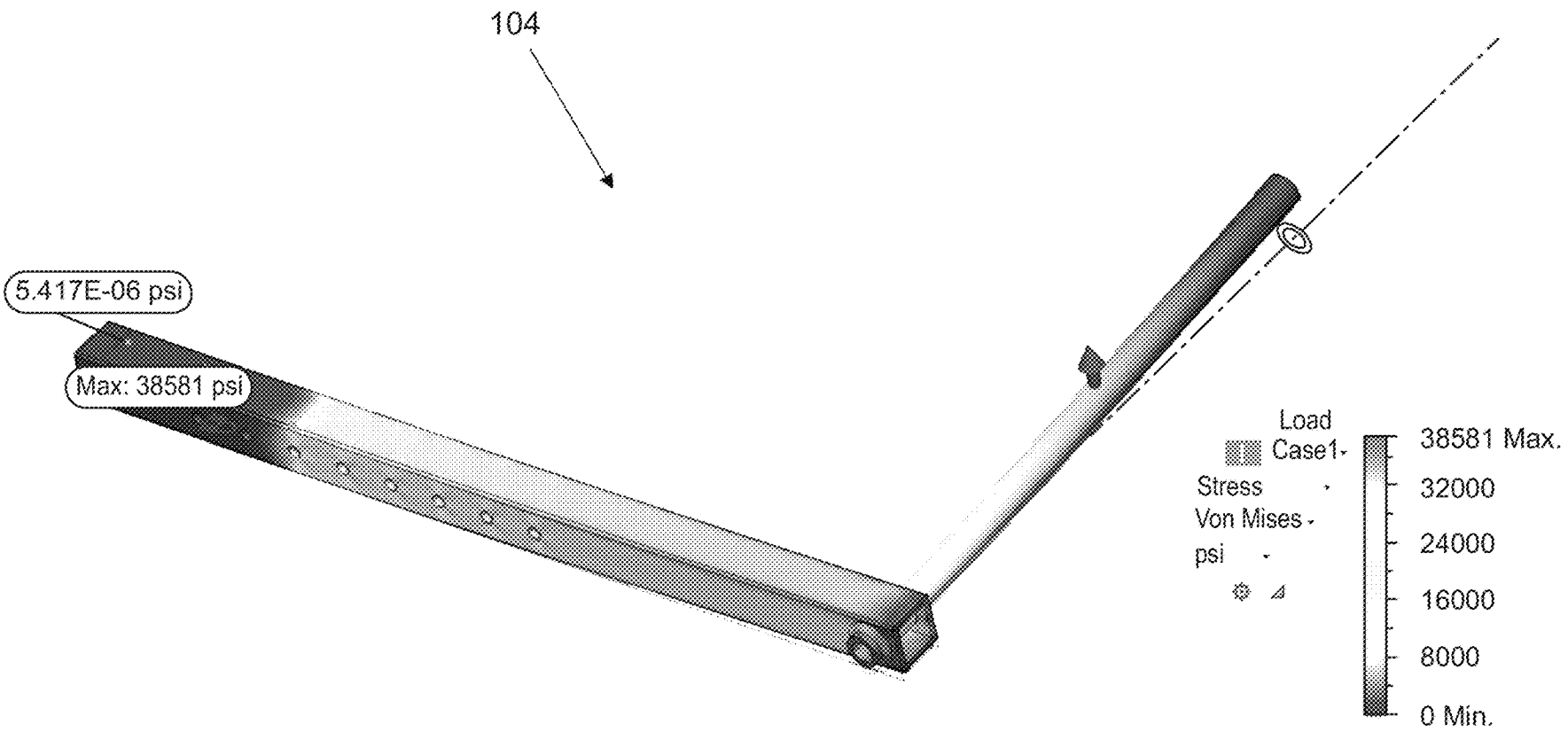
FIG. 2A is an illustration of the stress analysis of the swing arm.

FIG. 2A shows the stress analysis of the load arm mechanism 104. The maximum stress in the square tubing of the load arm mechanism 104 is approximately 10,000 psi. The material yield strength of the load arm mechanism 104 is approximately 44,000 psi. The of the load arm mechanism 104 has 4× factor of safety.

Figure 2B:
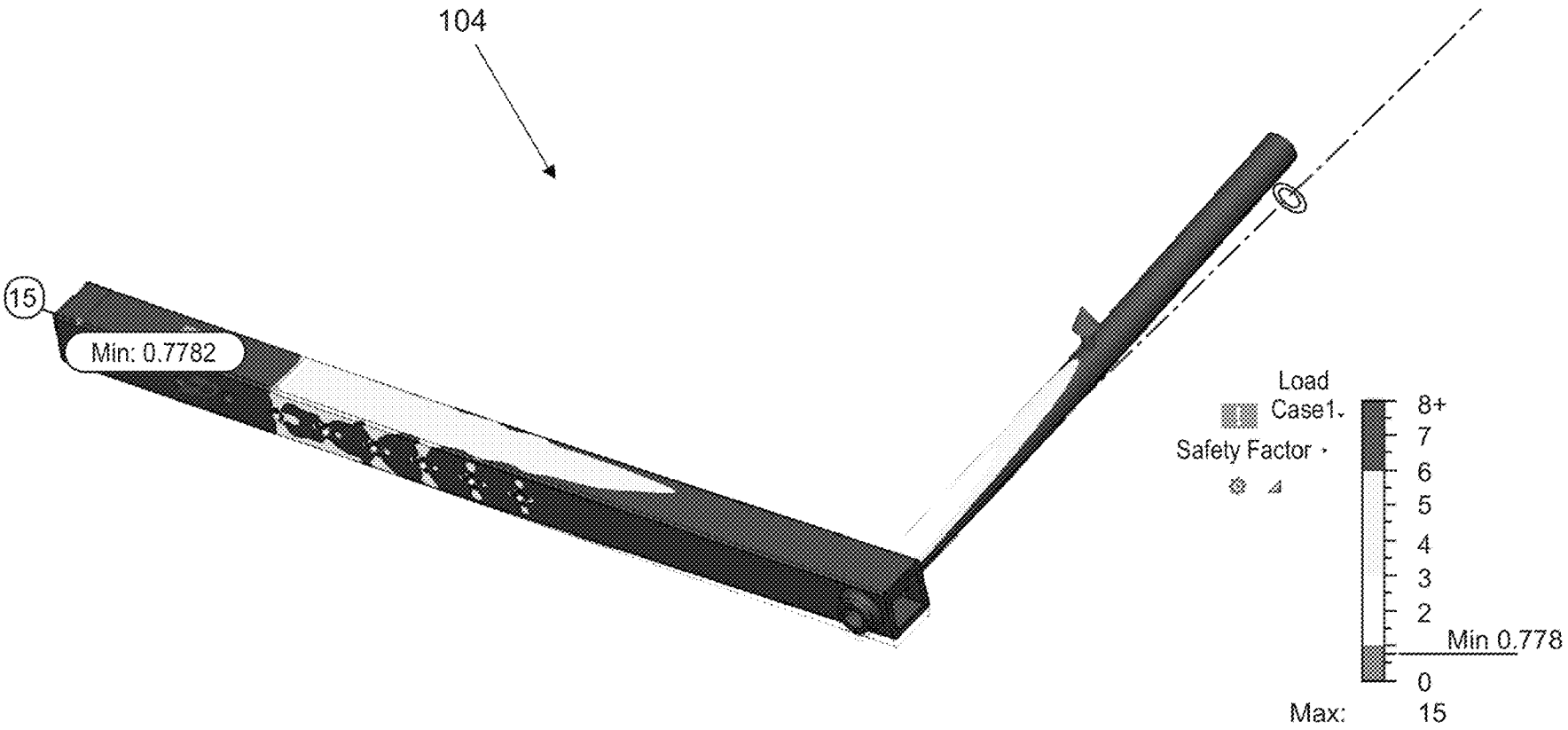
FIG. 2B is an illustration of the load case analysis of the swing arm.
Figure 3A:
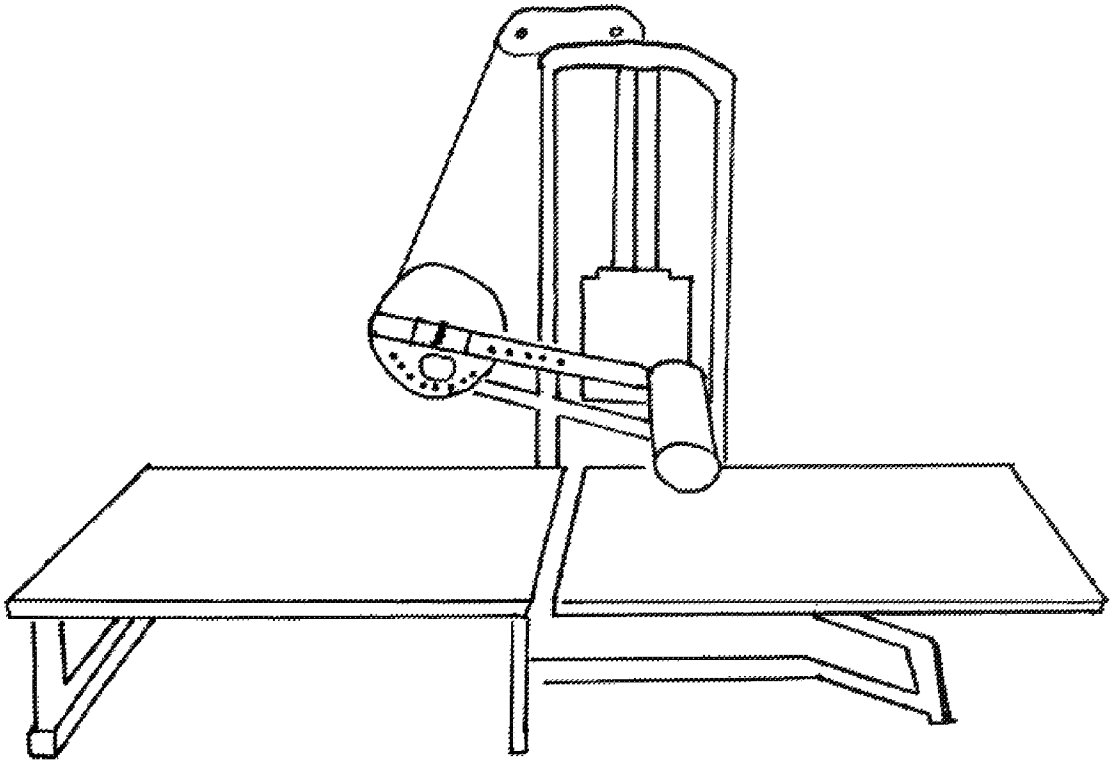
FIG. 3A is a photograph showing a side view of the exercise machine.
Figure 3B:
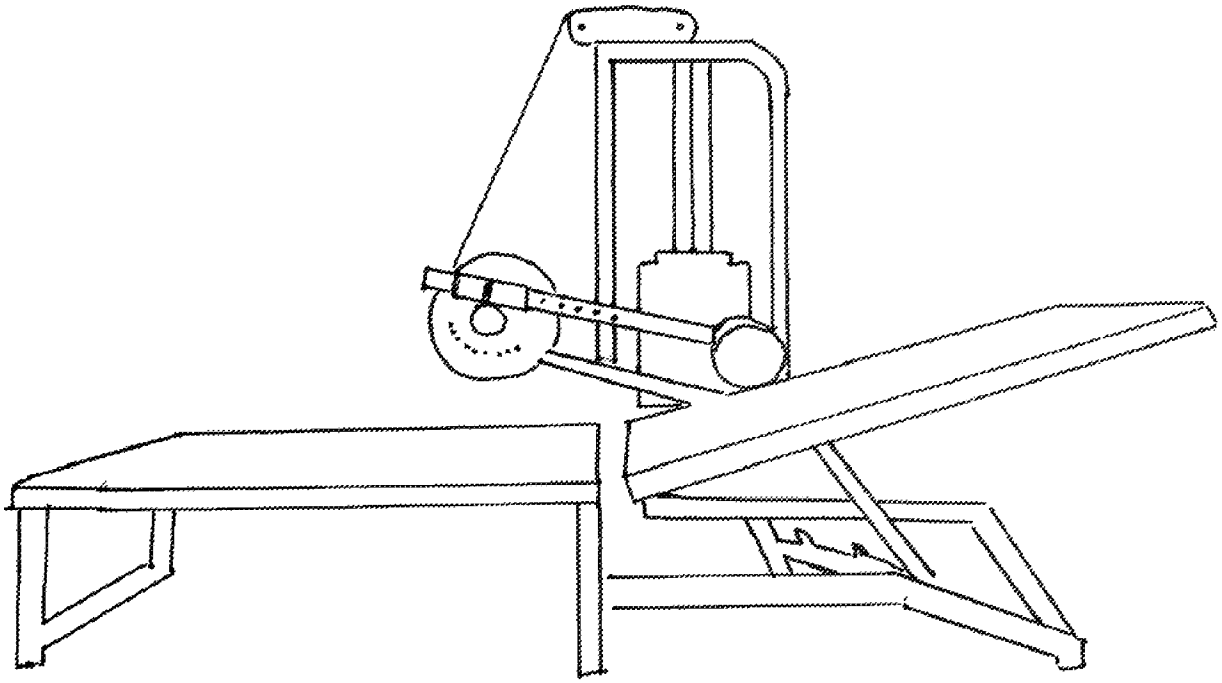
FIG. 3B is a photograph showing an angled side view of the exercise machine.
Figure 3C:
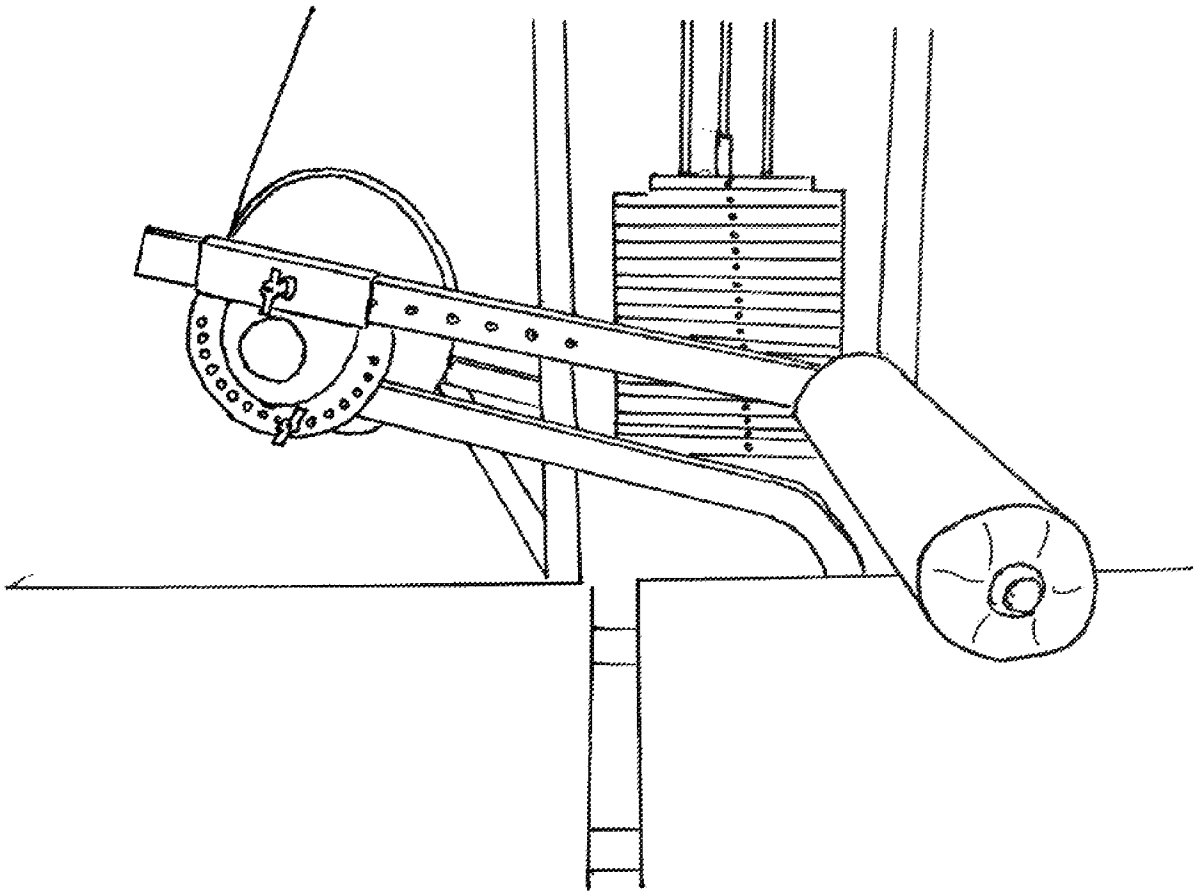
FIG. 3C is a photograph of the load arm mechanism.
Figure 3D:
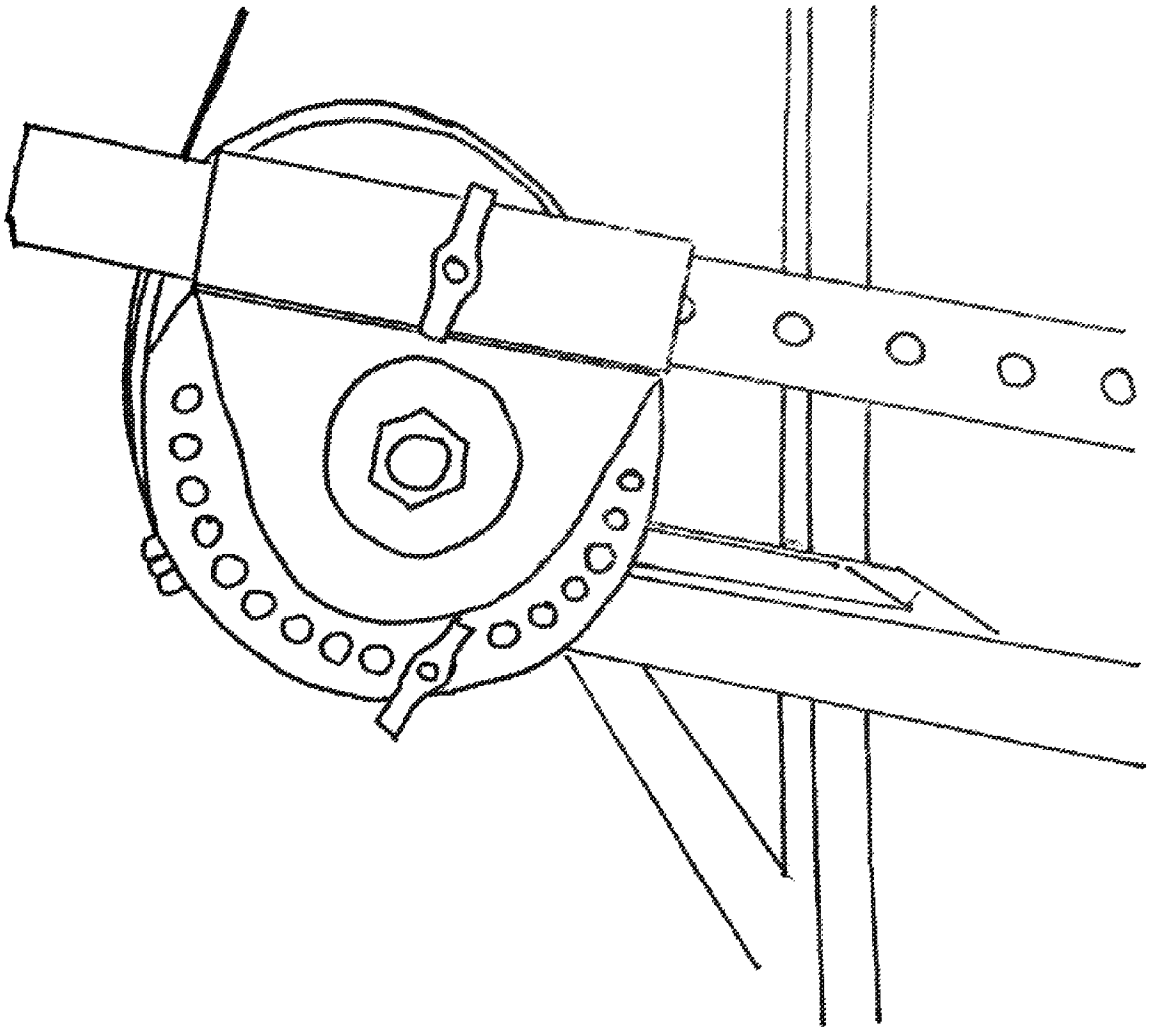
FIG. 3D is a photograph of the load arm angular and linear adjustments.
Figure 3E:
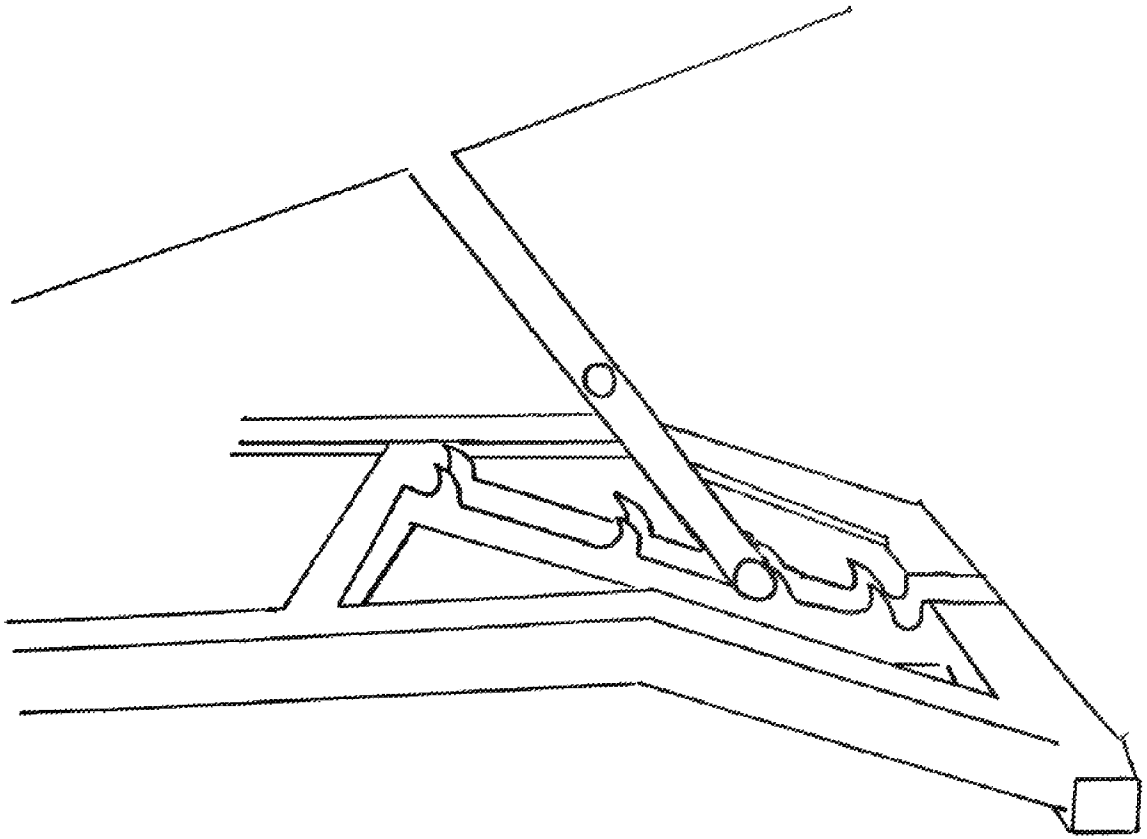
FIG. 3E is a photograph of the angular bench adjustments.

FIG. 2B shows the load analysis of the load arm mechanism 104. The load arm mechanism 104 has a quarter inch wall and a 2-inch by 2-inch square tubing at the maximum extension position. In the load analysis, 250 pounds was applied perpendicularly on the round pipe. The square tube was fixed at the inserted end and should produce minimal error in the analysis. The results are shown in FIG. 2B.

Various accessories and/or modifications can be combined with the exercise machine to allow for modifications in training techniques. These accessories and/or modifications can add varying levels of difficulty as a user becomes more skilled at the basic exercises and techniques, thereby increasing muscular activation of the lumbopelvic core complex. The modifications and accessories disclosed herein can be used to perform a plank, a side plank, a bird-dog, a superman, a lumbar extension, a glute bridge, a single leg raise, a dual-leg raise, a bent leg raise, a resisted push-up, or any other exercise used to train the lumbopelvic core complex.

Figure 4A:
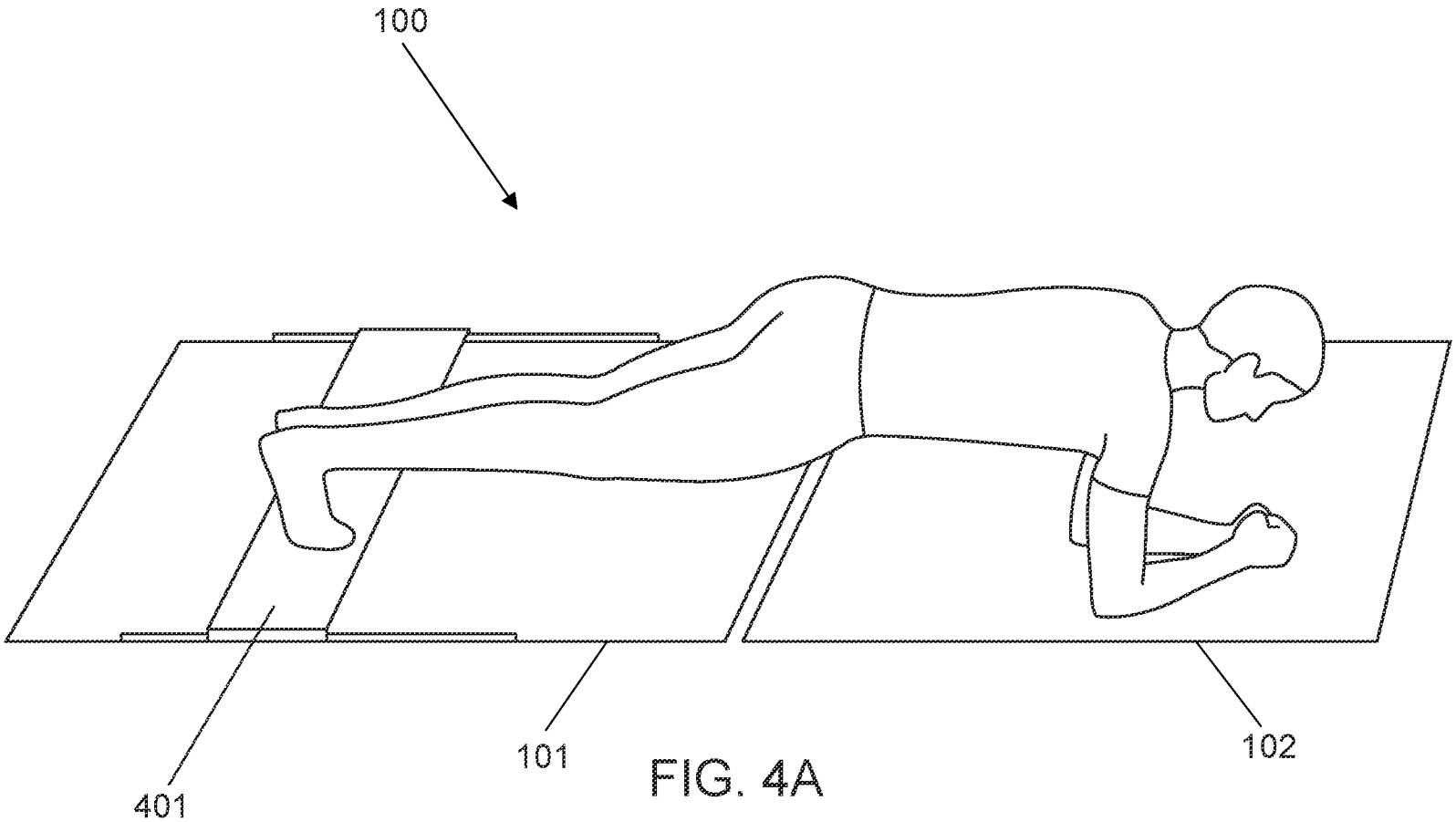
FIGS. 4A-4B are schematics of a user performing a plank exercise using a sliding platform attachment on the exercise machine.
Figure 4B:
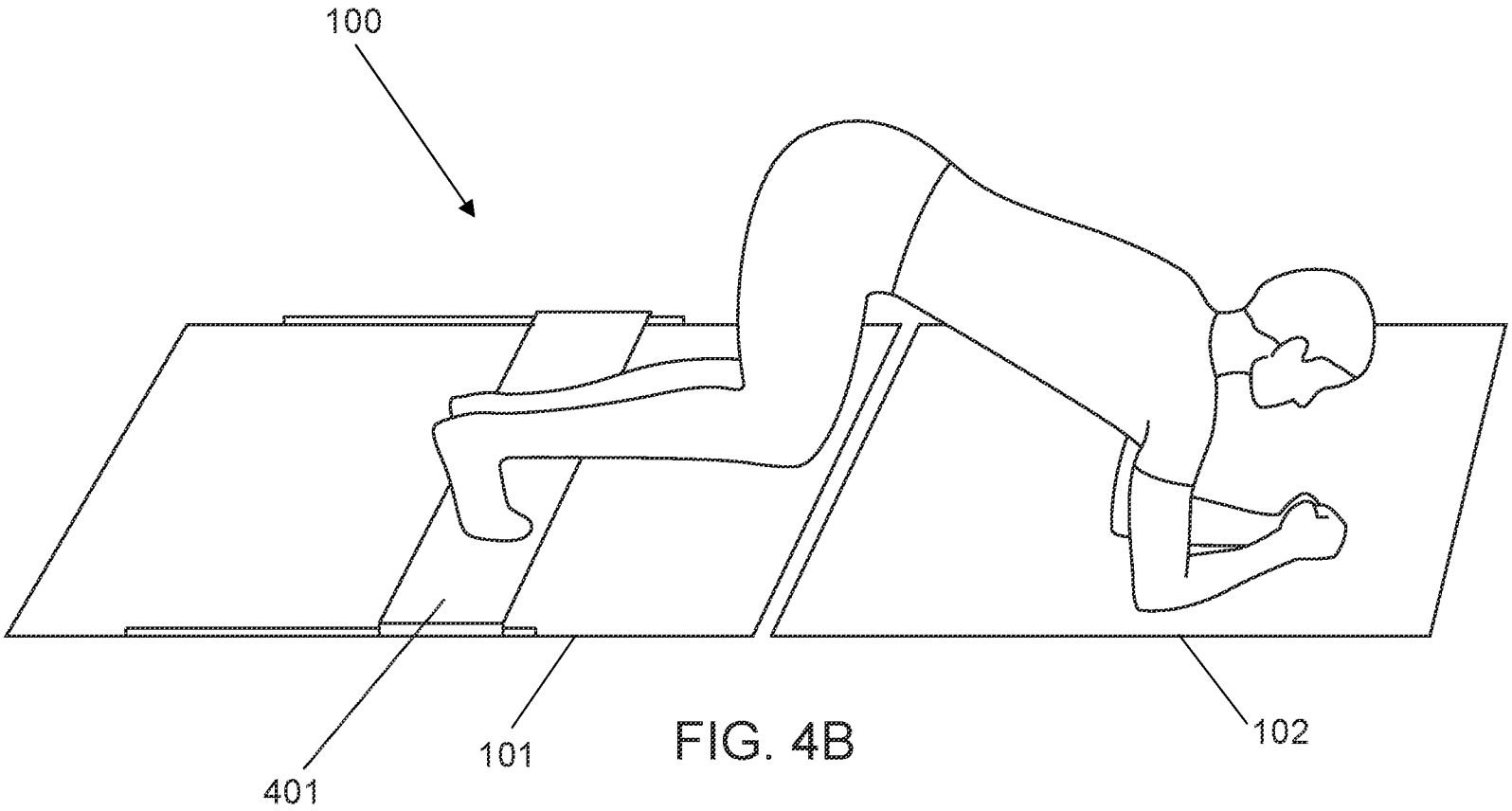

The exercise machine 100 can be modified to include a sliding platform 401 attachment. The sliding platform 401 can be placed on either end of the exercise machine 100. With the sliding platform 401, the user can place one's feet on the sliding platform 401, drawing in or away the lower extremities, thereby adding a dynamic component to the exercises performed on the exercise machine 100, such as a plank exercise as shown in FIGS. 4A-4B. The user can also perform exercises using the sliding platform 401 attachment in the opposite manner whereby the user places the upper extremities on the sliding platform 401 and the lower extremities on the stationary bench 101. The sliding platform 401 may move horizontally freely or may be attached to the exercise machine 100 with a resistance component. The resistance component may be a spring, a band, or any type of resistance that provides a spring-like or recoil resistance.

Figure 5A:
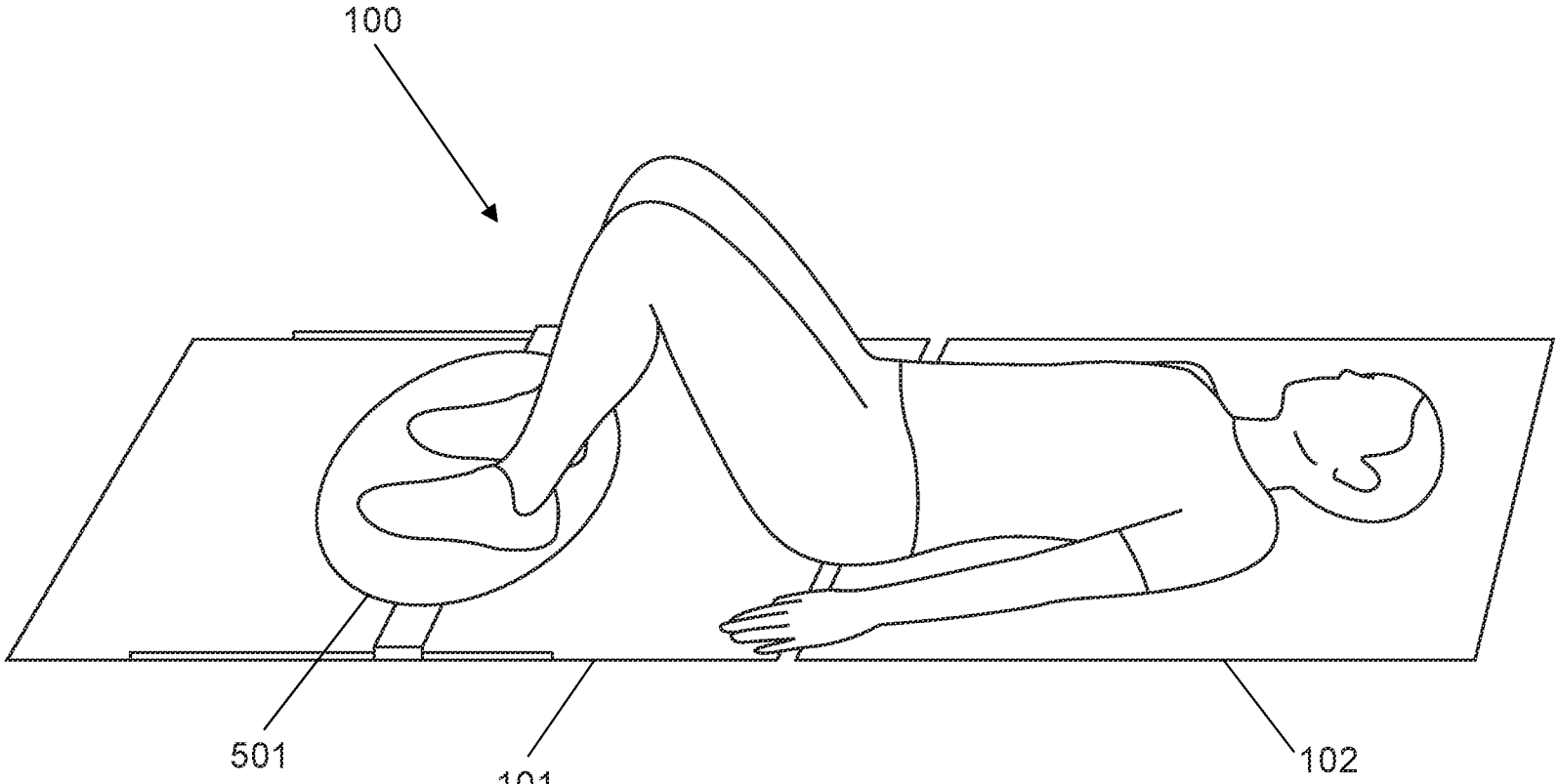
FIG. 5A is a schematic of a user using a swivel platform attachment on the exercise machine.
Figure 5B:
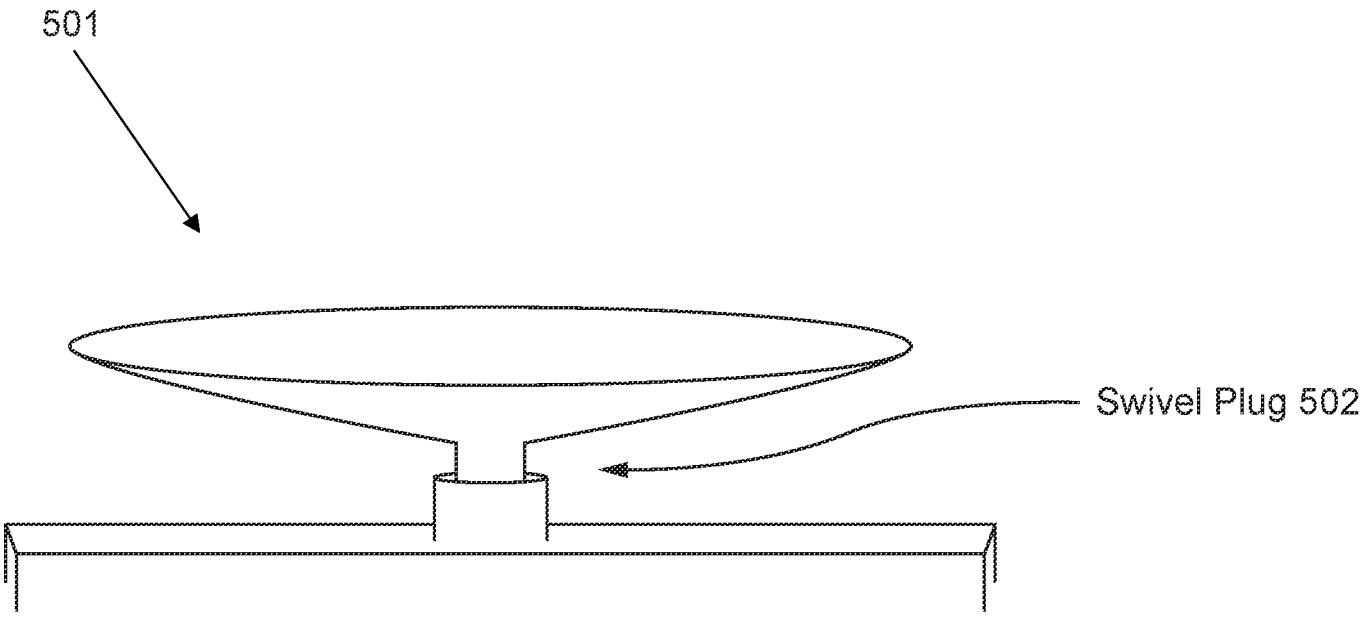
FIG. 5B is a schematic of the swivel platform attachment of FIG. 5A.

The exercise machine 100 can be modified to include a sliding a swivel platform 501 attachment. The swivel platform 501 can be placed on either end of the exercise machine 100. With the swivel platform 501, the user can place one's feet on the swivel platform 501 (shown in FIG. 5A), stabilizing oneself as the platform wobbles/rotates based on the user's weight distribution on the swivel platform. The user can also perform exercises using the swivel platform 501 in the opposite manner whereby the user places the upper extremities on the swivel platform 501 and the lower extremities on the stationary bench 101. The stability of the swivel platform 501 can be adjusted using the swivel plug 502. Varying degrees of difficulty can be achieved based on the placement of the user's feet and the tightness of the swivel mechanism.

Figure 6A:
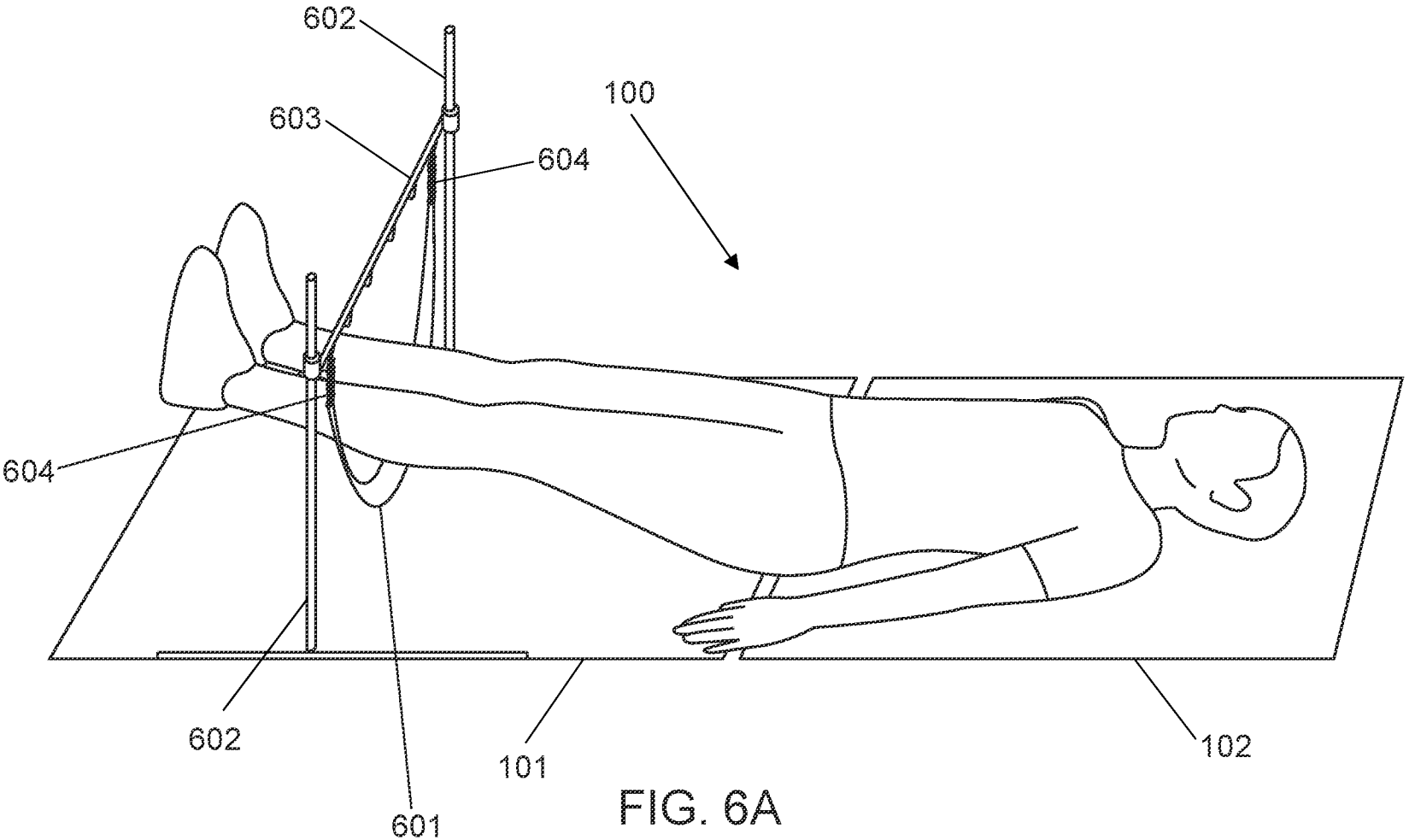
FIG. 6A is a schematic of a user using a suspended sling attachment on the exercise machine.
Figure 6B:
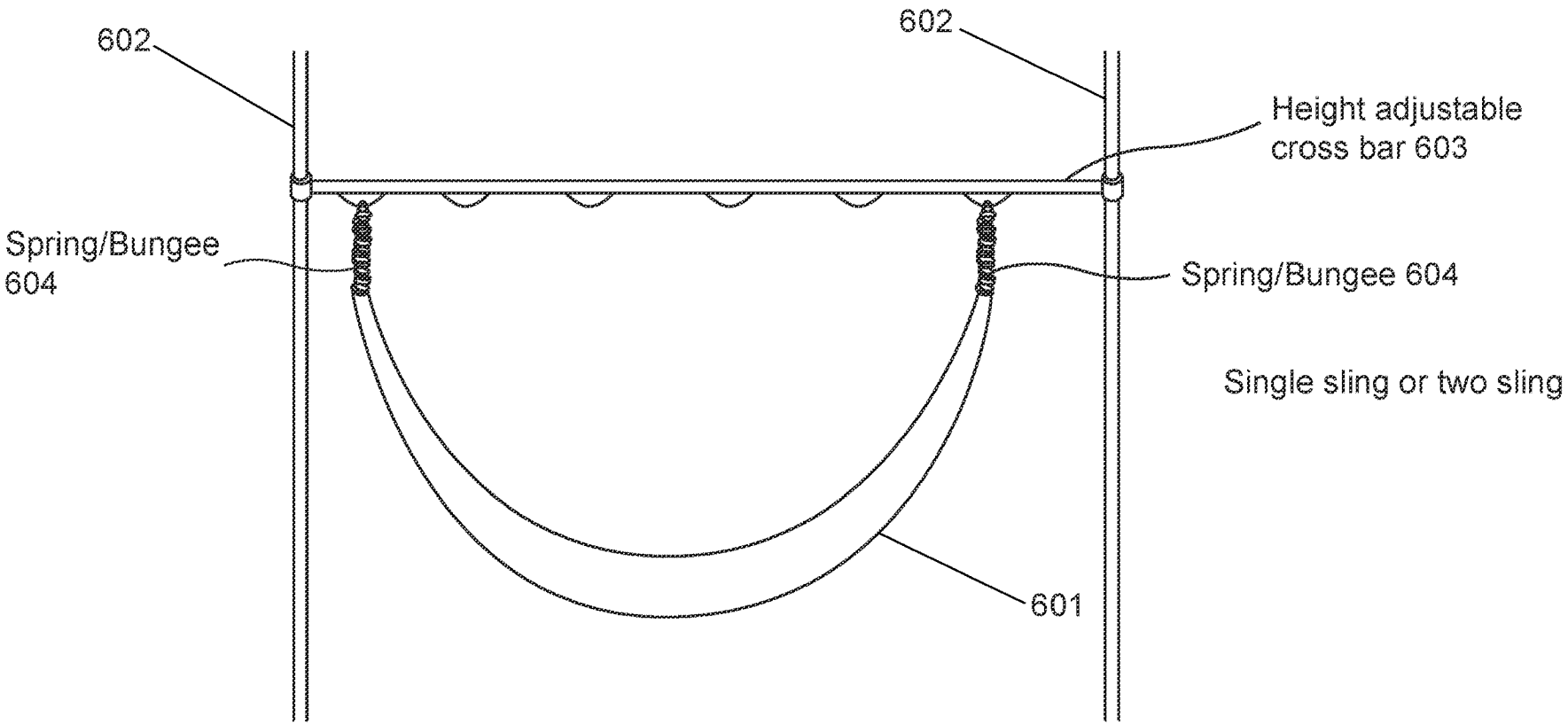
FIG. 6B is a schematic of the suspended sling attachment of FIG. 6A.

The exercise machine 100 can be modified to include a suspended sling 601. The user can position one or two extremities within the sling 601. Two vertical posts 602 with a height-adjustable crossbar 603 can be added to the exercise machine 100 so as to attach the suspended sling 601 as shown in FIG. 6B. The sling 601 can be attached to the front or back of the exercise machine 100 to enable the user to place either their arms or legs in the sling. Various attachment points along the crossbar 603 allow for the sling mechanism to be placed at different locations. Alternatively, multiple slings can be attached along the horizontal crossbar. A spring or bungee 604 mechanism can be attached to the suspended sling 601 to increase the level of difficulty of the exercise. With the suspended sling 601, the user can place one's feet or lower extremities onto the sling 601 as shown in FIG. 6A. Two slings 601 can also be used allowing the user to place each foot or lower extremity into separate slings. Alternatively, the user can place one's upper extremities into the sling 601. Two slings 601 can also be used allowing the user to place arm into separate slings 601. The suspended sling or slings 601 allows the user to perform exercises on the exercise machine 100, such as a glute bridge or plank, with increased difficulty due to the unsteadiness of the extremities in the suspended slings 601. An exemplary suspension sling is a TRX Suspension Training® system. As a result of the diminished stability from the user's fixation points to the exercise machine 100, greater trunk and core coordination is required with this technique.

The platform of the exercise machine 100 can be made unstable by adjusting the stationary bench 101, a rotating bench 102, or the support structure 103. The stability can be adjusted to be either immobile and secure or unstable. The exercise machine 100 can be fixed to the ground or other stable support structure to enforce stability. The exercise machine 100 can also be unfixed to allow for varying degrees of instability or wobbliness. At least one inflatable hemisphere can be disposed on at least one of the stationary bench 101 or the rotating bench 102. For example, the inflatable hemisphere can be a BOSU® ball. The platform of the BOSU® ball or inflatable hemisphere may be placed on the stationary bench 101 or on the rotating bench 102, and the user places his or her feet, back, or forearms on the ball. The degree of instability or wobbliness may be adjusted by varying the amount of air pressure inside the bladder of the BOSU® ball or inflatable hemisphere. As a result of the diminished stability from the user's fixation points to the exercise machine 100, greater trunk and core coordination is required with this technique.

The exercise machine 100 can be made of any material capable of withstanding a sufficient amount of force and load from added resistance and to prevent rotation of the apparatus. The material may include but is not limited to metal, plastic, wood, or PVC. The material is preferably steel-based to allow for substantial durability.

Methods of Using the Exercise Machine of Example 1

The exercise machine 100 of Example 1 can be used to train the lumbopelvic core muscles by allowing the user to simulate a variety of core strengthening exercises including, but not limited to, a plank, a side plank, a glute bridge, a bird-dog, a superman, a lumbar extension, a leg raise (single-leg, dual-leg, or bent leg), a resisted push-up, or other exercises specifically used to target the core muscles. The user is able to progressively improve their strength through the use of added resistance. The resistance means comprises at least a weight stack, a resistance, band, a guided weight resistance, or a friction based resistance. The exercises may be performed with the exercise machine 100 substantially parallel to the ground and fixed to the ground. The exercises can be performed by varying the angle $\alpha$ of the rotating bench 102. Alternatively, the exercises may be performed where at least one of the stationary bench 101 or the rotating bench 102 is positioned on at least one inflatable hemisphere. The exercise machine 100 of Example 1 simulates the most effective exercises to strengthen these muscles by means of a guided exercise machine as described herein.

Figure 7A:
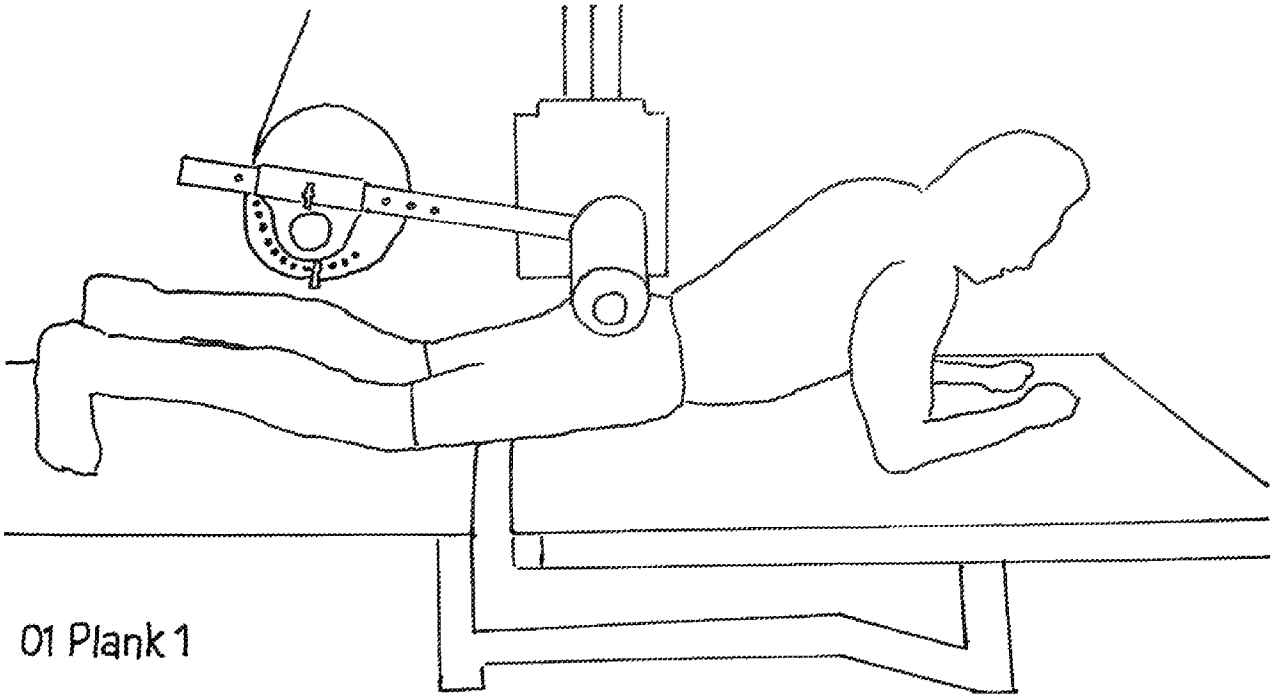
FIGS. 7A-7C are photographs of a user performing one repetition of a plank (FIG. 7A—start position, FIG. 7B—full plank hold position, FIG. 7C—final position) on the exercise machine.
Figure 7B:
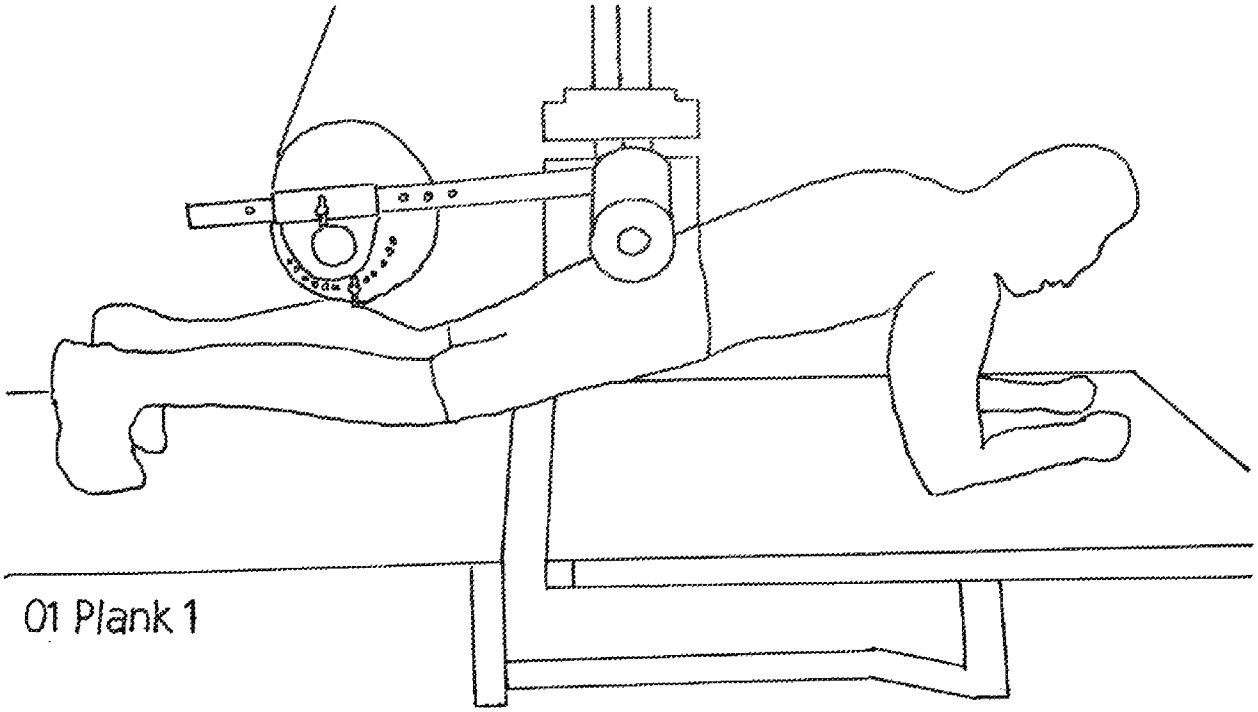
Figure 7C:
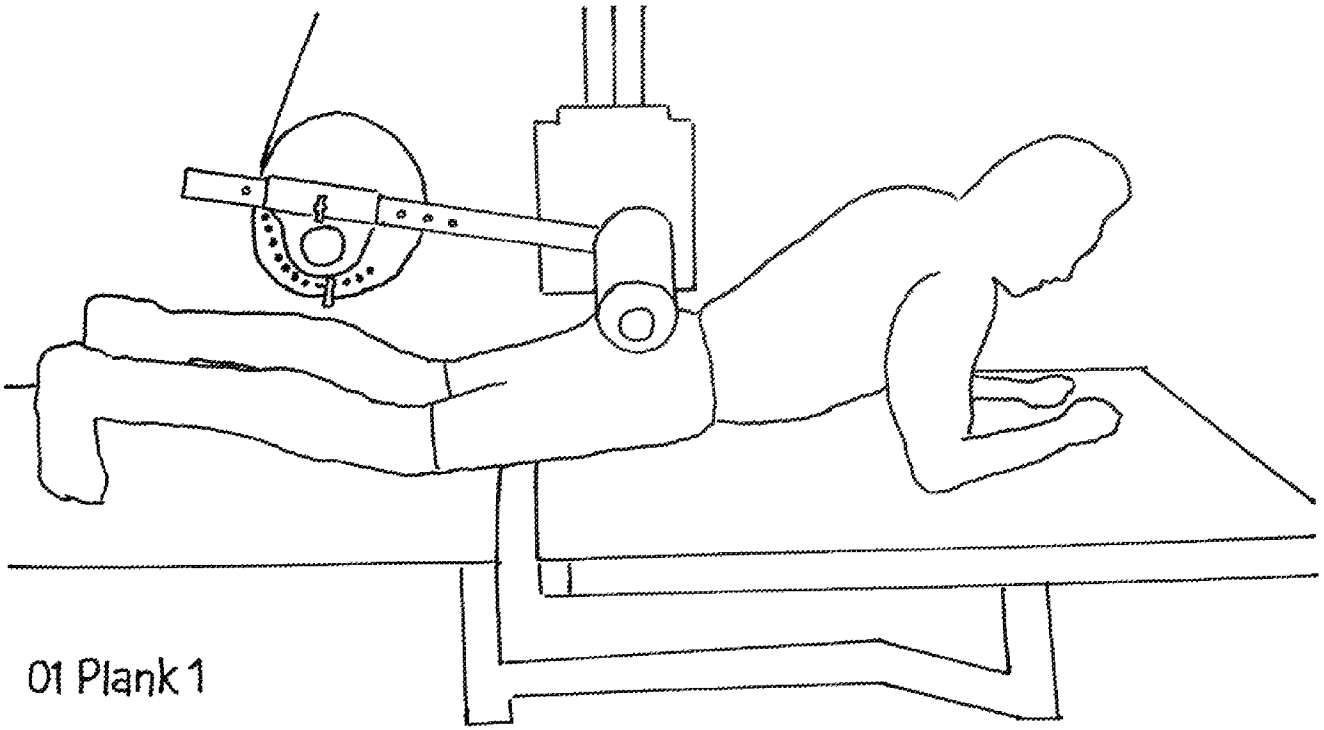

A plank exercise engages the core, strengthens the transverse abdominus muscle, and creates the flat abdominal appearance that many seek to attain aesthetically. FIGS. 7A-7C are photographs of a user performing one repetition of a plank on the exercise machine 100 of Example 1. The user is shown on the exercise machine 100 at the starting position (FIG. 7A), the full plank hold position (FIG. 7B), and the final position (FIG. 7C).

Figure 8A:
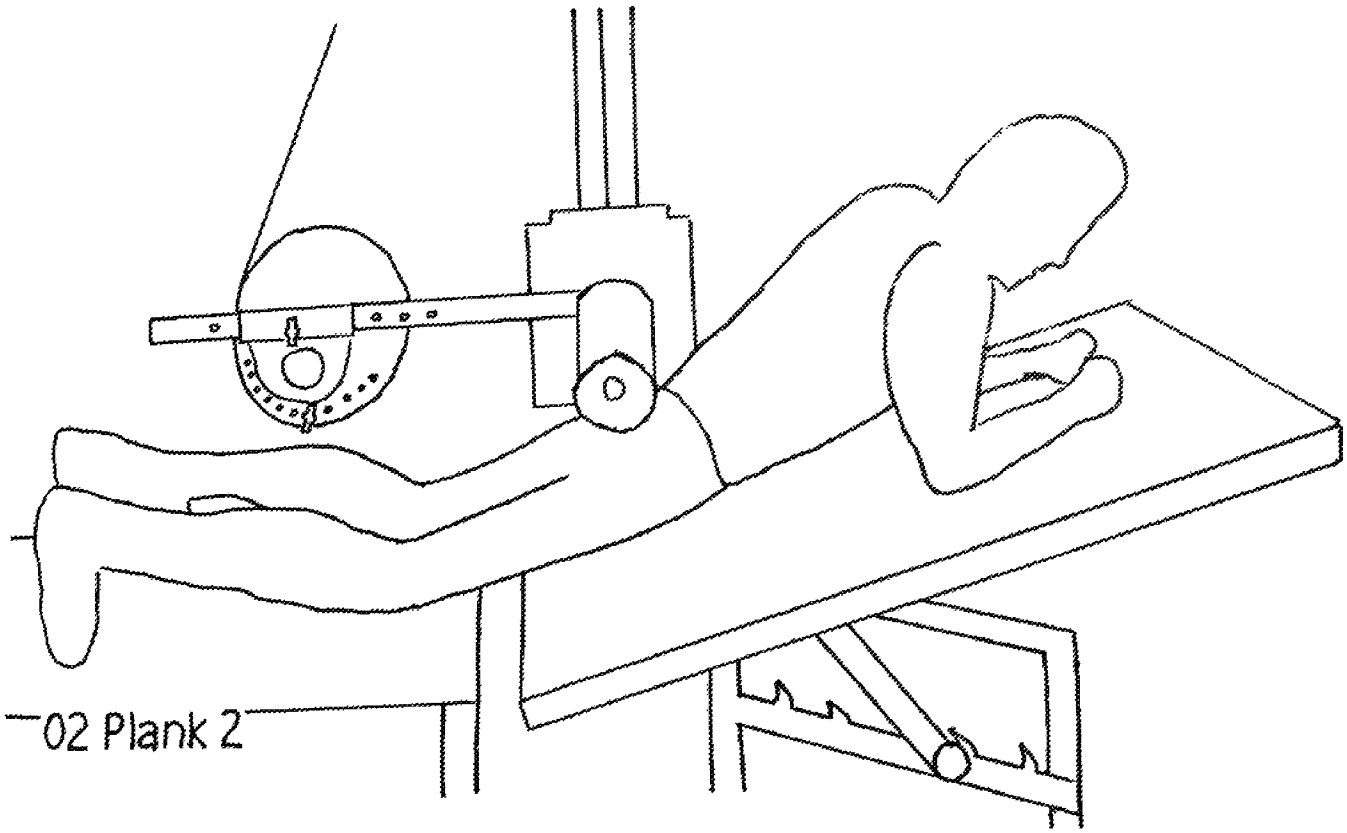
FIGS. 8A-8C are photographs of a user performing one repetition of a modified plank (FIG. 8A—start position, FIG. 8B—full plank hold position, FIG. 8C—end position) on the exercise machine.
Figure 8B:
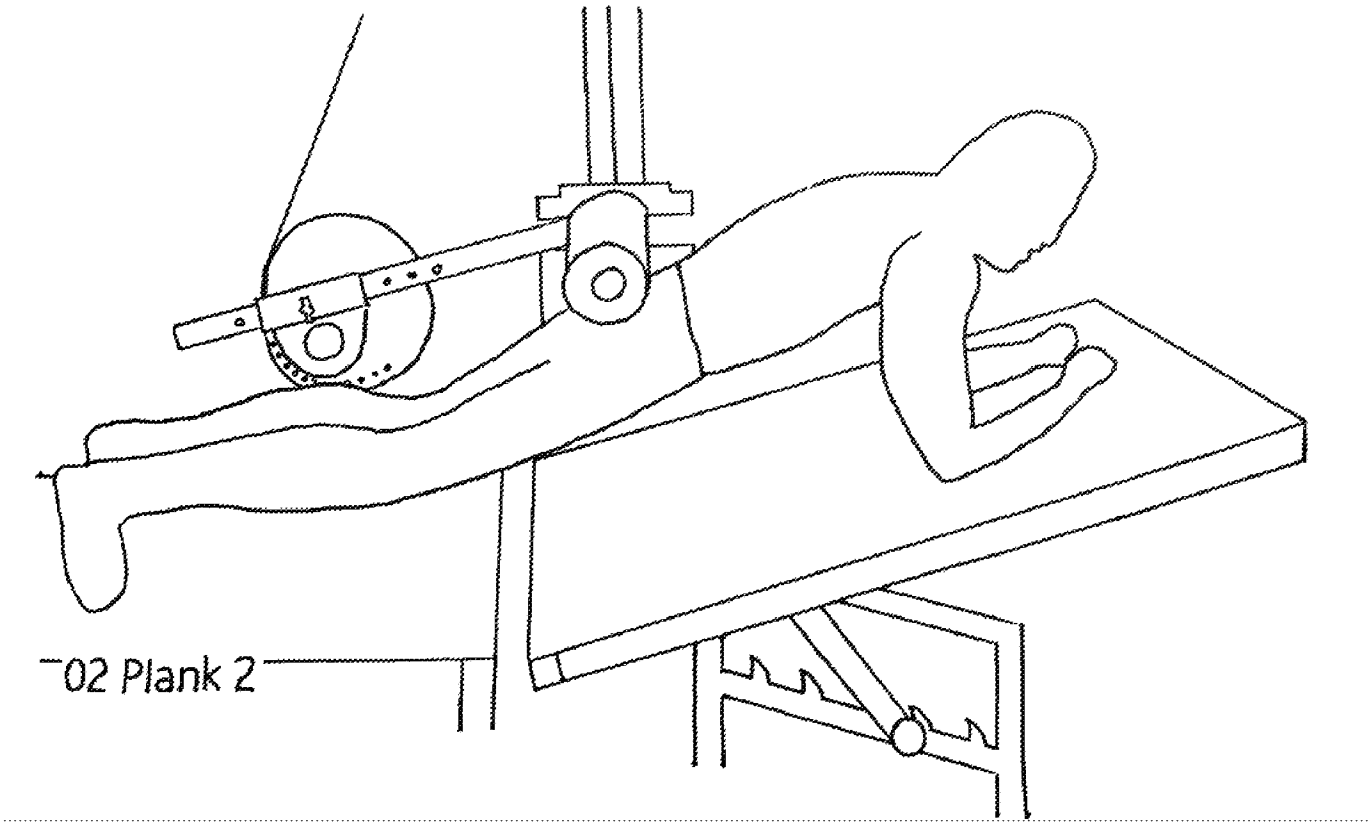
Figure 8C:
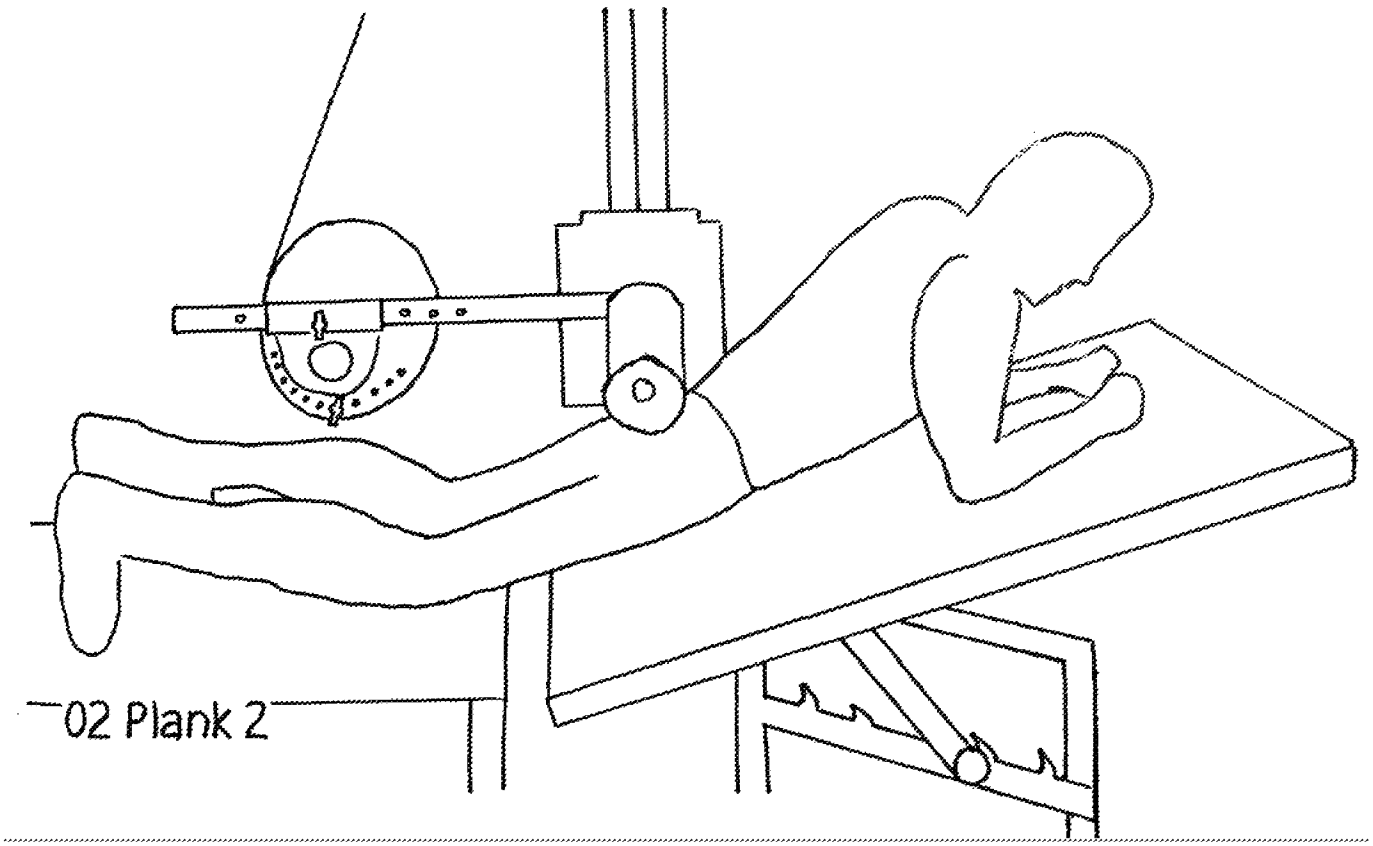

The rotating bench 102 can be vertically adjusted to allow for the user to perform a modified plank. FIG. 8A-8C show a user performing one repetition of a modified plank with the rotating bench 102 at an upwards angle.

Figure 9A:
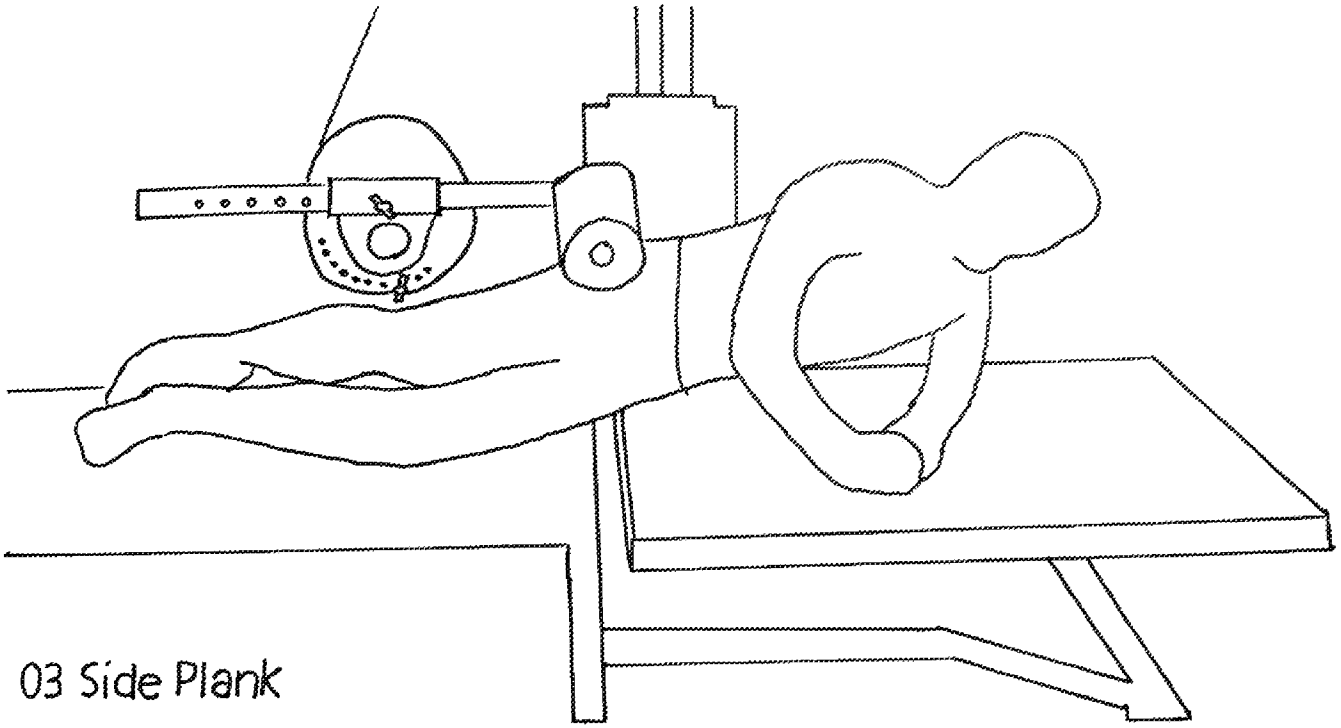
FIGS. 9A-9C are photographs of a user performing one repetition of a side plank (FIG. 9A—start position, FIG. 9B—full plank hold position, FIG. 9C—end position) on the exercise machine.
Figure 9B:
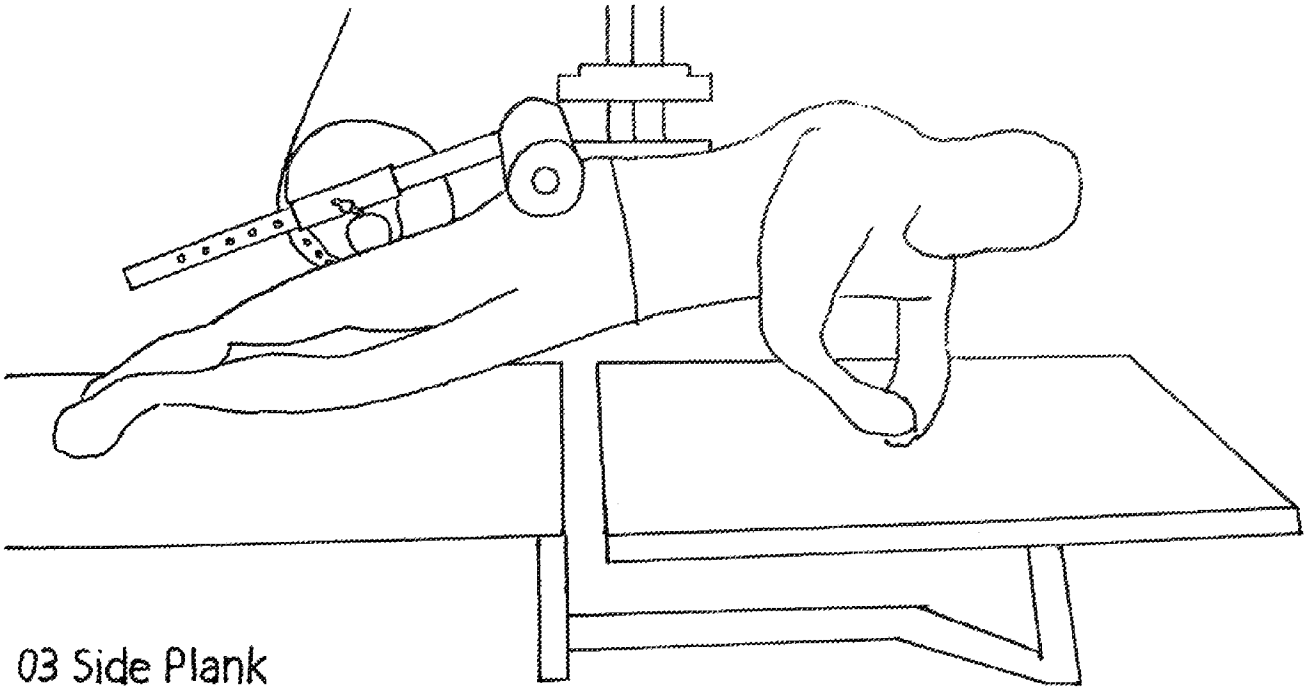
Figure 9C:
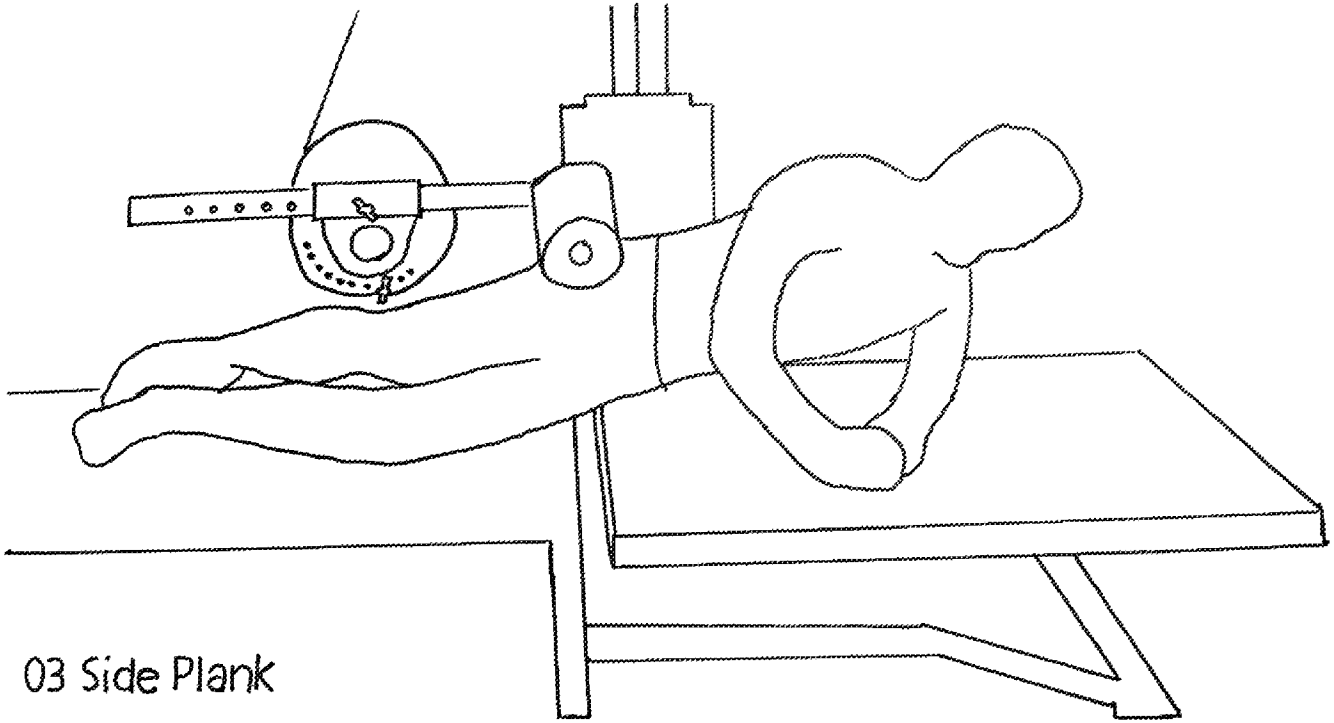

The exercise machine 100 of Example 1 can also be used to perform a side plank. FIG. 9A-9C show a user performing one repetition of a side plank.

The exercise machine 100 of Example 1 allows for additional resistance to be applied using the resistance bar 106 and weight stack 105. Different additions or attachments can be added to the exercise machine 100, including but not limited to a leg sling, a rotating stability platform, a weight stack, or a resistance band to allow for additional modifications of the plank exercise.

Figure 10A:
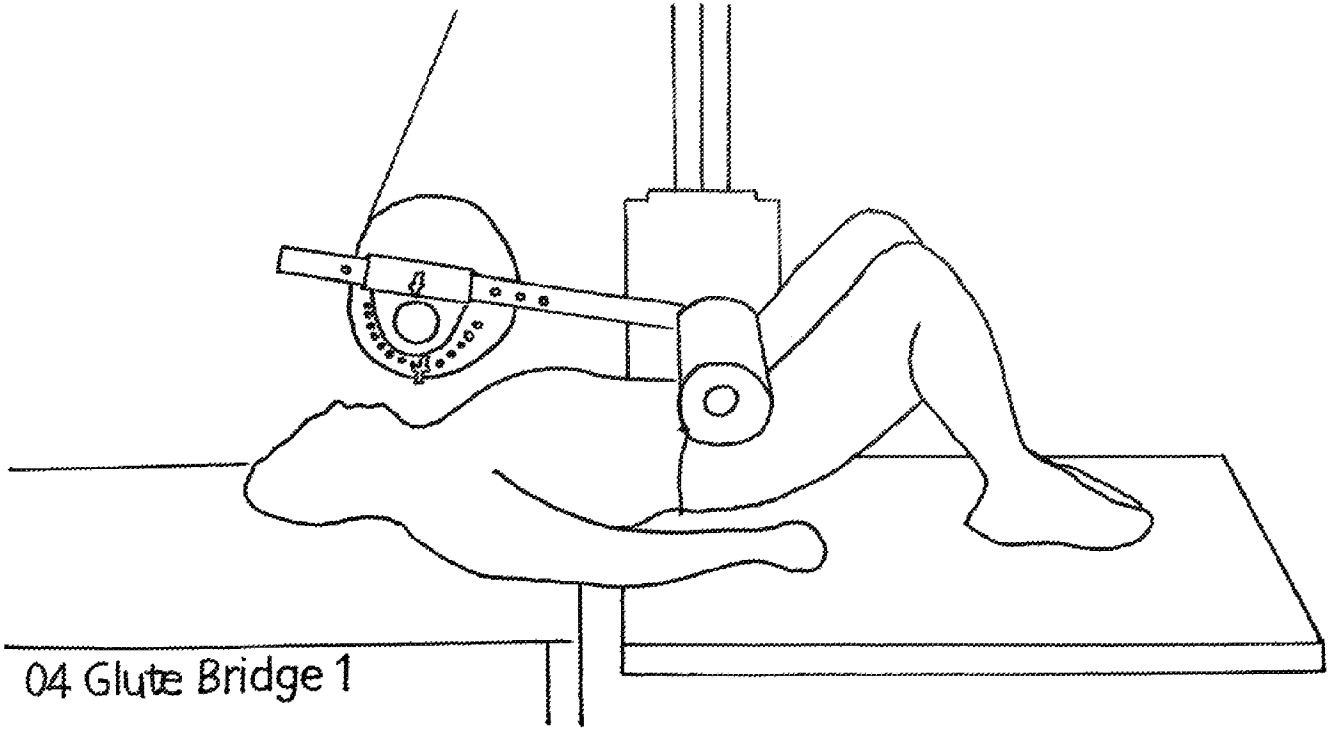
FIGS. 10A-10C are photographs of a user performing one repetition of a glute bridge (FIG. 10A—start position, FIG. 10B—bridged position, FIG. 10C—end position) on the exercise machine.
Figure 10B:
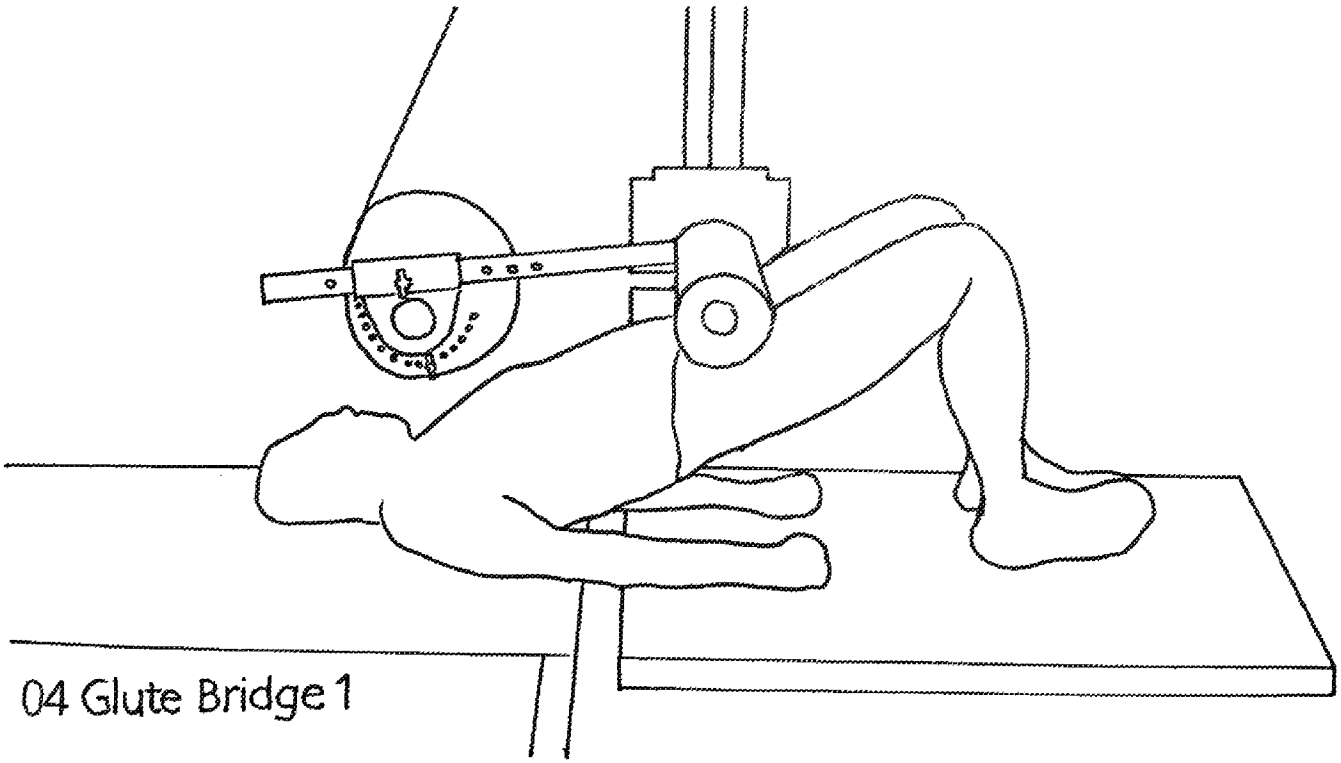
Figure 10C:
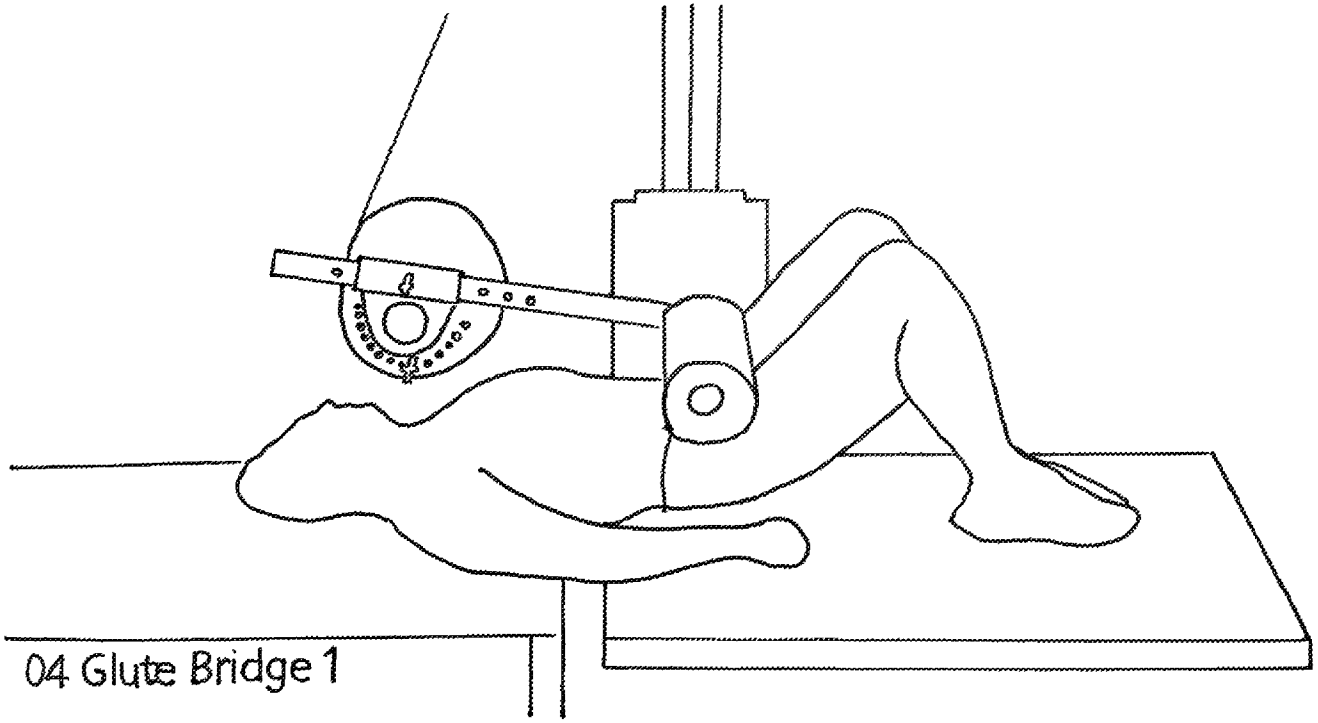
Figure 11A:
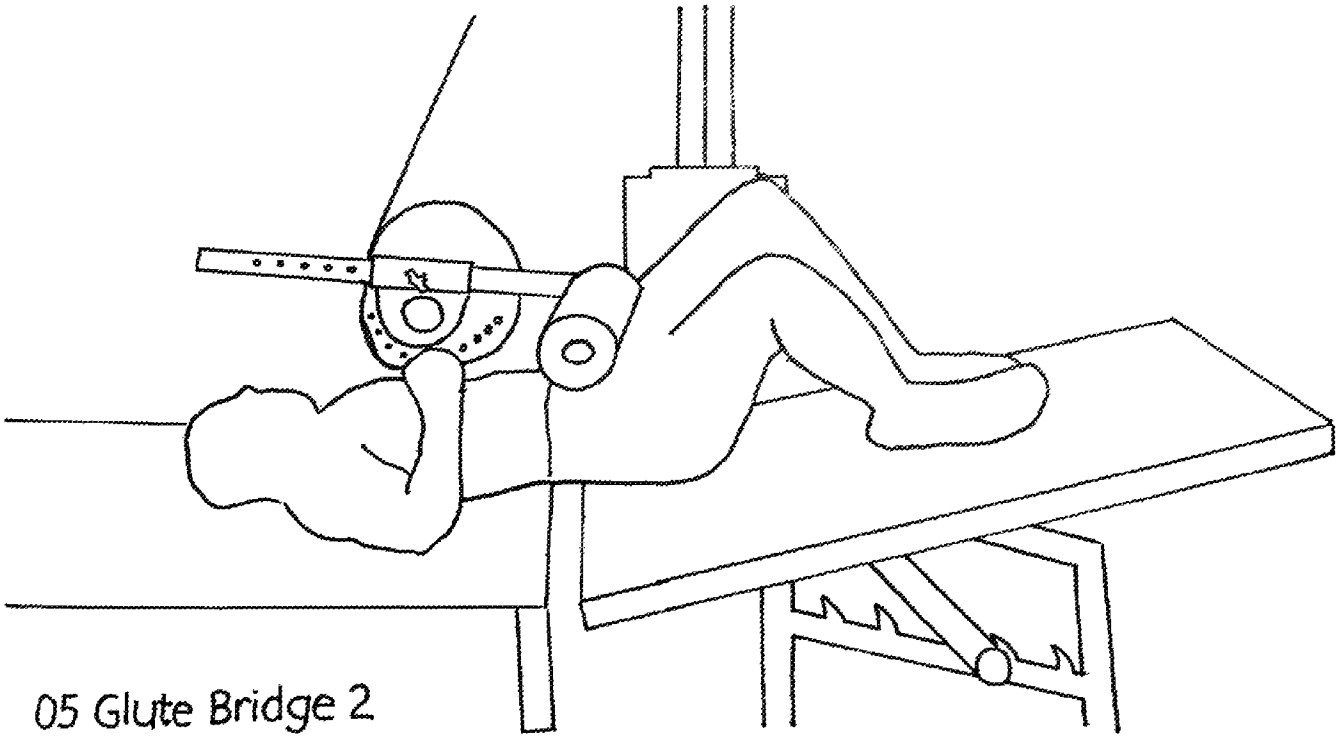
FIGS. 11A-11C are photographs of a user performing one repetition of a modified glute bridge (FIG. 11A—start position, FIG. 11B—bridged position, FIG. 11C—end position) on the exercise machine.
Figure 11B:
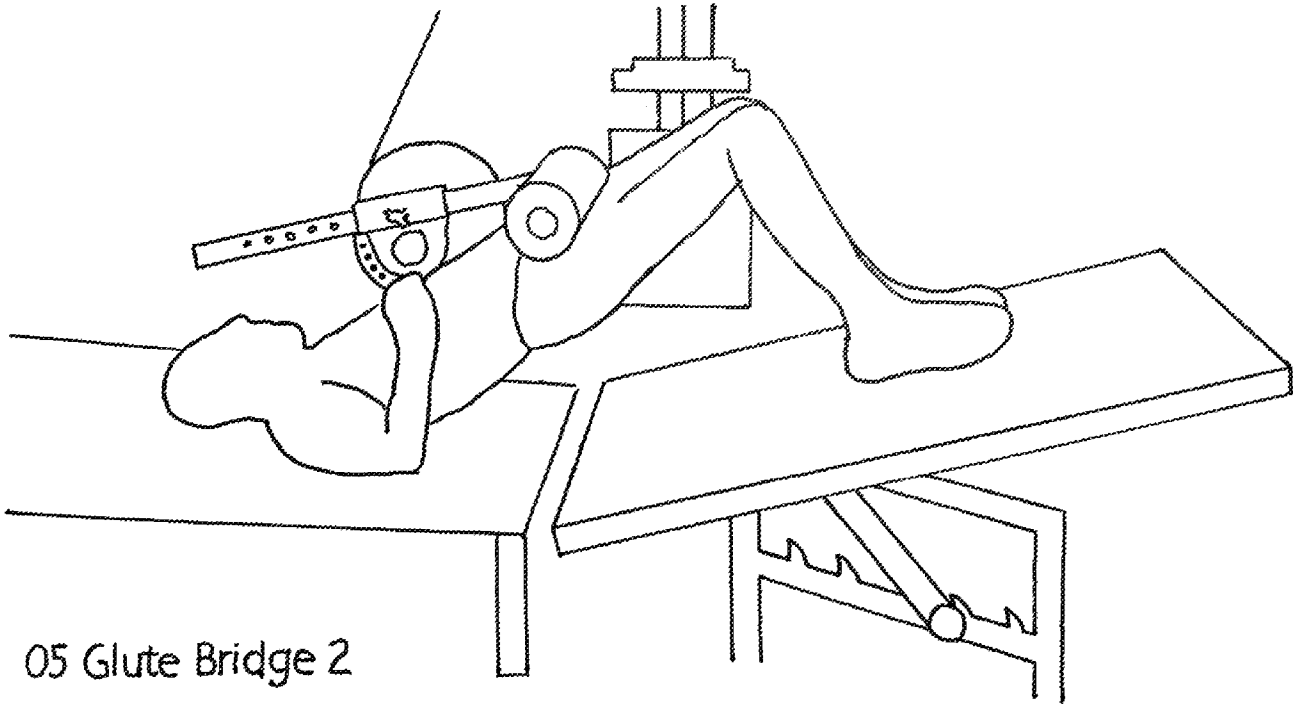
Figure 11C:
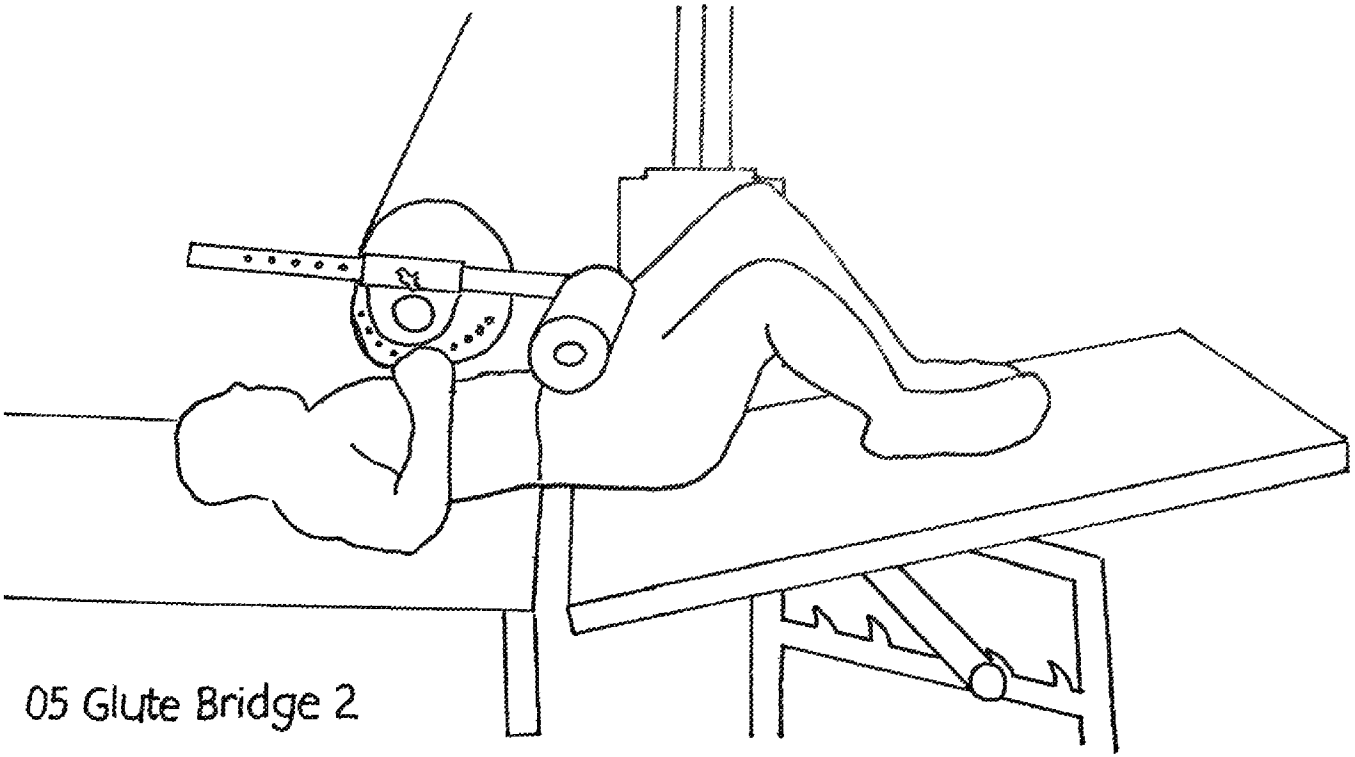
Figure 12A:
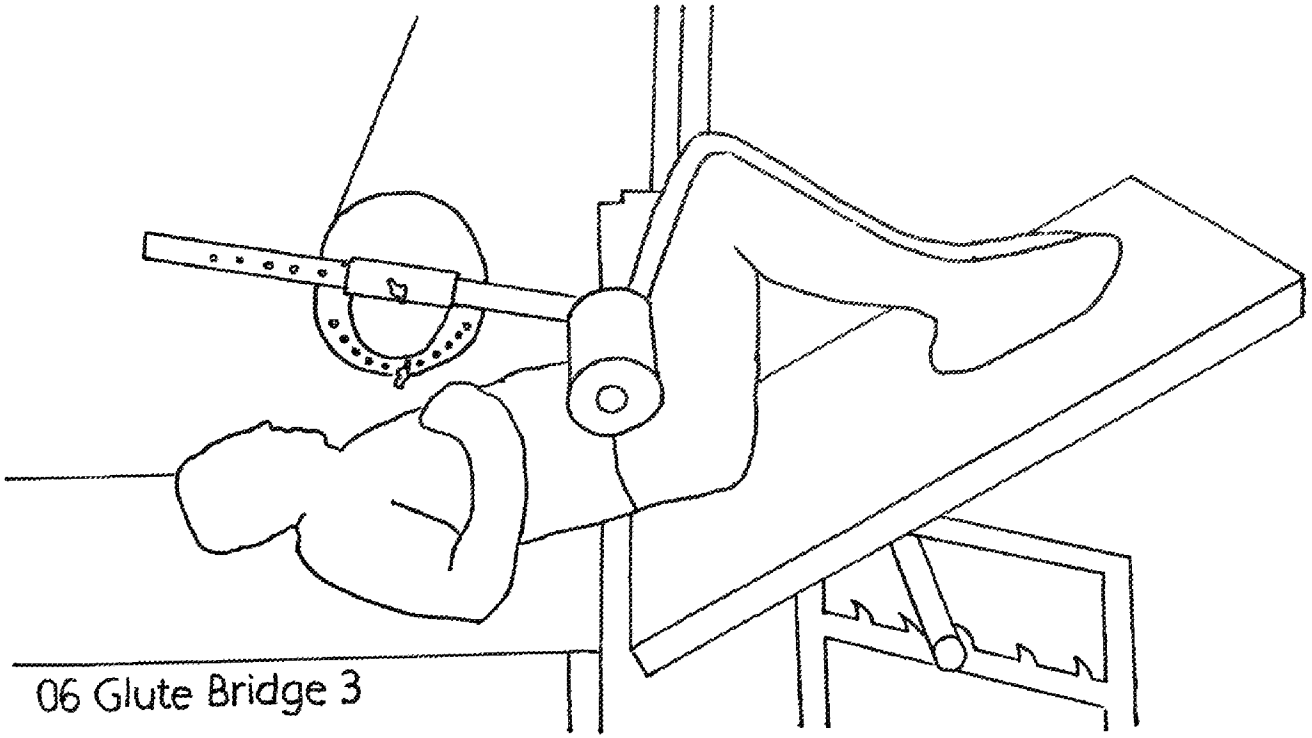
FIGS. 12A-12C are photographs of a user performing one repetition of a modified glute bridge (FIG. 12A—start position, FIG. 12B—bridged position, FIG. 12C—end position) on the exercise machine.
Figure 12B:
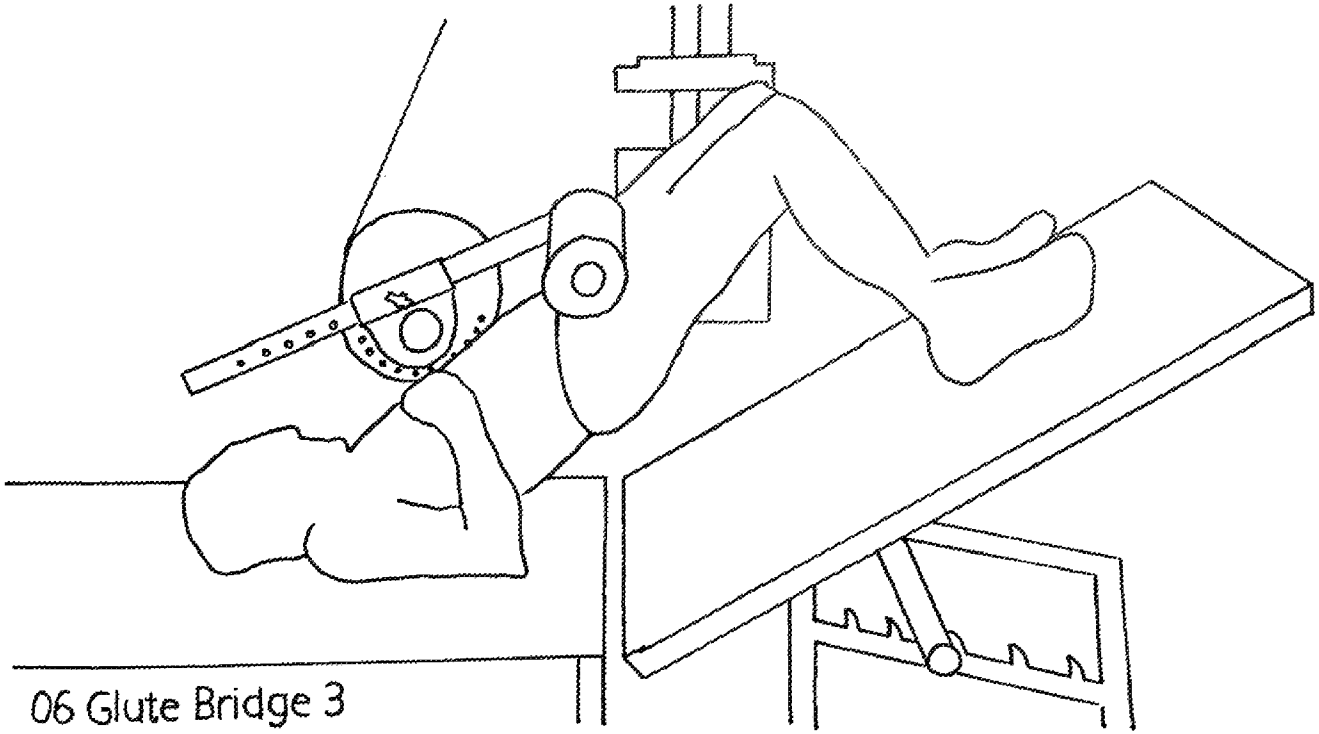
Figure 12C:
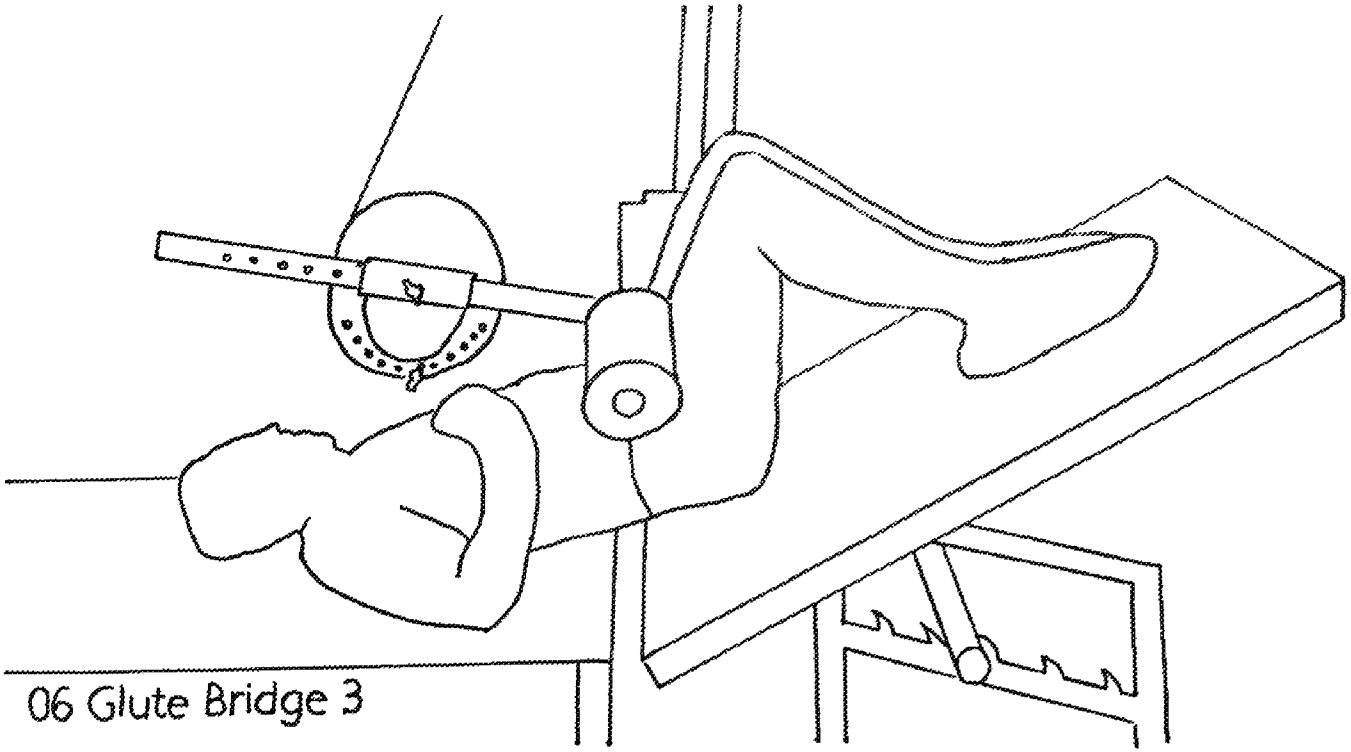

A glute bridge exercise strengthens not only the gluteal muscles, but also core muscles, including the multifidus, transverse abdominus, and pelvic floor muscles. To perform a glute bridge, the user lies on his or her back with the hips and knees flexed. He or she then elevates the hips/pelvis off the floor while keeping the feet and shoulders/posterior torso on the bench or ground. The user then returns to the start position. FIGS. 10A-10C are photographs of a user performing one repetition of a glute bridge on the exercise machine 100 of Example 1. The user is shown on the exercise machine 100 at the starting position (FIG. 10A), the bridged position (FIG. 10B), and the final position (FIG. 10C).

The rotating bench 102 can be vertically adjusted to allow for the user to perform a modified glute bridge. FIGS. 11A-11C and FIGS. 12A-12C show a user performing one repetition of a modified plank with the rotating bench 102 at multiple upwards angles. The exercise machine 100 of Example 1 allows for additional resistance to be applied using the resistance bar 106 and weight stack 105. The resistance bar 106 is positioned over the anterior proximal thighs or near the pubic symphysis and then translated vertically when performing the glute bridge. Different additions or attachments can be added to the exercise machine 100, including but not limited to a leg sling, a rotating stability platform, a weight stack, or a resistance band to allow for additional modifications of the glute bridge exercise.

Figure 13A:
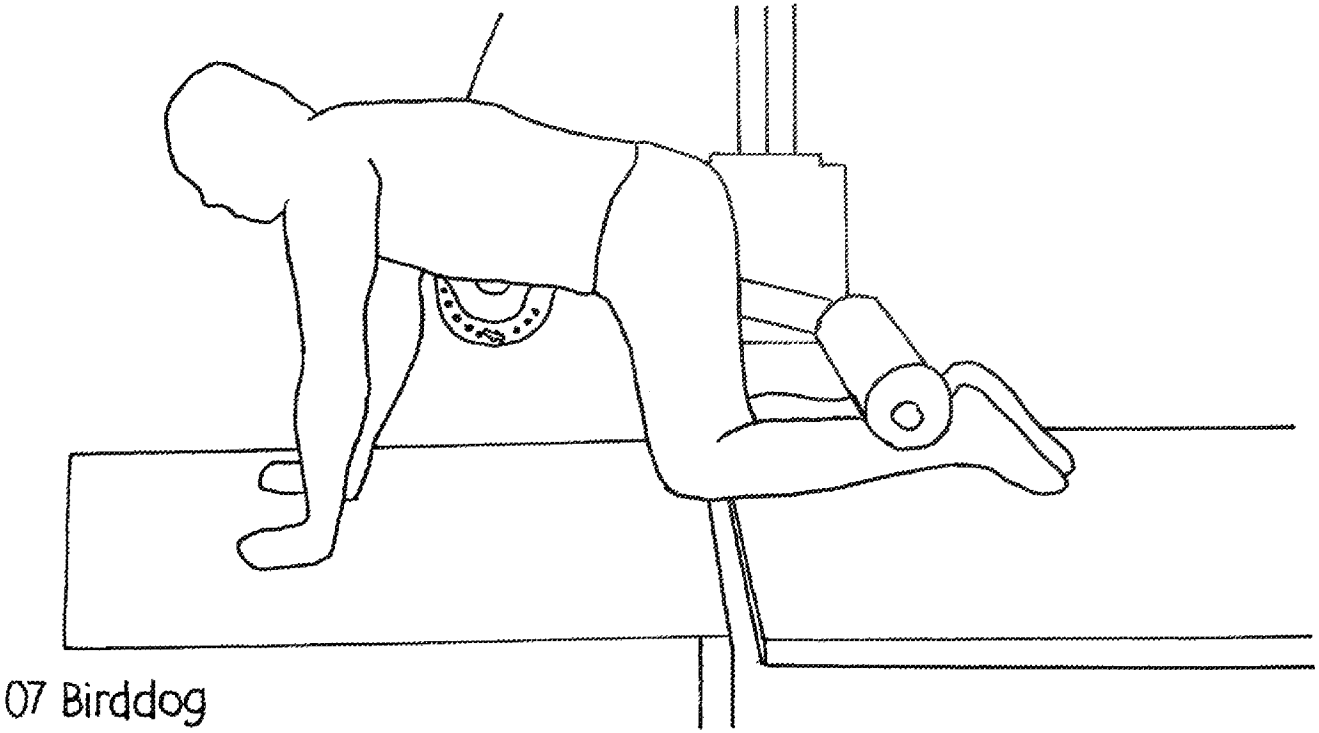
FIGS. 13A-13C are photographs of a user performing one repetition of a bird-dog (FIG. 13A—start position, FIG. 13B—bird-dog hold position, FIG. 13C—end position) on the exercise machine.
Figure 13B:
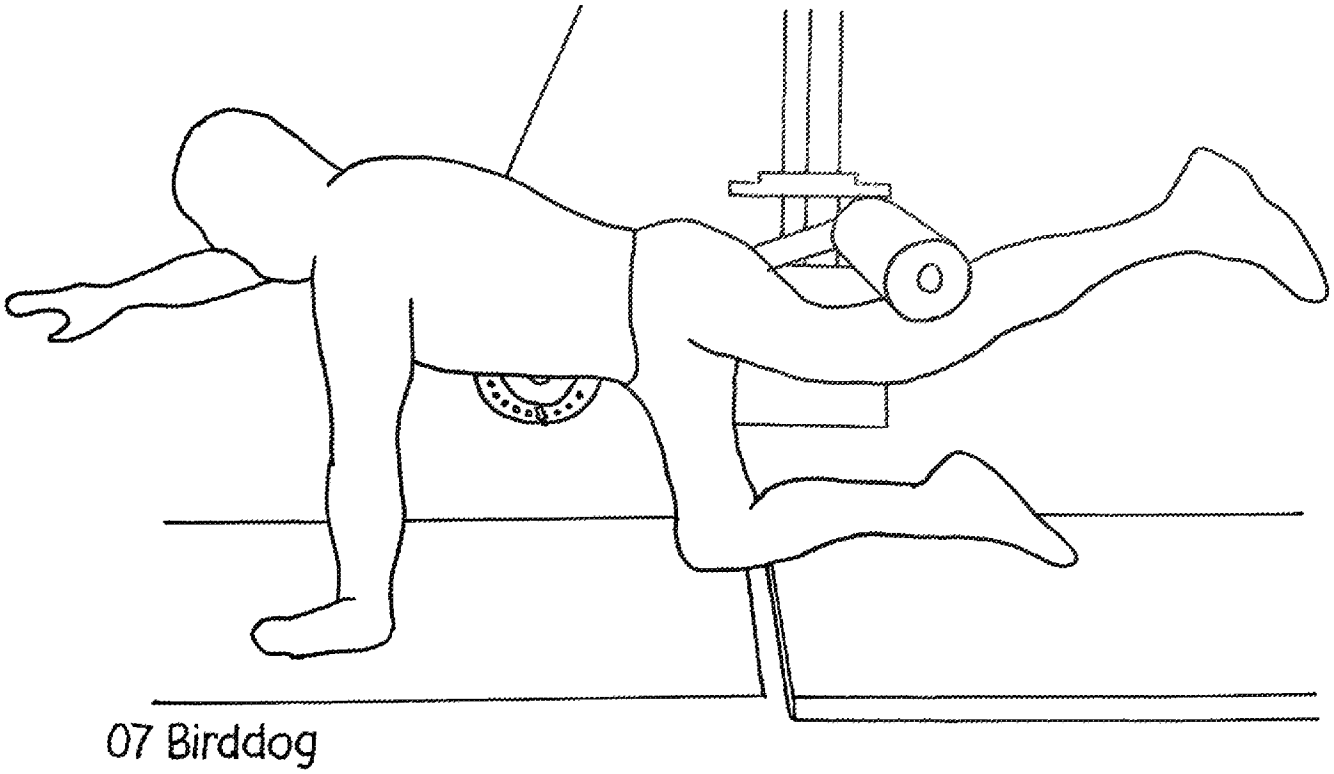
Figure 13C:
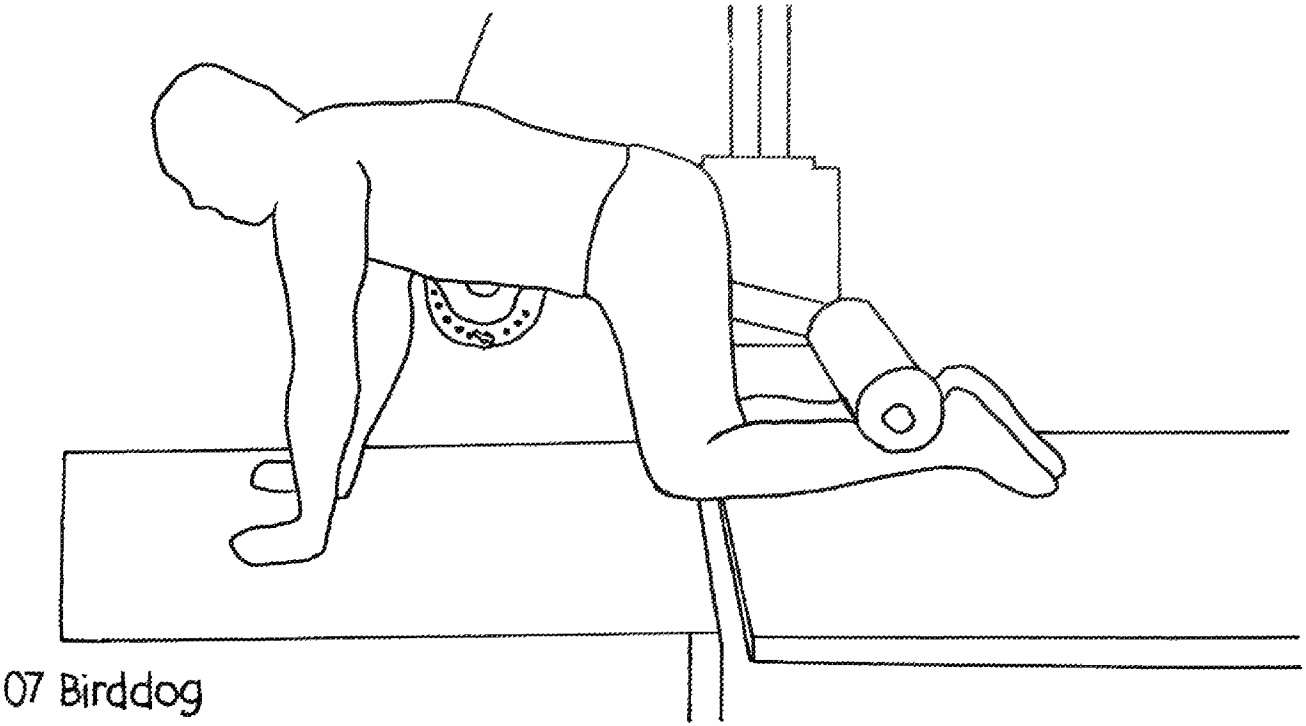

A "bird-dog" exercise is effective at targeting the lumbar multifidus muscles. To perform a bird-dog, the user starts in the four-point kneeling position with both knees and hips flexed to 90 degrees. The user then flexes one shoulder and simultaneously extends the contralateral knee and hip, translating the swing arm vertically. The user holds this position for several seconds, then returns to the starting four-point kneeling position and then repeats the motion with the contralateral upper and lower extremities. FIGS. 13A-13C are photographs of a user performing one repetition of a bird-dog on the exercise machine 100 of Example 1. The user is shown on the exercise machine 100 at the starting position (FIG. 13A), the bird-dog hold position (FIG. 13B), and the final position (FIG. 13C). The resistance bar is placed against the posterior legs/ankles. Different additions or attachments can be added to the exercise machine 100, including but not limited to a leg sling, rotating stability platform, a weight stack, or a resistance band to allow for additional modifications of the bird dog exercise.

Figure 14A:
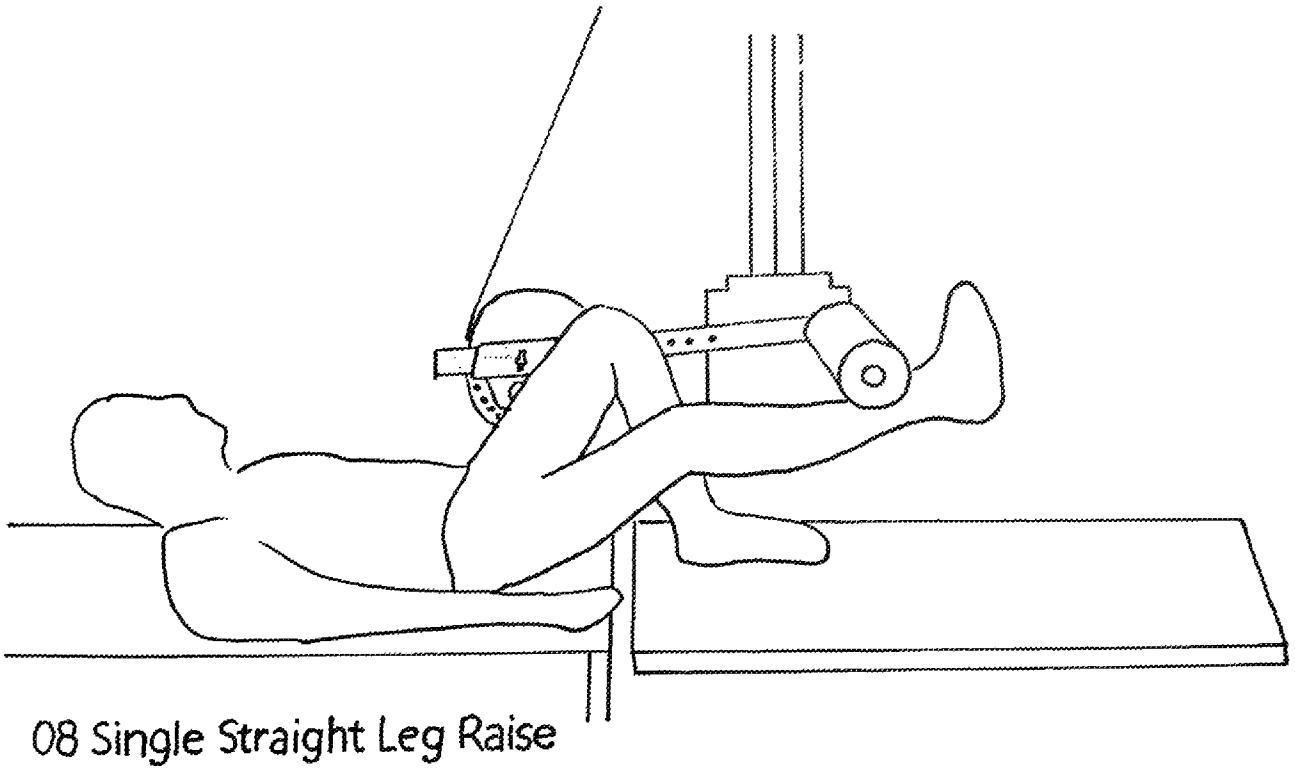
FIGS. 14A-14C are photographs of a user performing one repetition of a single straight leg raise (FIG. 14A—start position, FIG. 14B—leg raise hold position, FIG. 14C—end position) on the exercise machine.
Figure 14B:
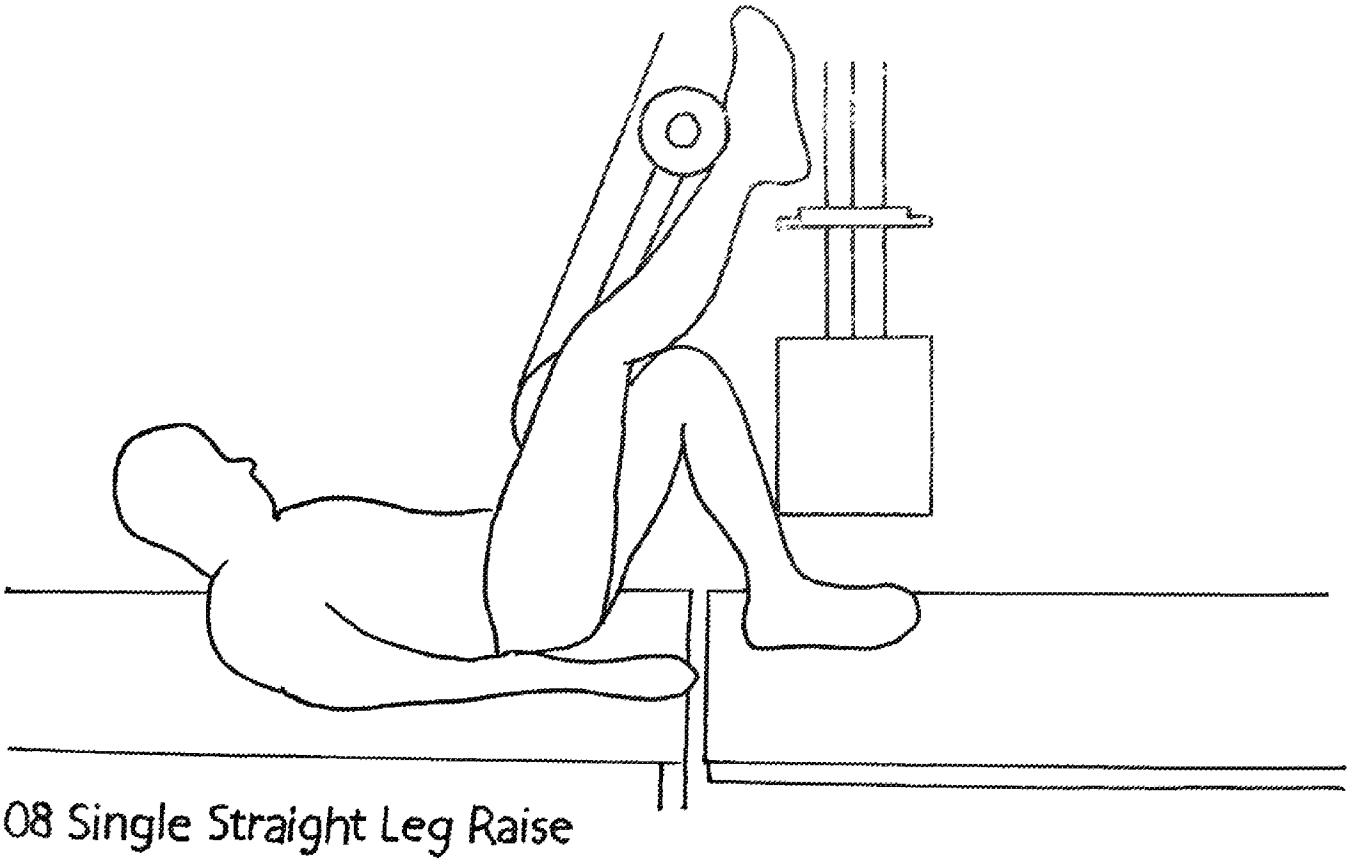
Figure 14C:
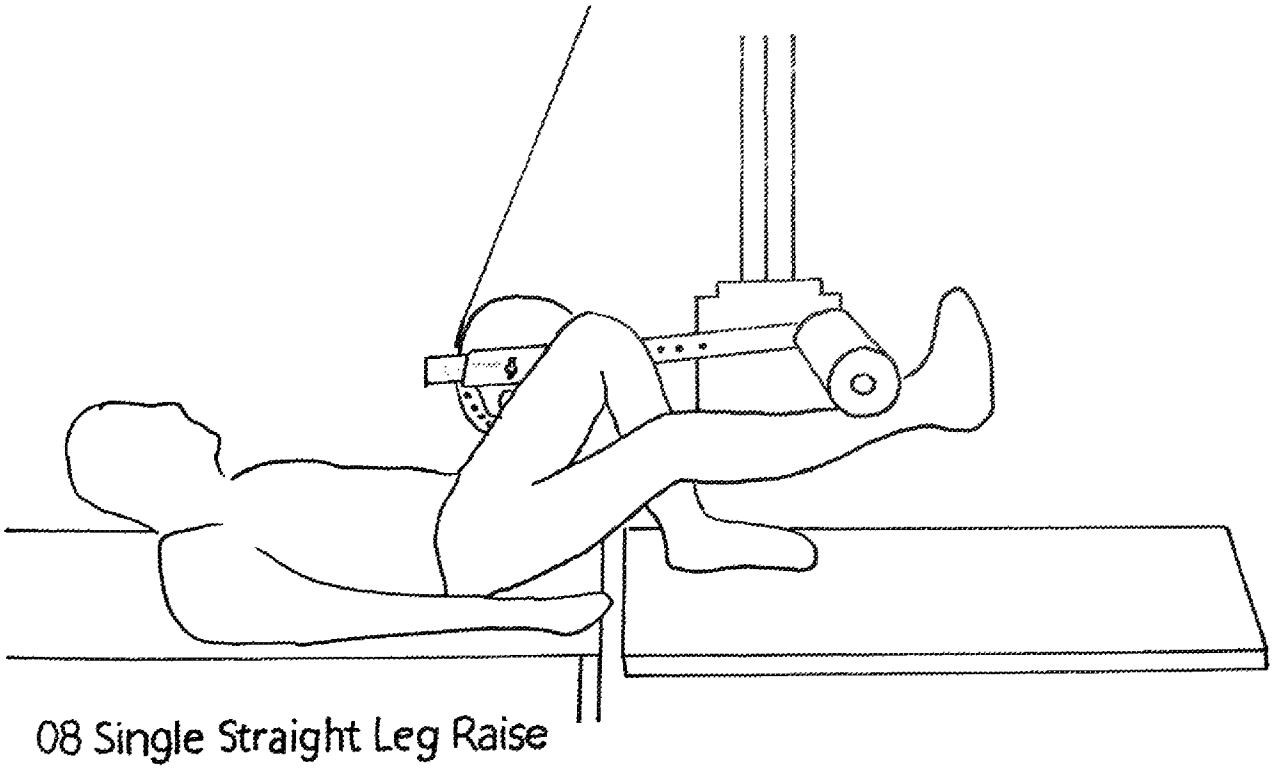
Figure 15A:
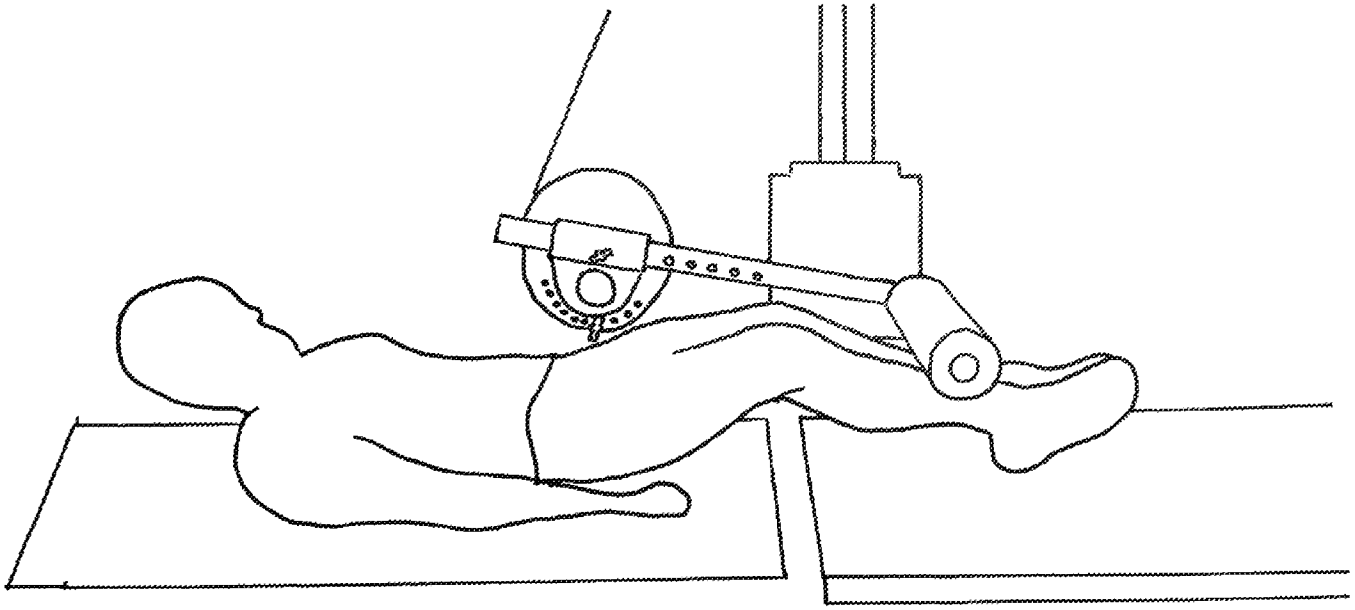
FIGS. 15A-15C are photographs of a user performing one repetition of a dual straight leg raise (FIG. 15A—start position, FIG. 15B—leg raise hold position, FIG. 15C—end position) on the exercise machine.
Figure 15B:
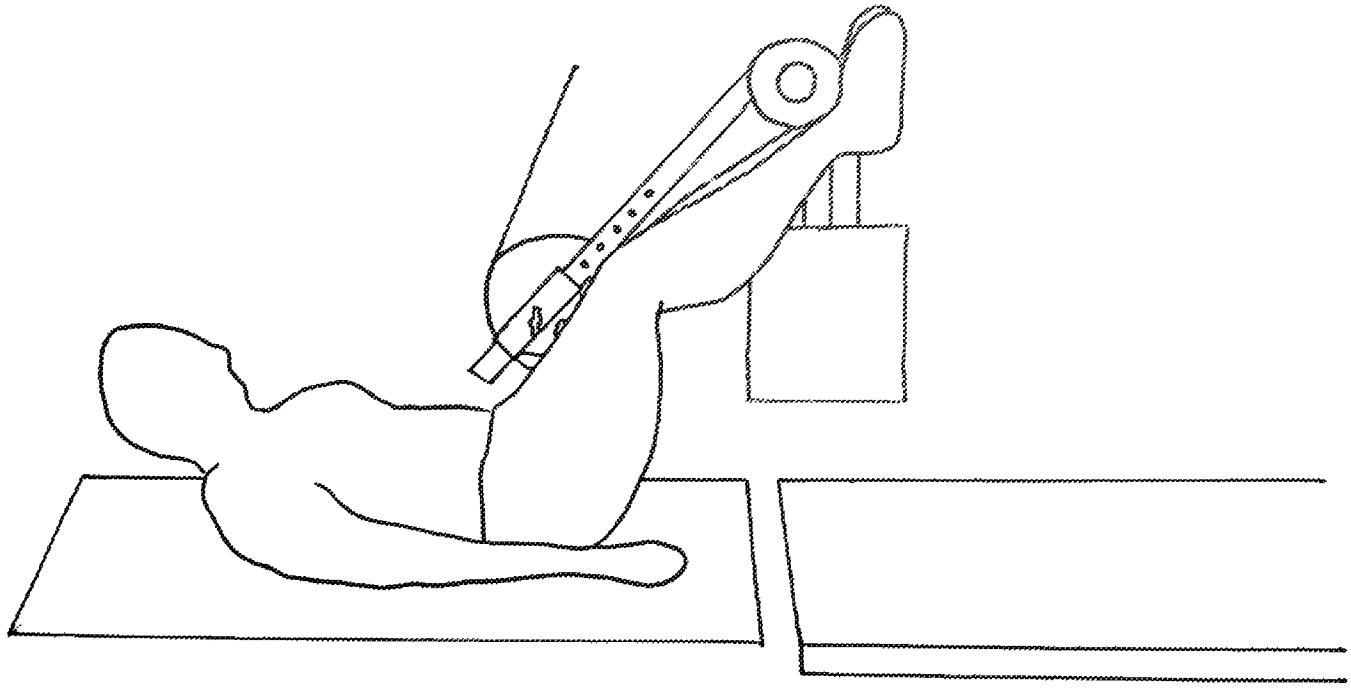
Figure 15C:
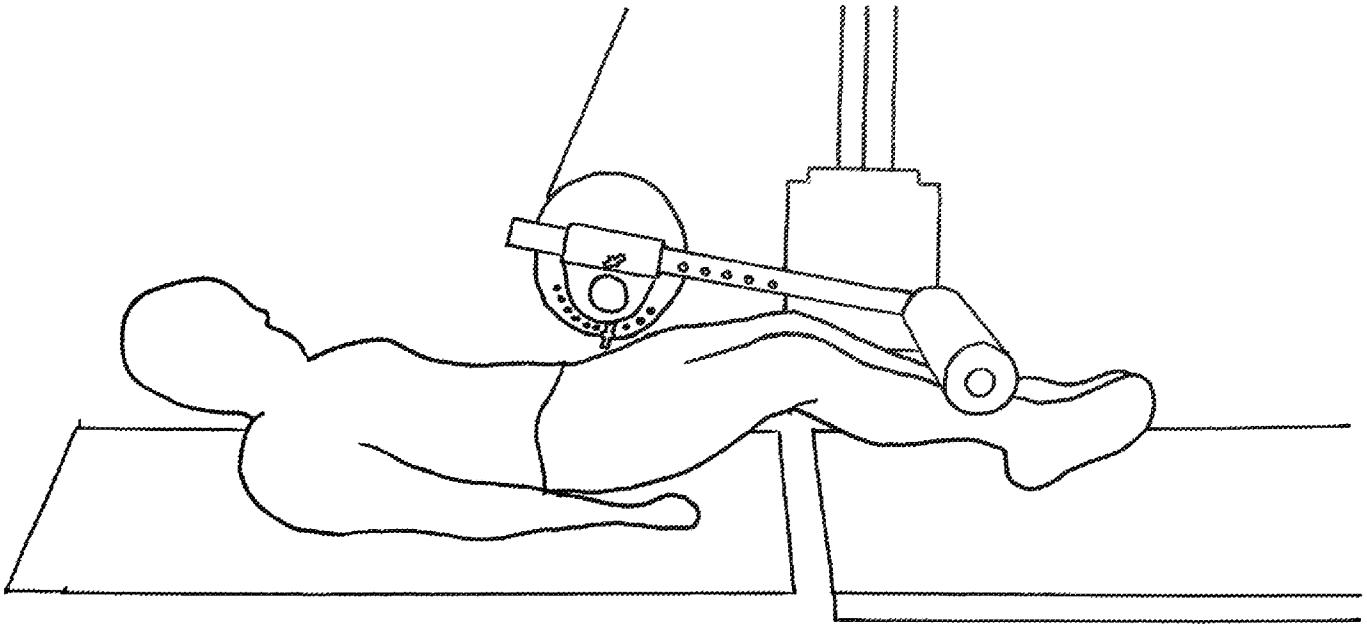
Figure 16A:
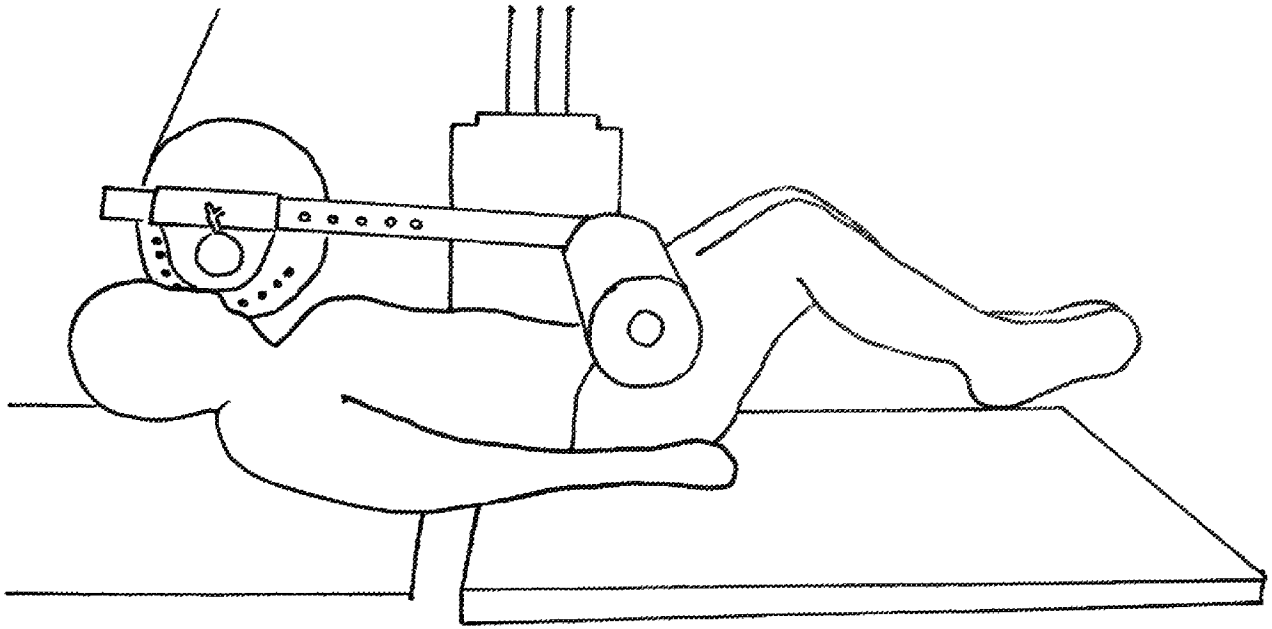
FIGS. 16A-16C are photographs of a user performing one repetition of a thigh bent leg raise (FIG. 16A—start position, FIG. 16B—leg raise hold position, FIG. 16C—end position) on the exercise machine.
Figure 16B:
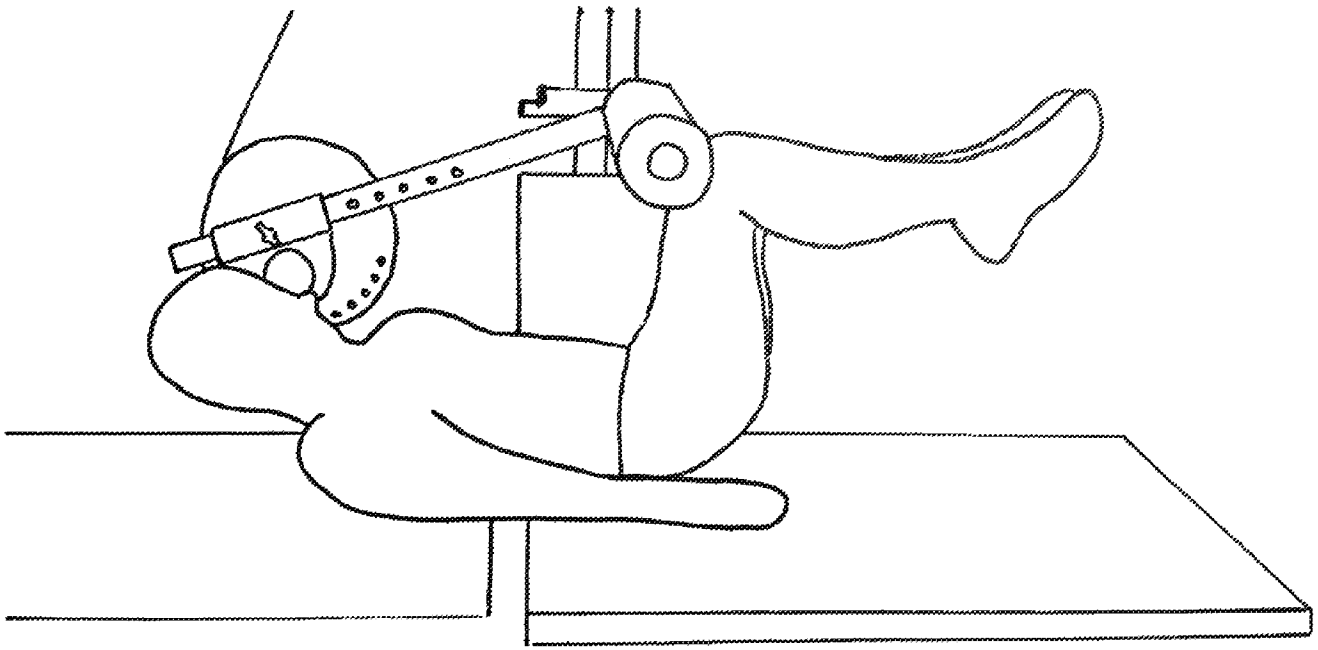
Figure 16C:
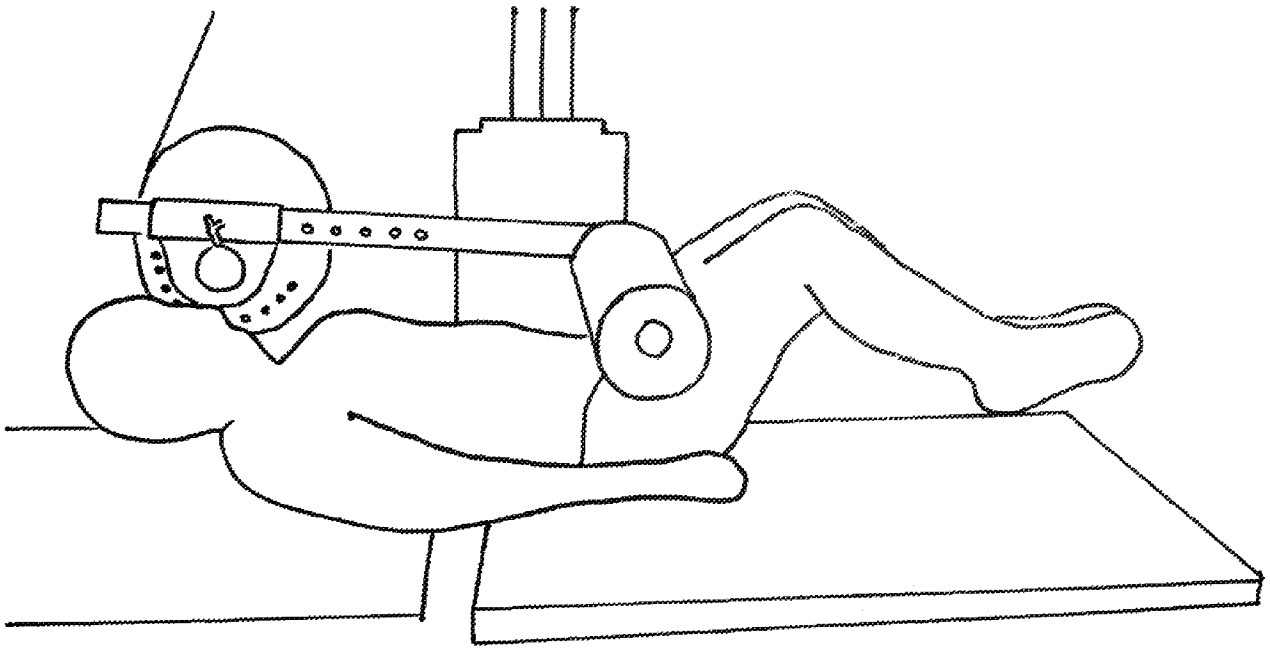
Figure 17A:
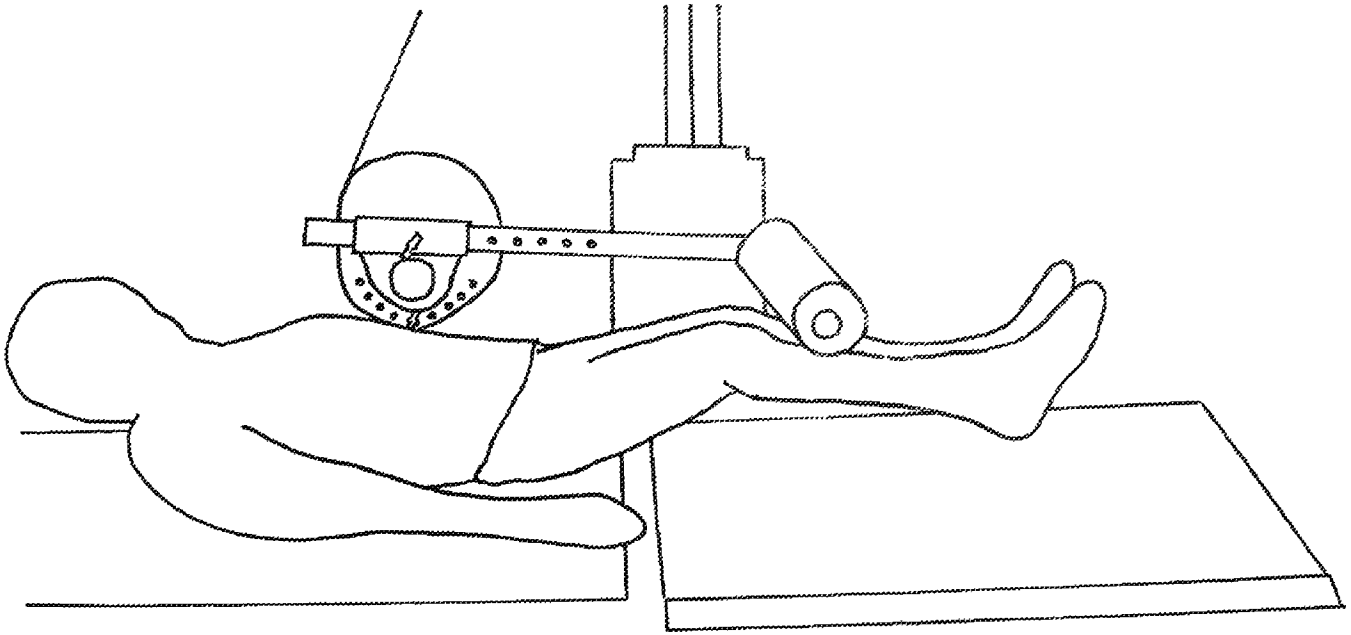
FIGS. 17A-17C are photographs of a user performing one repetition of a bent leg raise (FIG. 17A—start position, FIG. 17B—leg raise hold position, FIG. 17C—end position) on the exercise machine.
Figure 17B:
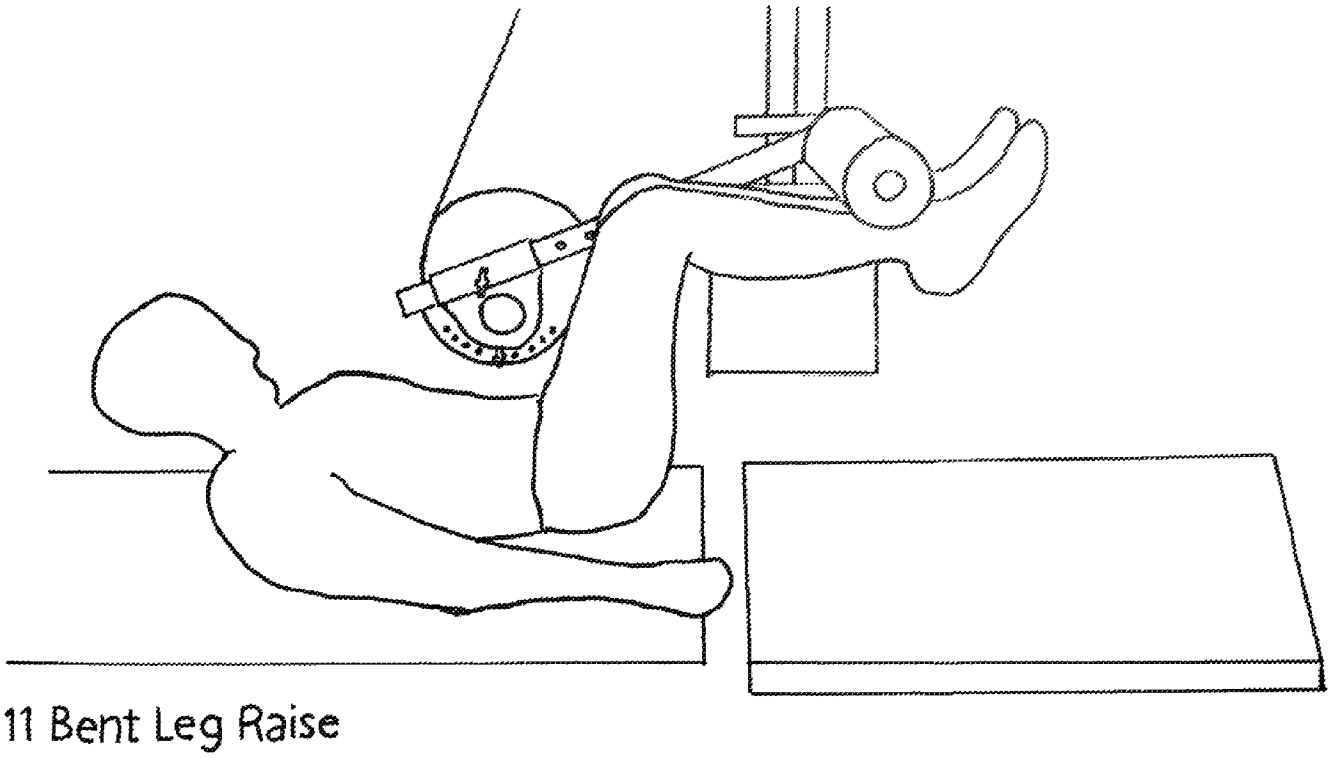
Figure 17C:
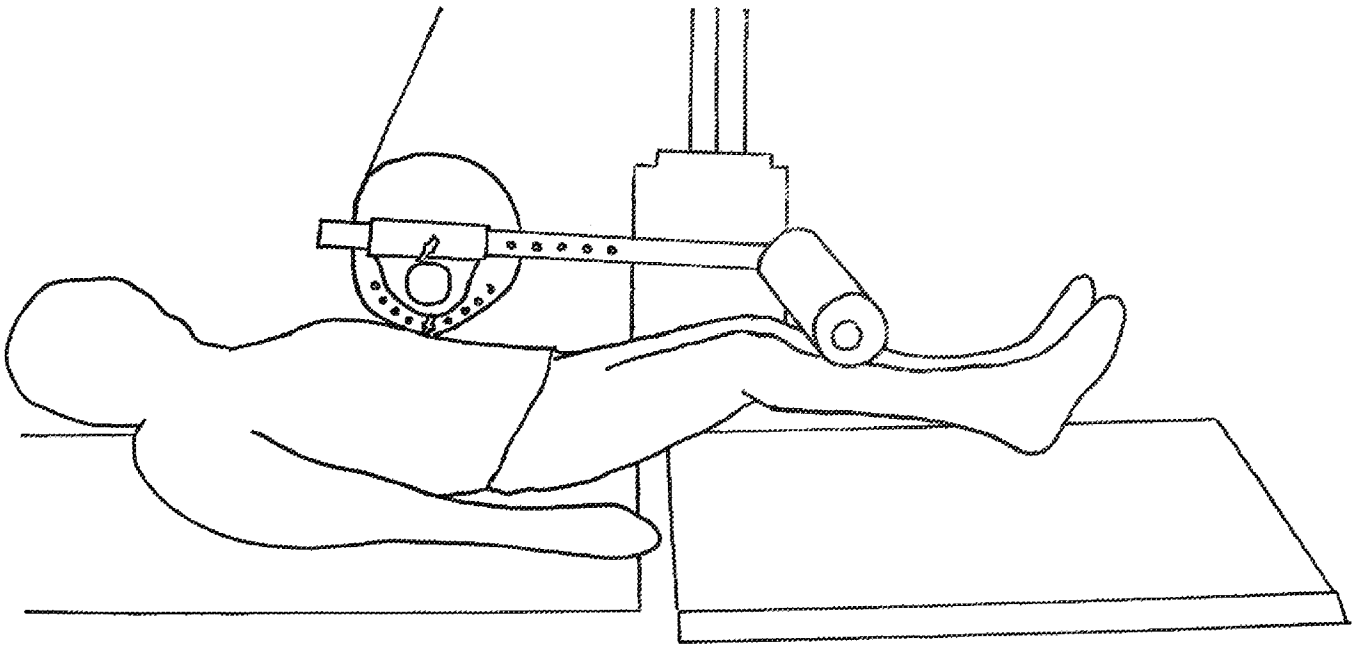
Figure 18A:
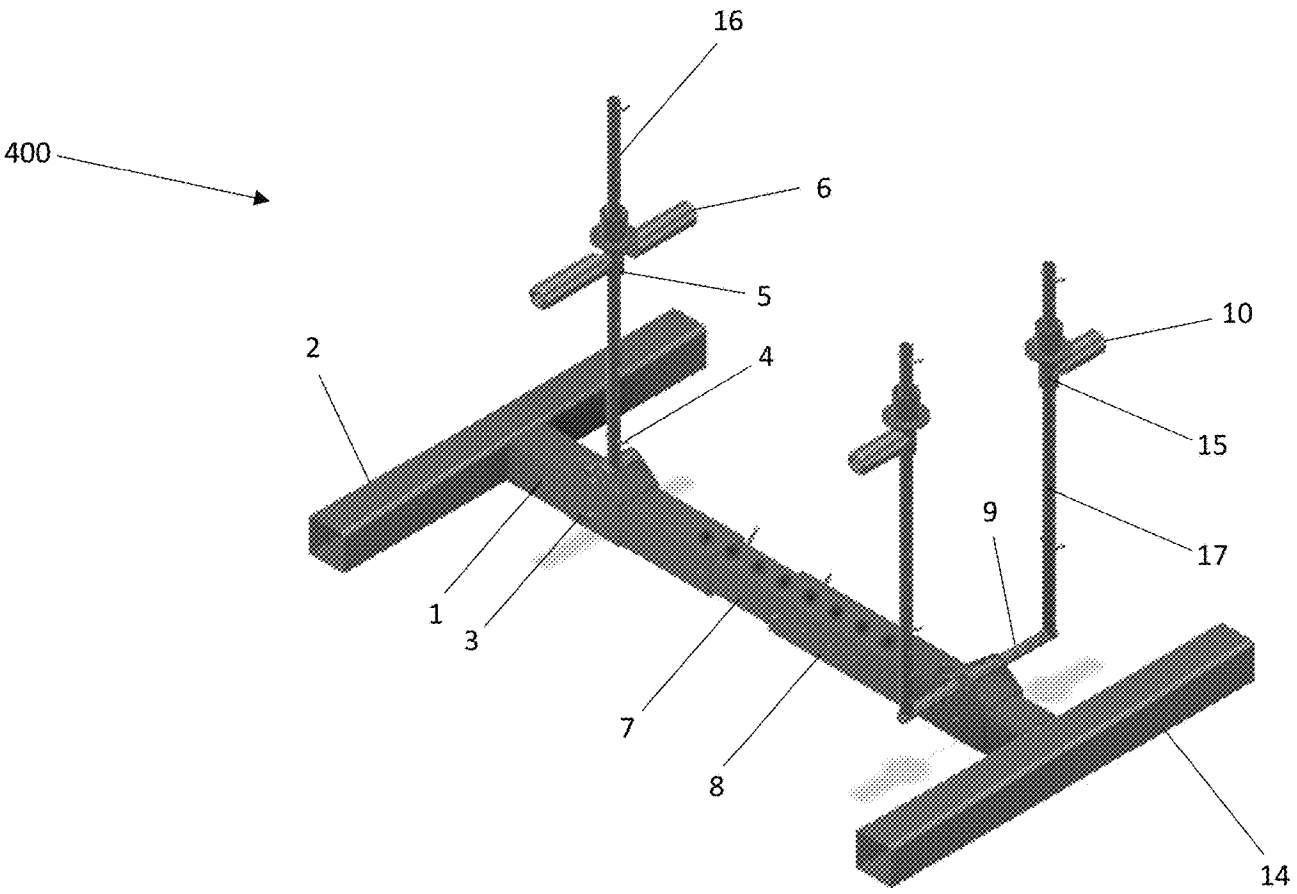
FIG. 18A is an oblique side view of an exercise machine. The exercise machine is configured with the front and back bases connected via the interconnecting center base and the guide rails positioned vertically.
Figure 18B:
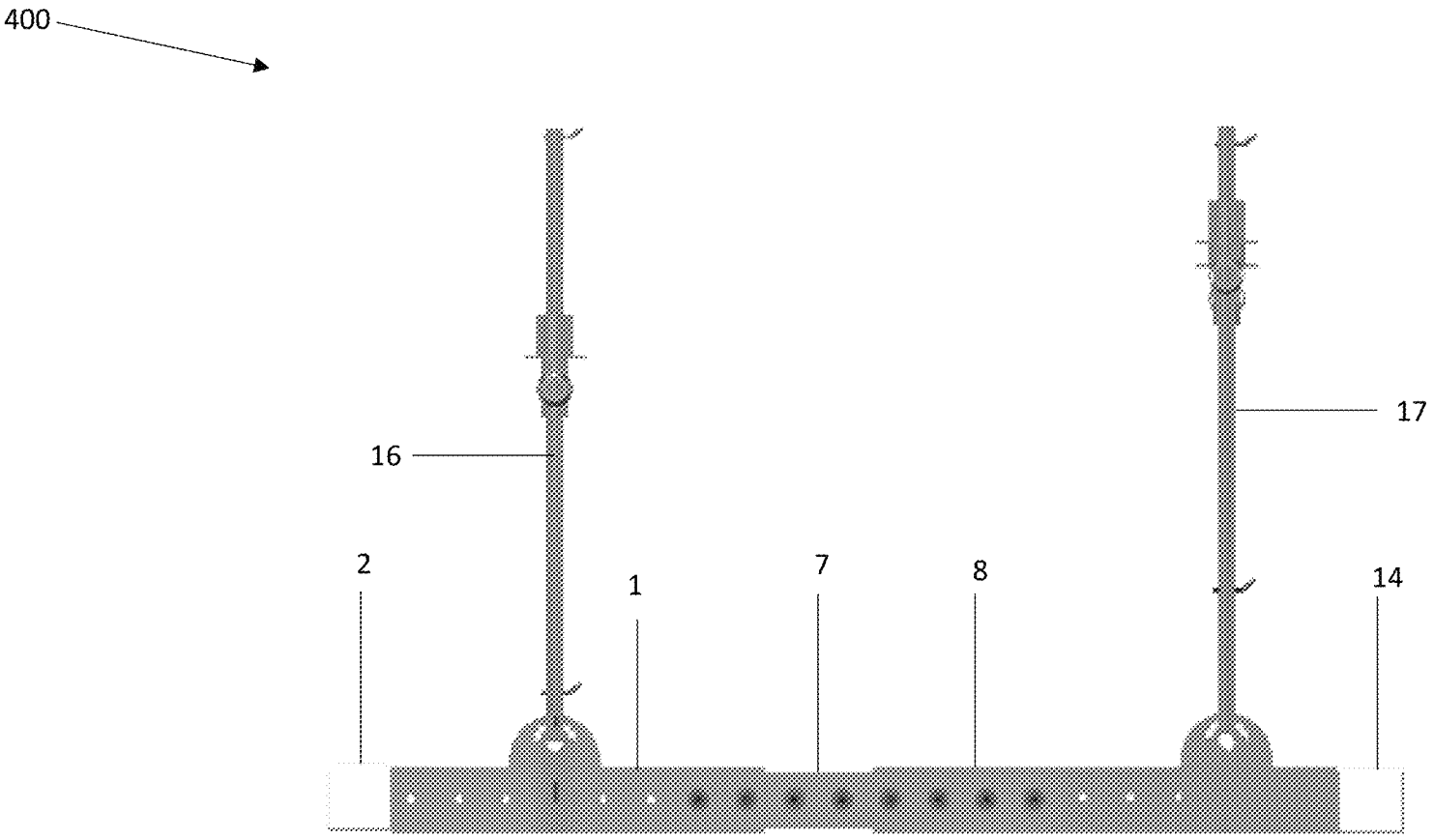
FIG. 18B is a side view of the exercise machine. The exercise machine is configured with the front and back bases connected via the interconnecting center base and the guide rails positioned vertically.
Figure 18C:
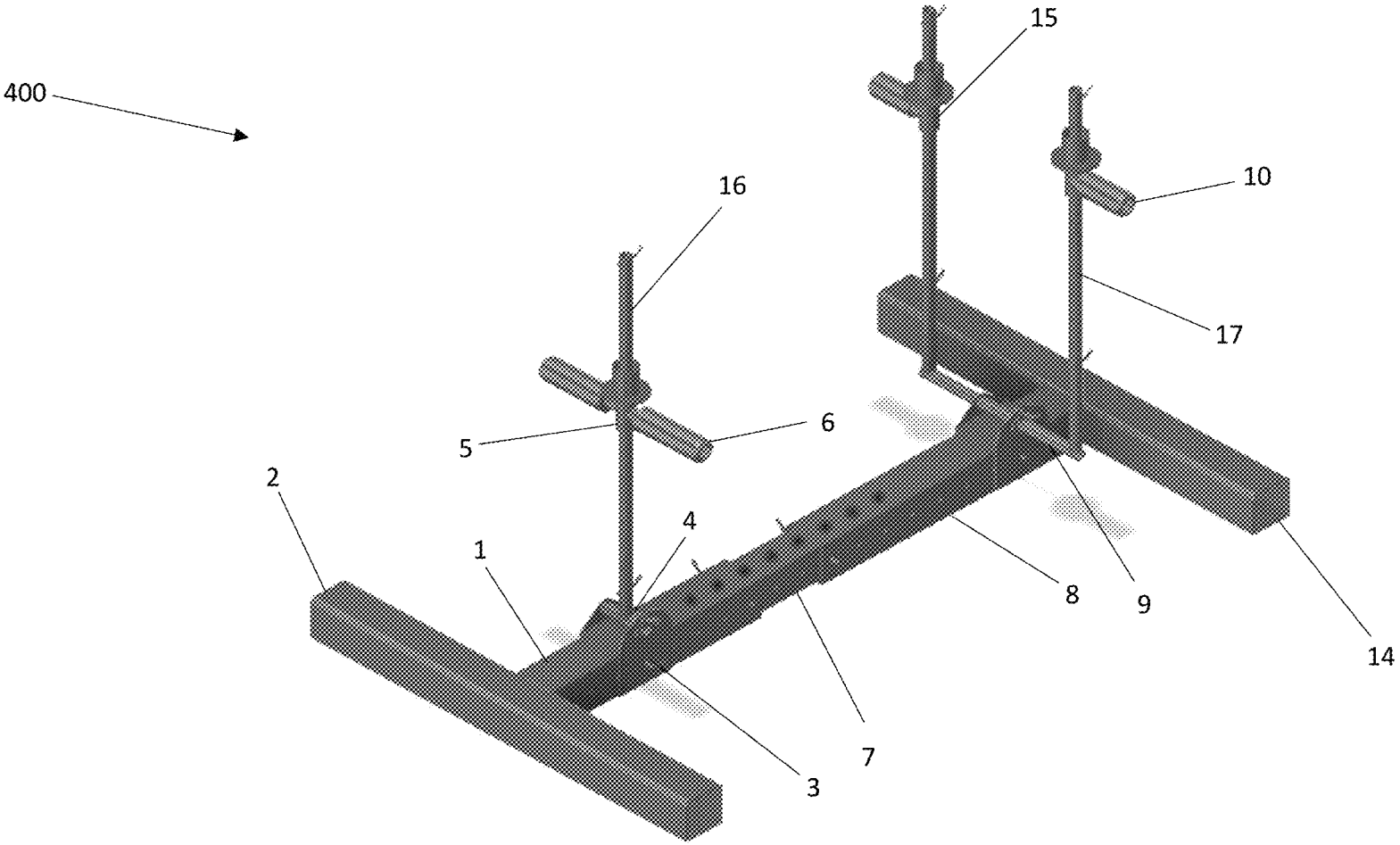
FIG. 18C is an oblique side view of the exercise machine. The exercise machine is configured with the front and back bases connected via the interconnecting center base and the guide rails positioned vertically.
Figure 18D:
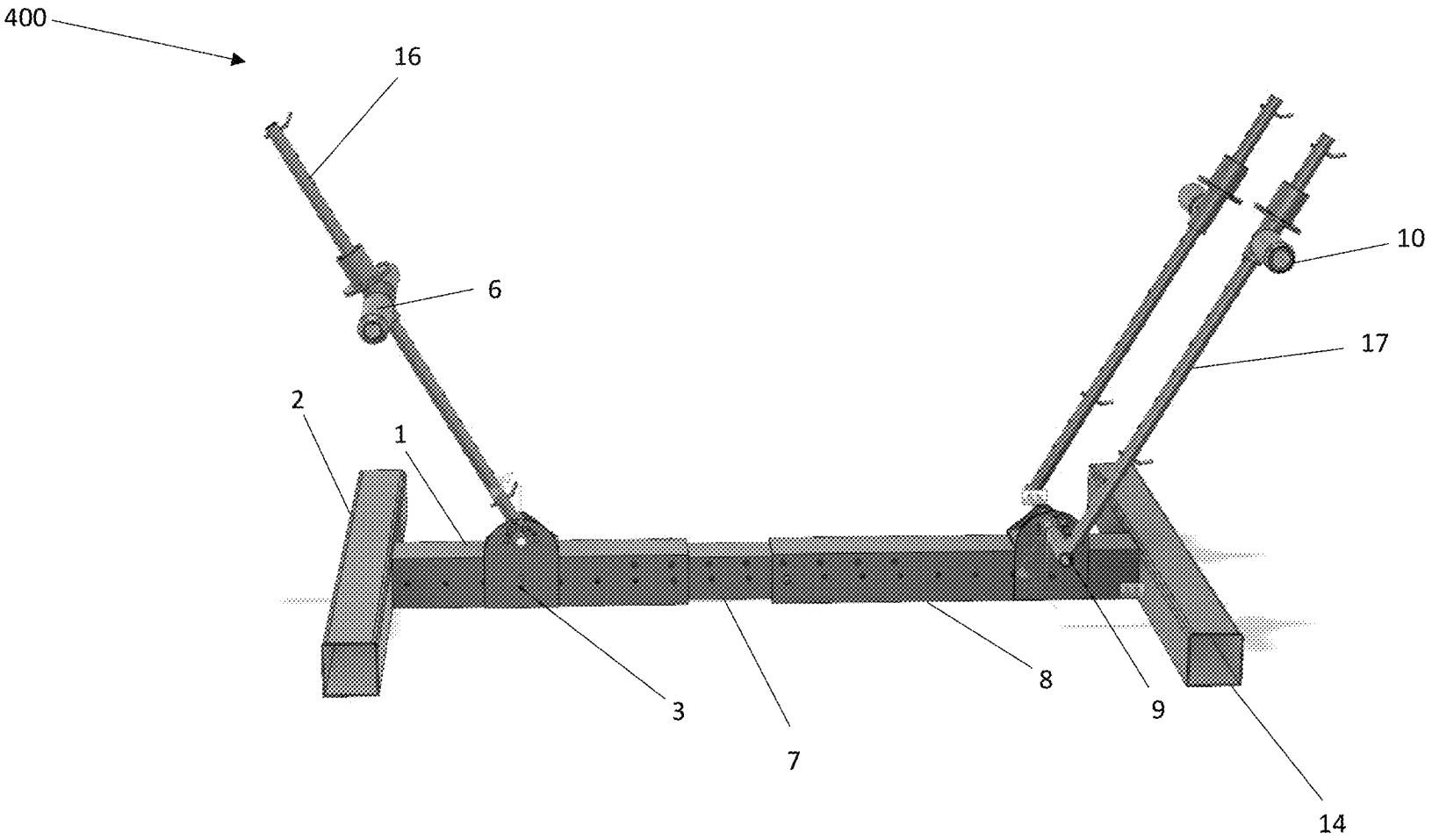
FIGS. 18D-18G are side and oblique views, respectfully, of the exercise machine with the guide rails of the apparatus positioned in various degrees of angulation.
Figure 18E:
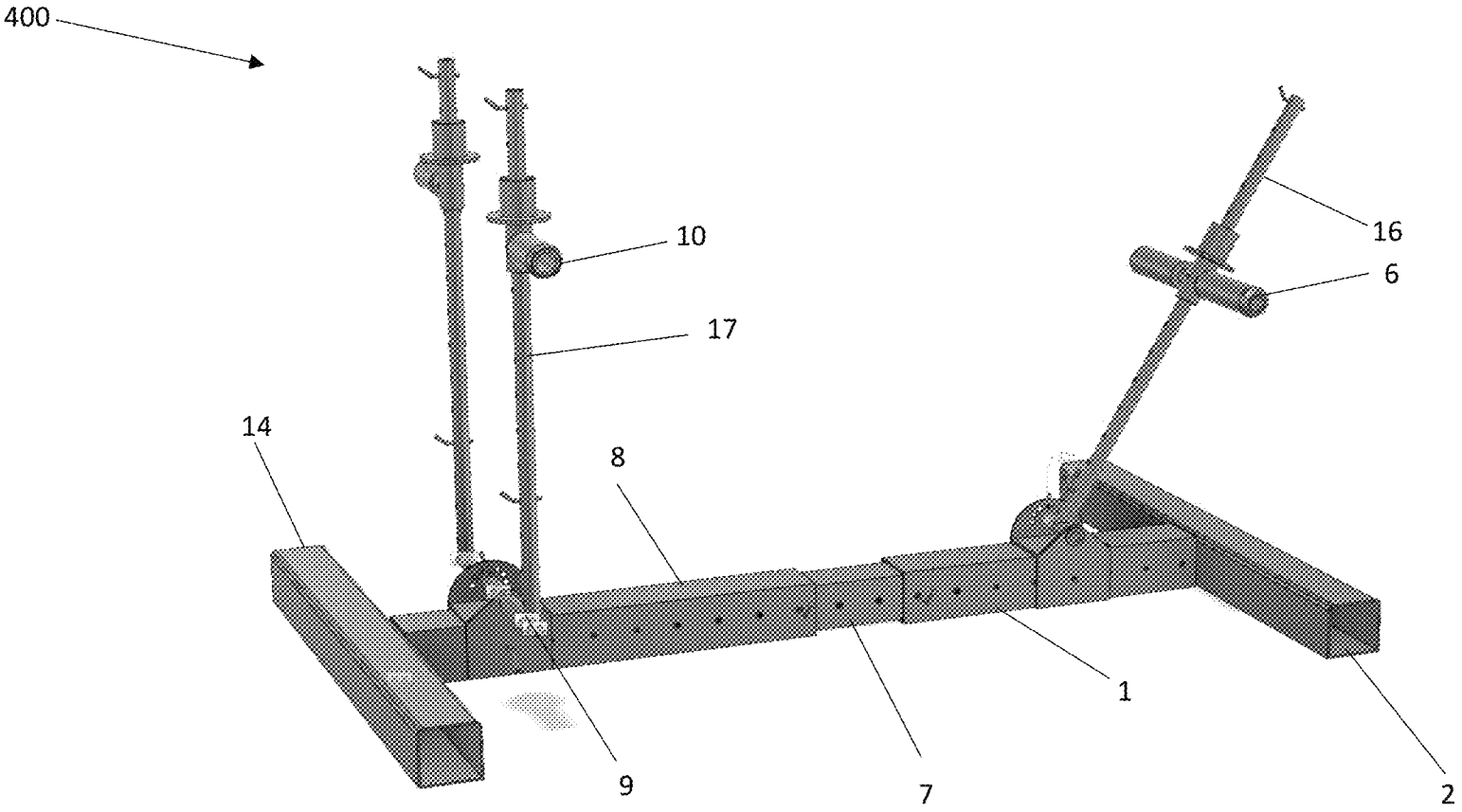
Figure 18F:
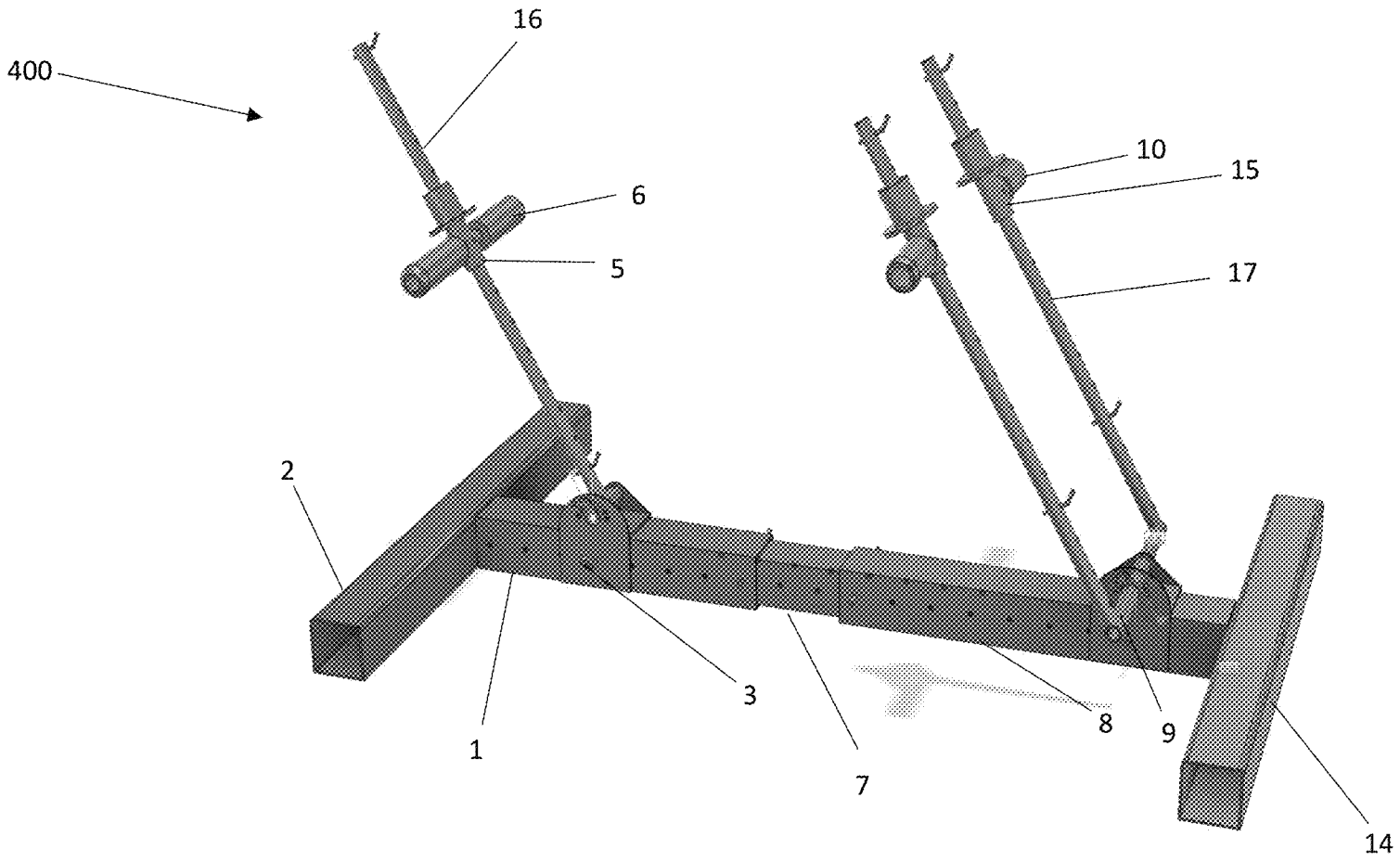
Figure 18G:
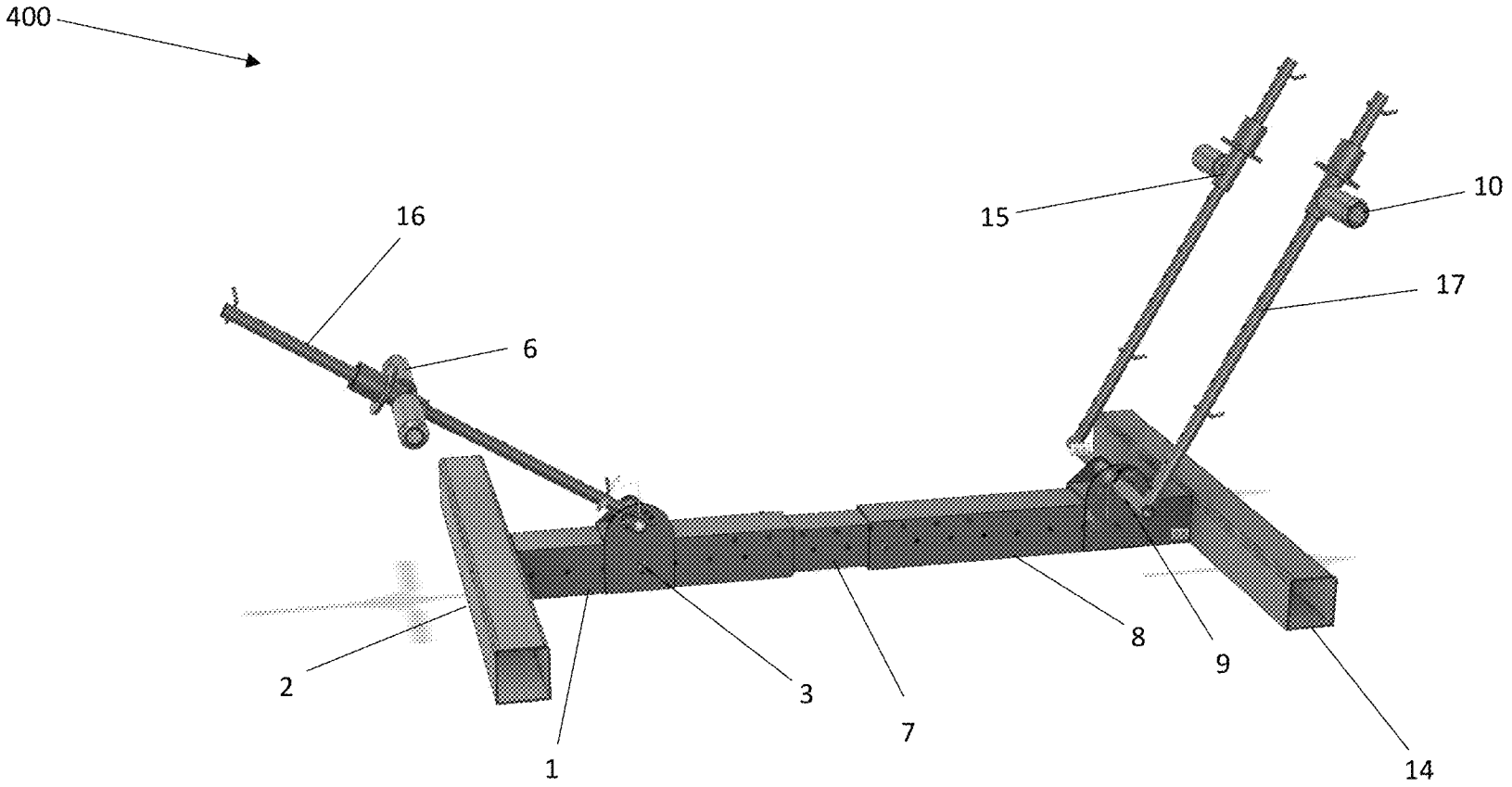
Figure 18H:
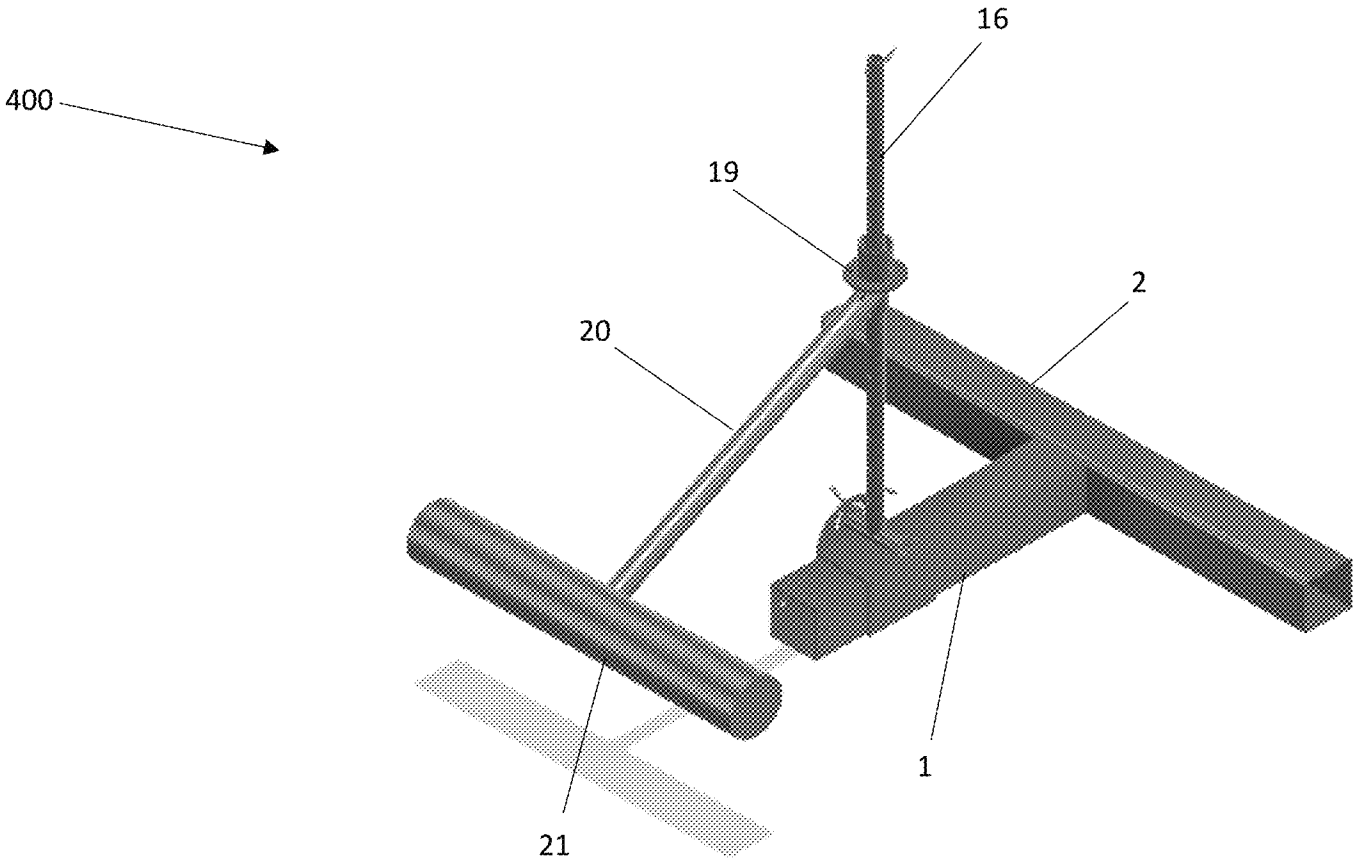
FIG. 18H is an oblique side view of the exercise machine with the bridge/plank accessory. The embodiment is configured with the back base only with the guide rail positioned vertically and the bridge/plank accessory connected to the guide rail.
Figure 18I:
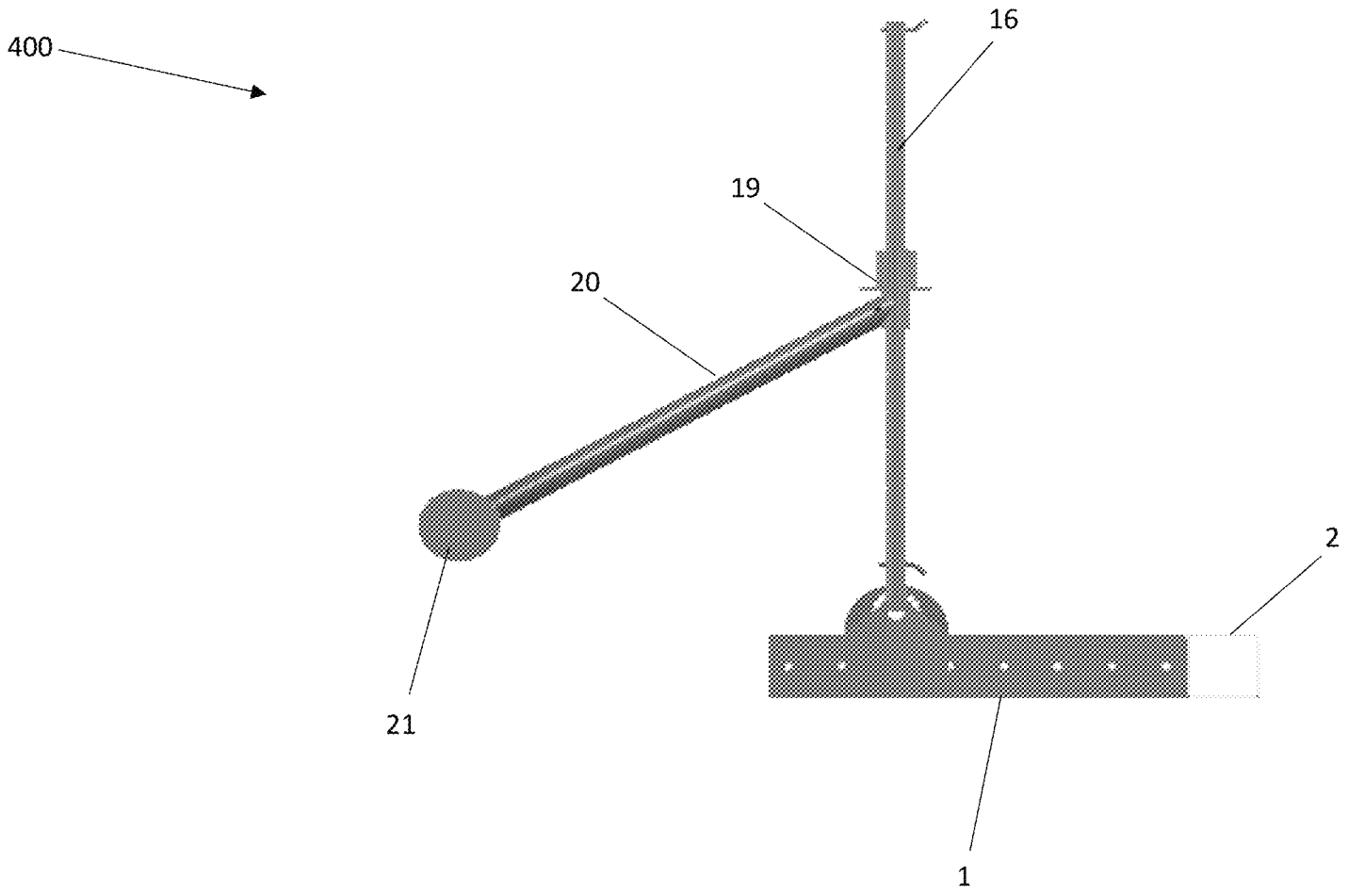
FIG. 18I is a side view of the exercise machine with the bridge/plank accessory. The embodiment is configured with the back base only with the guide rail positioned vertically and the bridge/plank accessory connected to the guide rail.
Figure 18J:
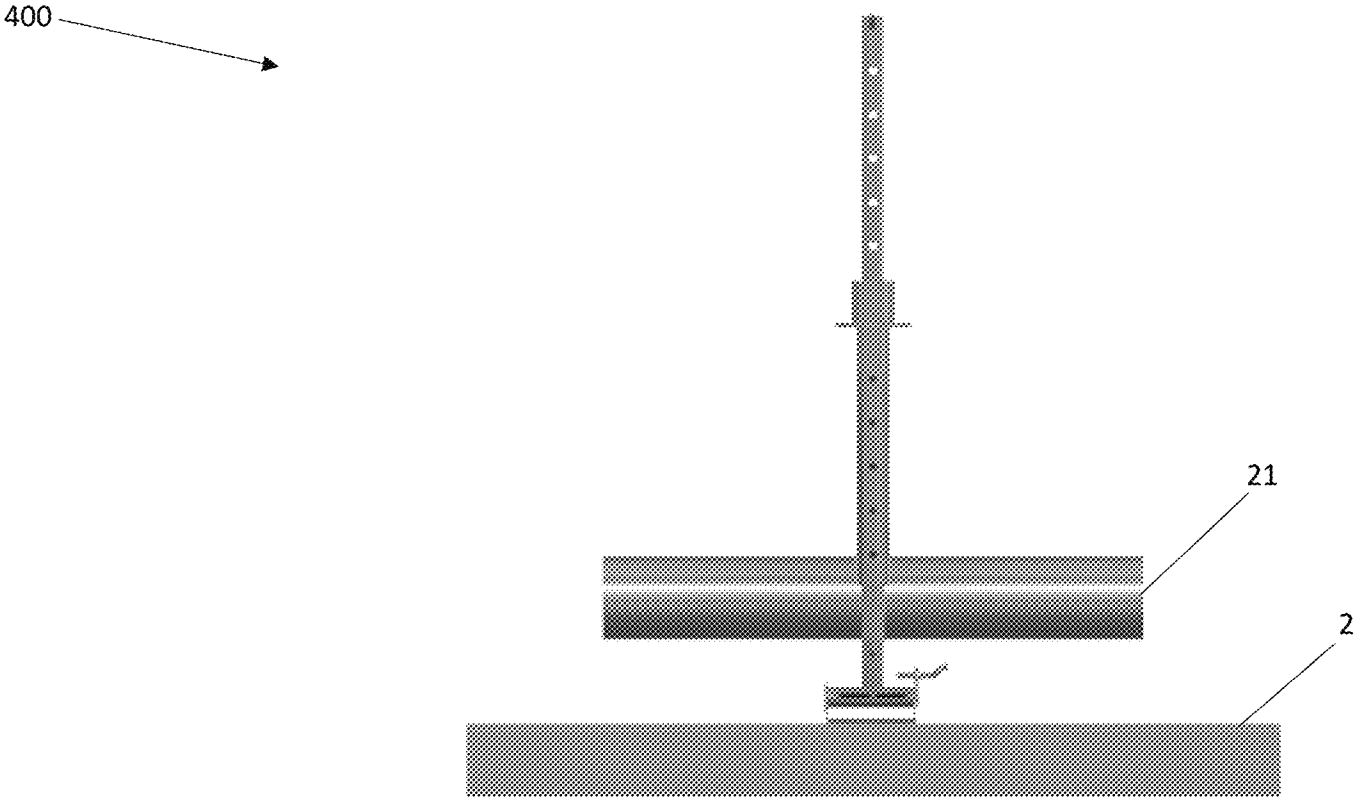
FIG. 18J is a front-to-back view of the exercise machine with the bridge/plank accessory. The exercise machine is configured with the back base only with the guide rail positioned vertically and the bridge/plank accessory connected to the guide rail.
Figure 18K:
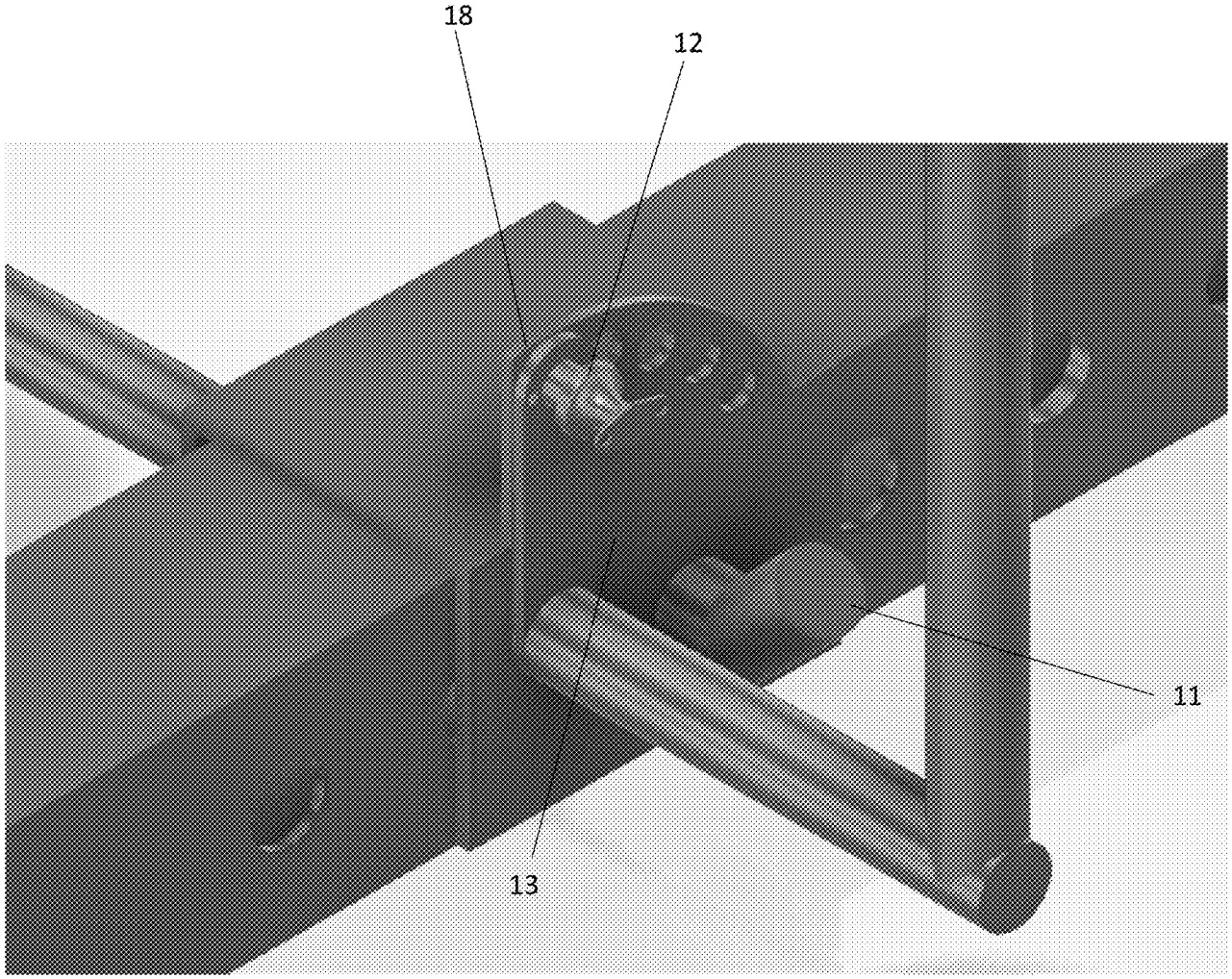
FIG. 18K is an oblique side view of the slide bracket and pivot lock mechanism of the exercise machine.
Figure 18M:
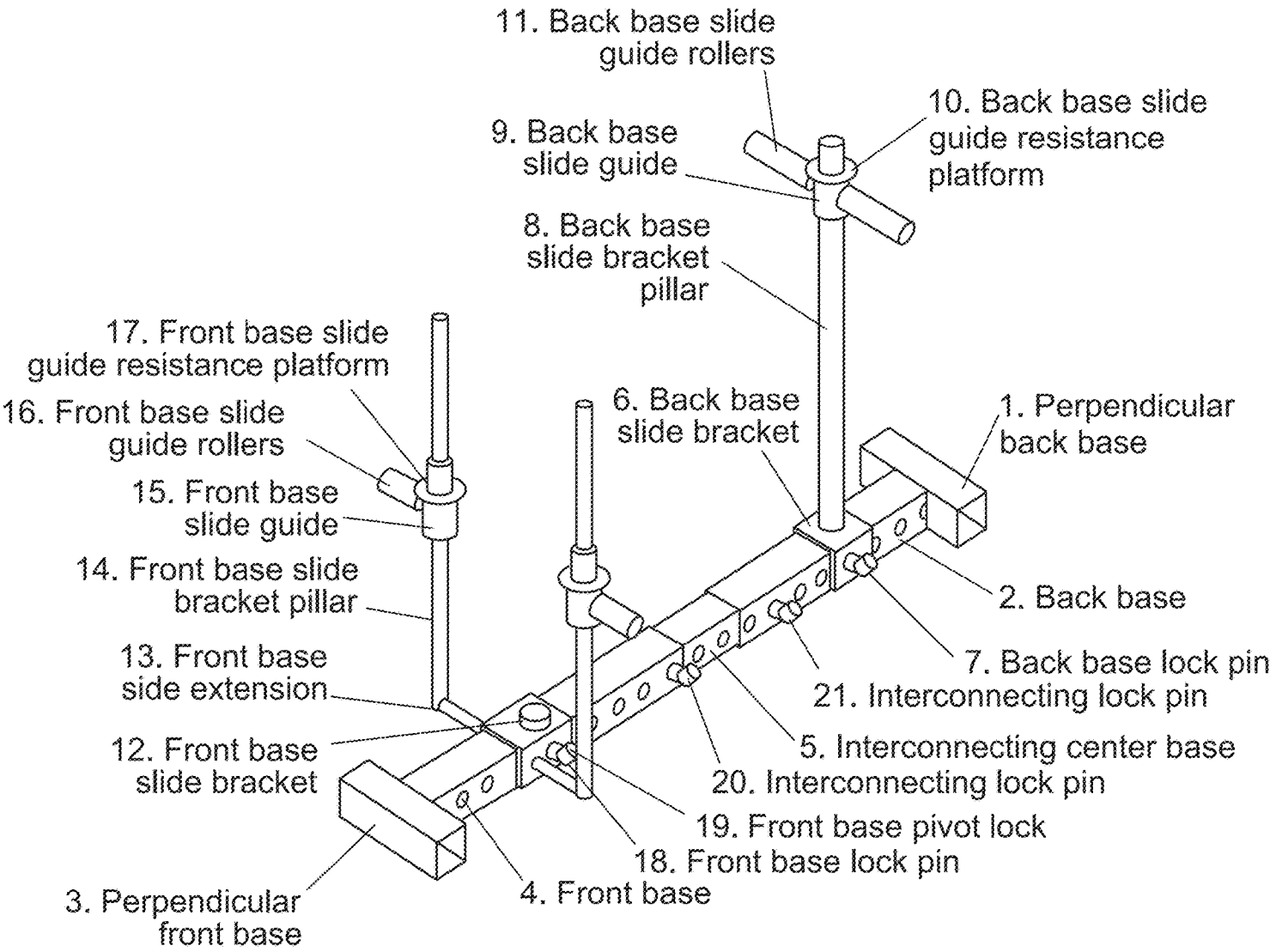
FIG. 18M is an image of the exercise machine identifying the components.

Several leg raise exercises engage the core musculature, build hip flexor strength, and help define the anterior abdominal muscles. These are often performed in fitness facilities as a "hanging" exercise where one holds onto a pull-up bar or braces the forearms on pads, suspending the body while performing the exercise. The exercise is often limited by one's ability to hold oneself in such challenging positions. The exercise machine 100 of Example 1 allows the user to perform these exercises on one's back. The user is shown on the exercise machine 100 performing a single straight leg raise at the starting position (FIG. 14A), the leg raise hold position (FIG. 14B), and the final position (FIG. 14C). A dual leg raise is shown in FIGS. 15A-15C. The exercise machine also allows for a modified thigh bent leg raise as shown in FIGS. 16A-16C and FIGS. 17A-17C. The resistance bar 106 is placed either over the thigh or leg and then the hip is flexed, translating the resistance bar vertically when performing the leg raise. The leg raise can be performed either single or dual-leg, with or without additional knee flexion during the exercise. Different additions or attachments can be added to the exercise machine 100, including but not limited to a leg sling, a rotating stability platform, a weight stack, or a resistance band to allow for additional modifications of the leg raise exercise.

Figure 29A:
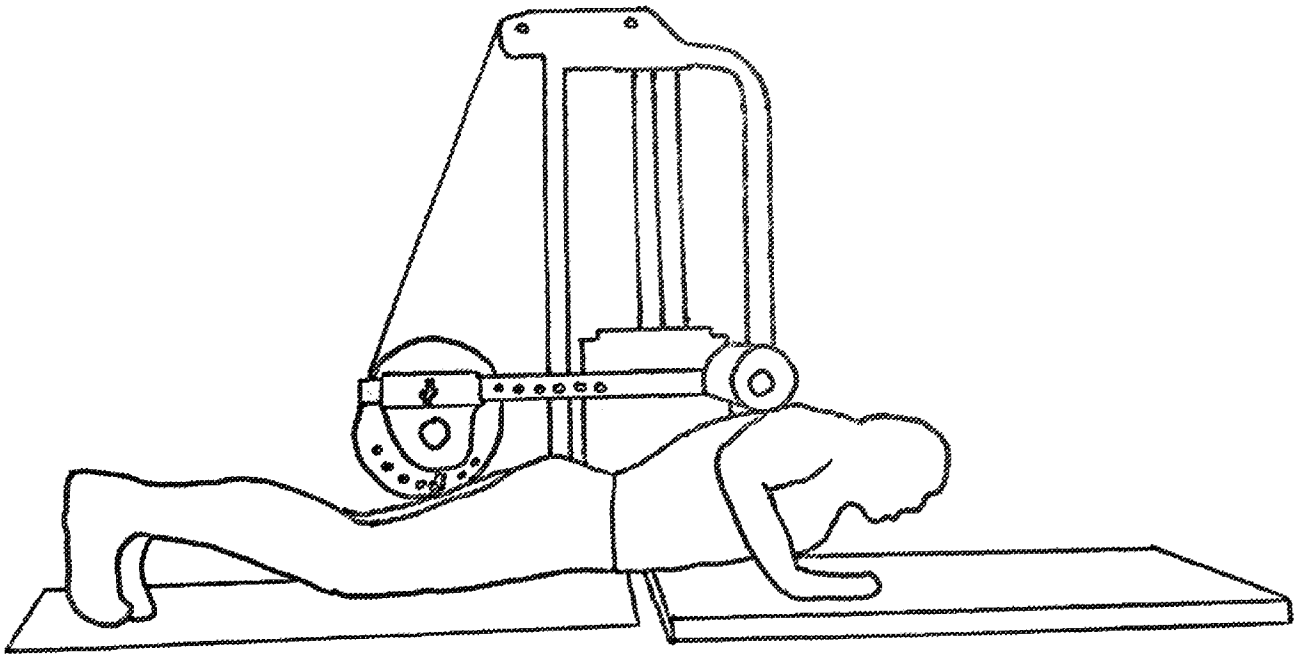
FIGS. 29A-29C are photographs of a user performing one repetition of a resisted push-up (FIG. 29A—start position, FIG. 29B—push-up hold position, FIG. 29C—end position) on the exercise machine.
Figure 29B:
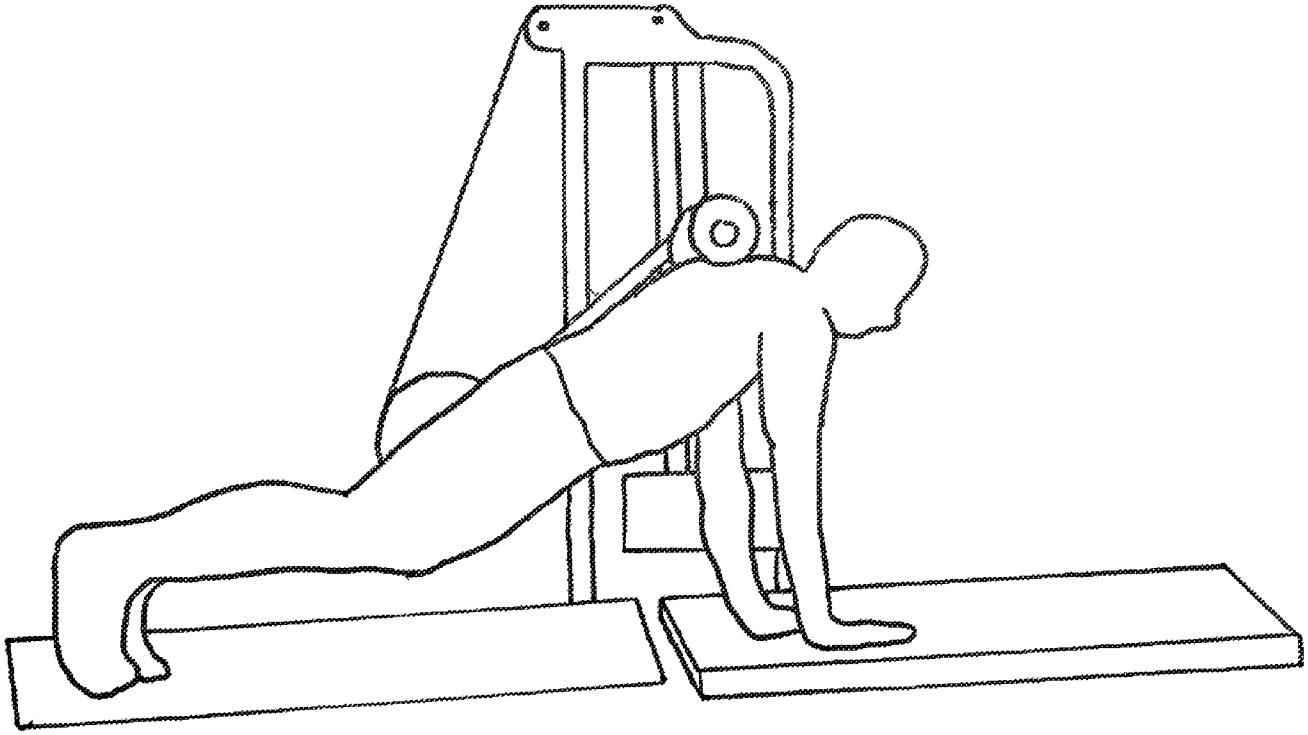
Figure 29C:
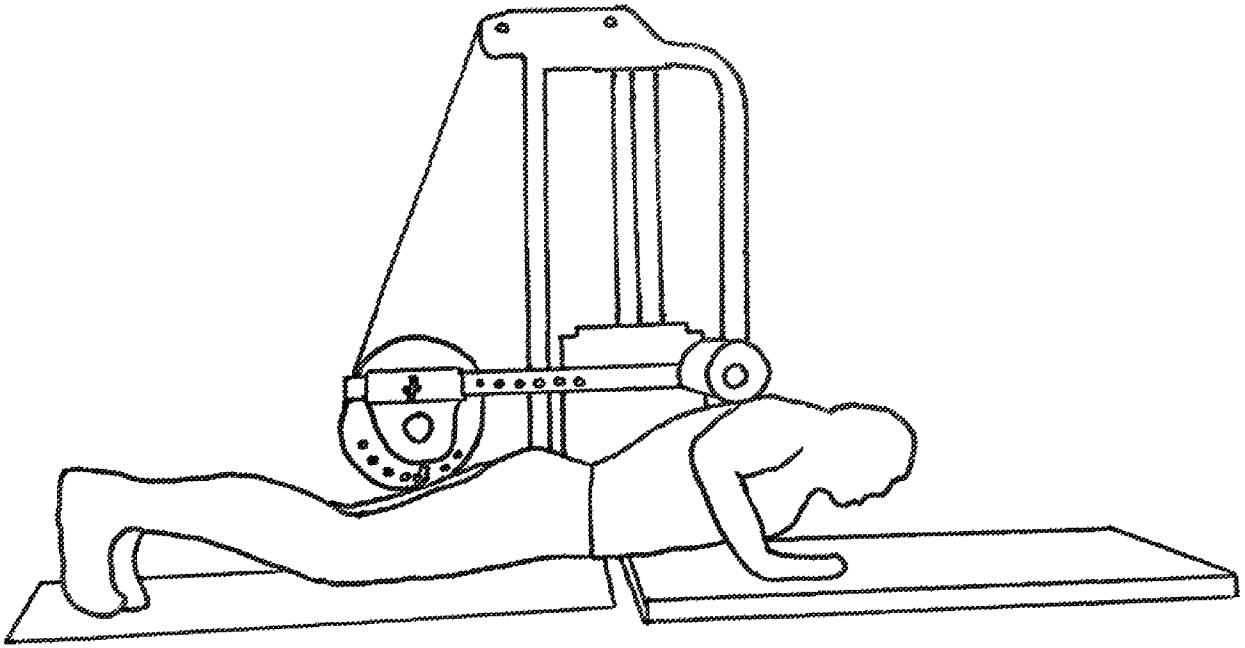

The exercise machine 100 of Example 1 can also be used to perform a push up with resistance (i.e., a resisted push-up). FIG. 29A-29C show a user performing one repetition of a resisted push-up. Although a resisted push-up is not primarily targeting the lumbar muscles or lumbopelvic core complex, the exercise machine 100 of Example 1 is also suitable for training the chest/pectoralis muscles through a novel approach. In this exercise, the user chooses a weight from the weight stack. The start position has the user in the traditional push-up position however with the resistance bar 106 adjusted such that it is located near the user's shoulder blades (FIG. 29A). Next, the user performs a concentric contraction, extending one's elbows, and elevating the torso against the resistance bar 106 (FIG. 29B). To complete the repetition, an eccentric contraction with gradual elbow flexion will return the user to the end position (FIG. 29C). Different additions or attachments can be added to the exercise machine 100, including but not limited to a leg sling, a rotating stability platform, a weight stack, an inflatable hemisphere such as a BOSU® ball, or a resistance band to allow for additional modifications of the resisted push-up exercise.

Example 2

Components of the Exercise Machine

A modified exercise machine 400 is shown in FIGS. 18A-18M and 19-22. The size of the exercise machine can be adjusted in length and/or width as necessary to accommodate user sizes and/or space constraints. The foundation of the exercise machine 400 consists of a front base 8, back base 1, and an interconnecting center base 7. The ends of the front and back bases have perpendicular "T-shaped" extensions 14—front perpendicular base, 2—back perpendicular base) to provide stability. The front base 8 and back base 1 can be coupled via a telescoping interconnecting center base 7 using cross pins/detent pins transfixed through machined holes in the base components. This allows for the base to be adjusted between about 5 inch and 15 inch increments or holes. Preferably each increment or hole is between about 1 inch to 2 inches. In one embodiment there are 10 holes and each hole is spaced about 1.5 inches from the next nearest hole. In another embodiment the holes are about 1 inch or about 2 inches from the next nearest hole. The front base 8 and back base 1 can be between 12 inches and 24 inches, preferably between 14 inches and 20 inches, and more preferably between 16 inches and 18 inches. The interconnecting center base 7 also provides further stability and ensures collinearity of the front base 8 and the back base 1. The interconnecting center base 7 can also be removed to allow the front base 8 and back base 1 to be used individually.

Figure 21:
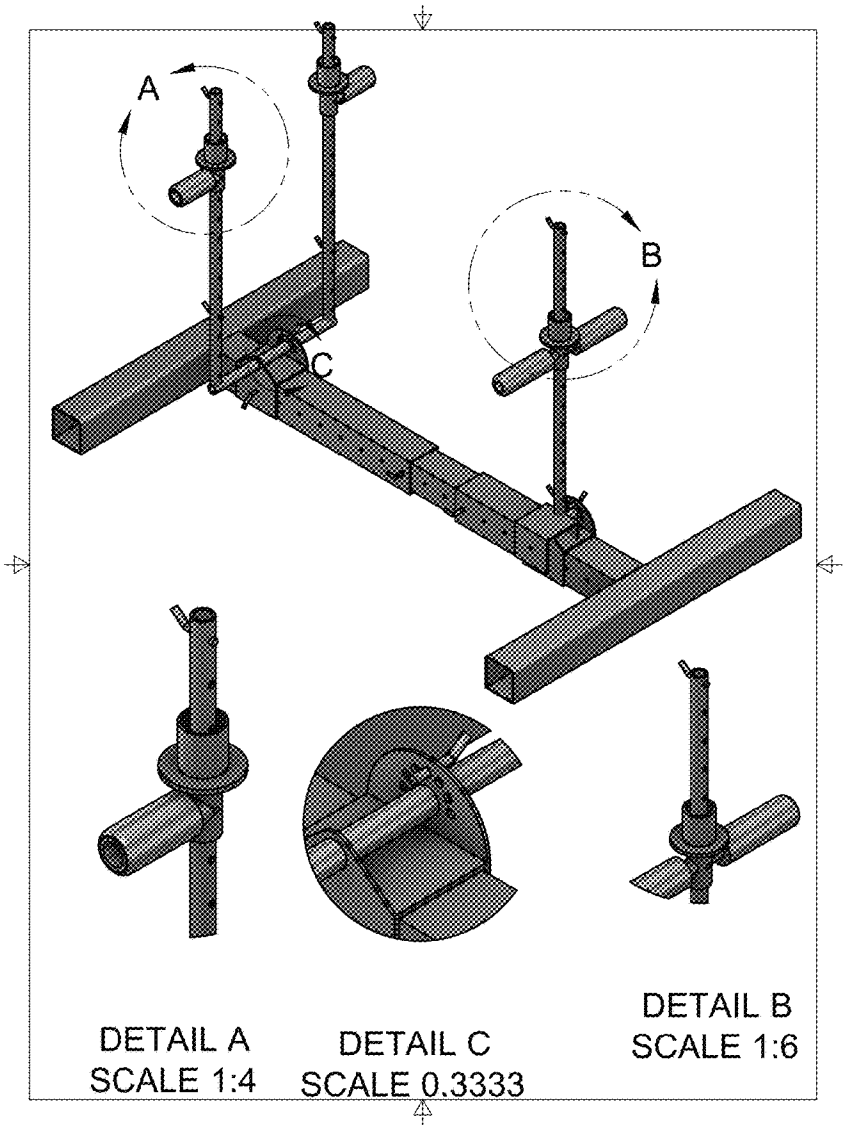
FIG. 21 is an exemplary figure of the exercise machine with zoomed-in details of the slide guides and pivot lock.

A front guide rail 17 and a back guide rail 16 can be attached to the front base 8 or back base 1, respectively. The guide rails are attached using front and back slide brackets 13, 3. The slide brackets are slightly wider than the base upon which they sit. The slide brackets are secured to the bases via locking pins 11 transfixed through machined holes in the brackets and bases. This provides stability to the bracket and guide rail mechanism. Length adjustments can be made by moving the slide brackets in either direction along the bases. This allows for the base to be adjusted in between about 5 inch and 15 inch increments or holes. Preferably each increment or hole is between about 1 inch to 2 inches. In one embodiment there are 10 holes and each hole is spaced about 1.5 inches from the next nearest hole. In another embodiment the holes are about 1 inch or about 2 inches from the next nearest hole. The front base 8 and back base 1 can be between 12 inches and 24 inches, preferably between 14 inches and 20 inches, and more preferably between 16 inches and 18 inches FIG. 21 is an exemplary figure of the invention with zoomed-in details of the slide guides and pivot lock.

The front guides rails are offset laterally via front a lateralizing rod 9 extending from the front slide bracket 13. This allows for a more natural position/spacing of the user's upper extremities, i.e. close to the user's biacromial distance, against the front rollers 10. Similarly, the lateralizing rod 9 prevents interference from the user's head, which may need to be positioned between the two front guide rails 17, depending on the angulation through the front pivot lock 18.

Encircling the front and back guide rails 17, 16 are front and back slide guides 15, 5 that allow for smooth translation along the guide rails. The slide guides contain roller(s) 10, 6 and a resistance platform. The roller(s) 10, 6 projects laterally from the slide guides 15, 5, allowing the user to position an extremity against the roller(s) 10, 6 for comfort. This roller 10, 6 rotates about a central axis facilitating movement along the user's extremity. The resistance platform is at the distal end of the slide guide and allows for placement of weight plates to rest on the resistance platform, thereby permitting additional resistance as desired by the user. The resistance can be modified to consist of a belt, strap, or other mechanism capable of applying external load.

Figure 19:
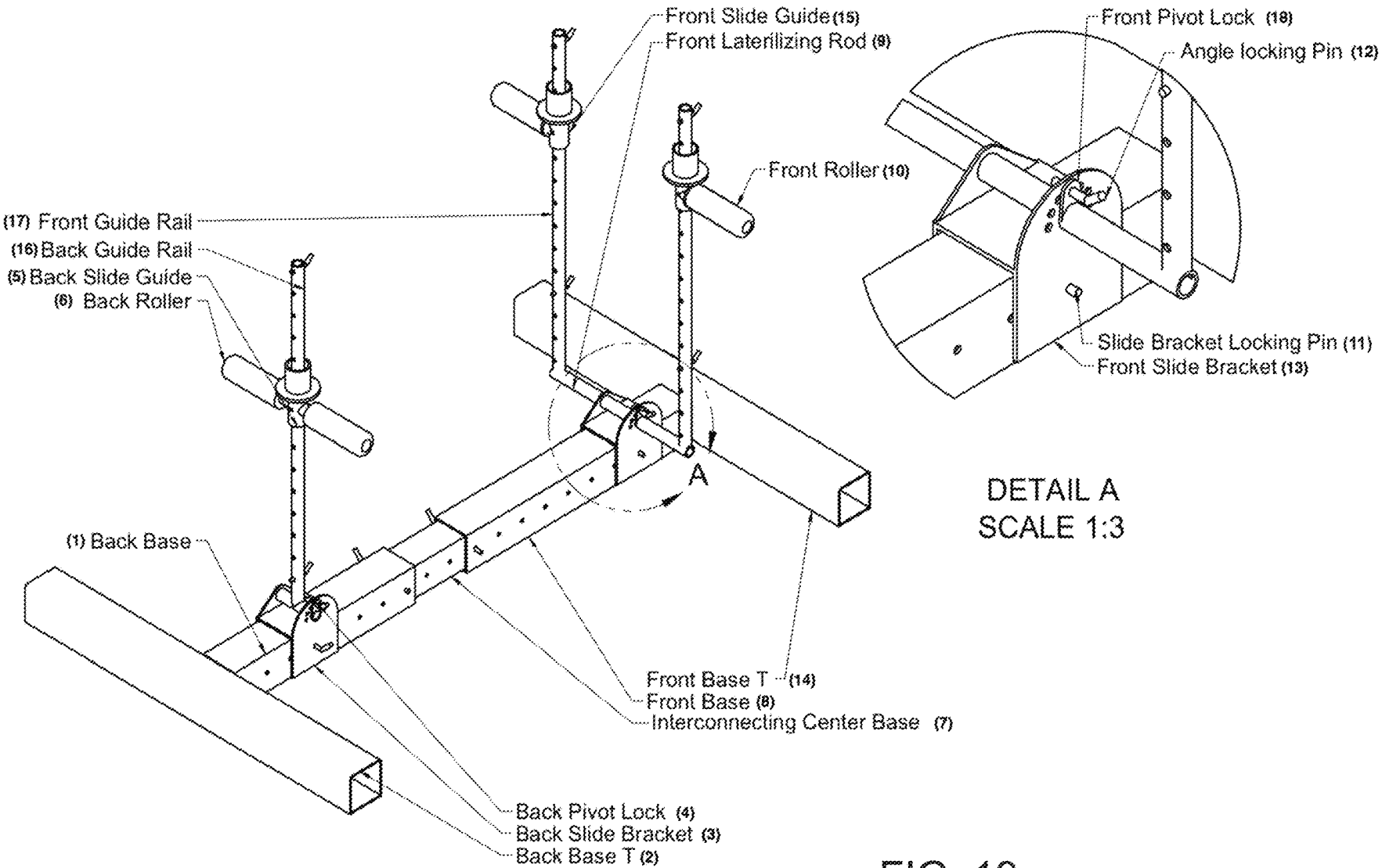
FIG. 19 is an exemplary drawing of the invention detailing the parts of the exercise machine.

Detail A of FIG. 19 shows that the front and back slide brackets 13, 3 have a pivot lock mechanism 18, 4. Through the use of the angle locking pin 12, the angles of the front and back guide rails 17, 16 can be adjusted. The guide rails 17, 16 and slide guides 15, 5 have machined holes through each part. This allows for placement of a locking pin 12 to set limits of motion of the slide guides 15, 5 along the guide rails 17, 16. Alternatively, the pin 12 can be passed through both the slide guide 15, 5 and guide rail 17, 16, locking the mechanism in one position.

Figure 20:
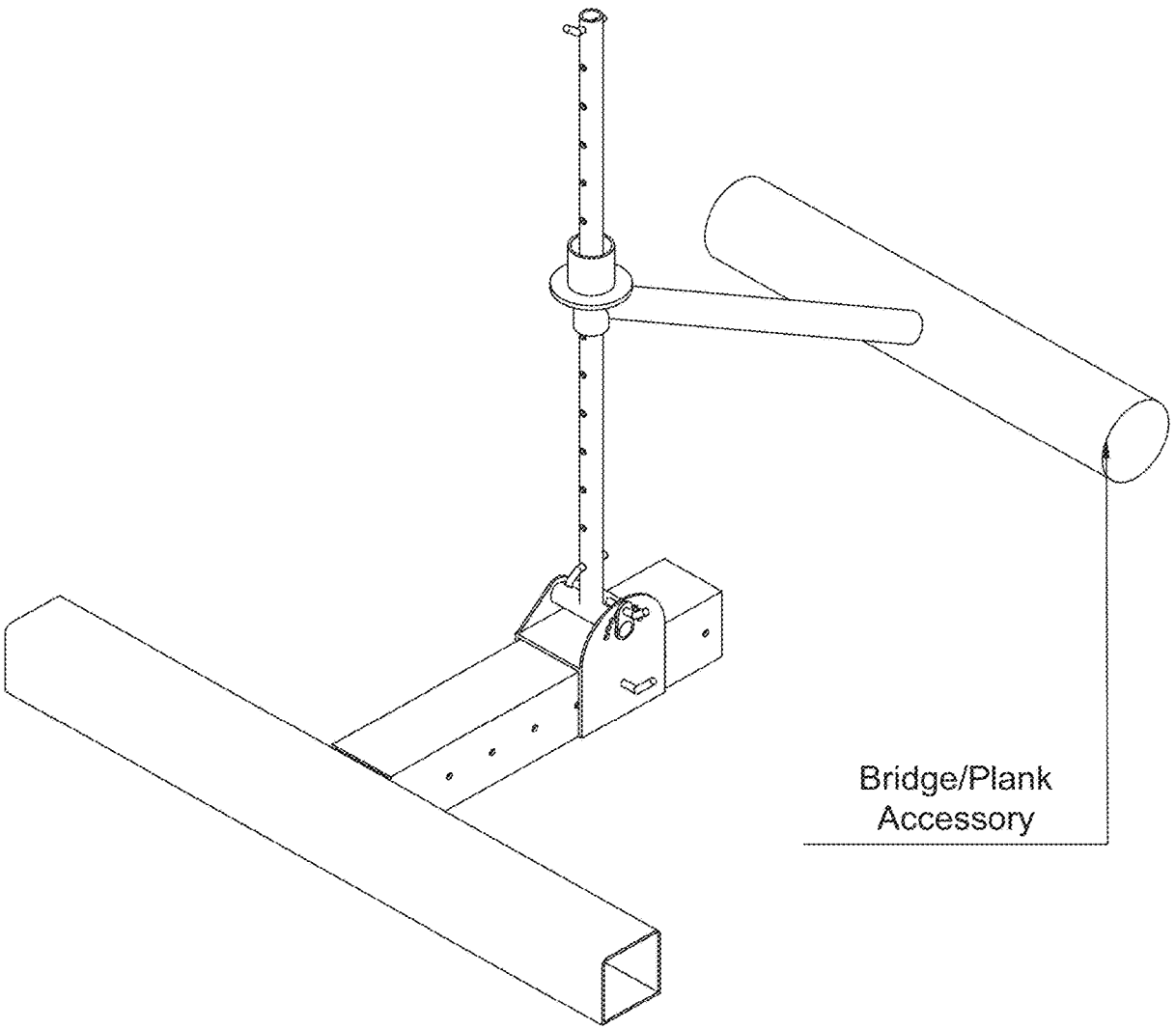
FIG. 20 is an exemplary drawing of the exercise machine with the bridge/plank accessory.

FIG. 20 is a modification of the exercise machine 400 of Example 2. The modification includes a back base 1, back perpendicular base 2, back slide bracket 3, back pivot lock 4, and back guide rail 16; however, the back slide guide 5 is omitted and replaced with a bridge/plank accessory. The bridge plank accessory consists of a slide guide/resistance platform 19, offset extension 20, and roller 21. Similarly, the guide rail and slide guide have machined holes through each part. This allows for placement of a locking pin 12 if desired. The locking pin 12 can then set the limit(s) of motion of the slide guide 19 along the back guide rail 16.

Figure 22:
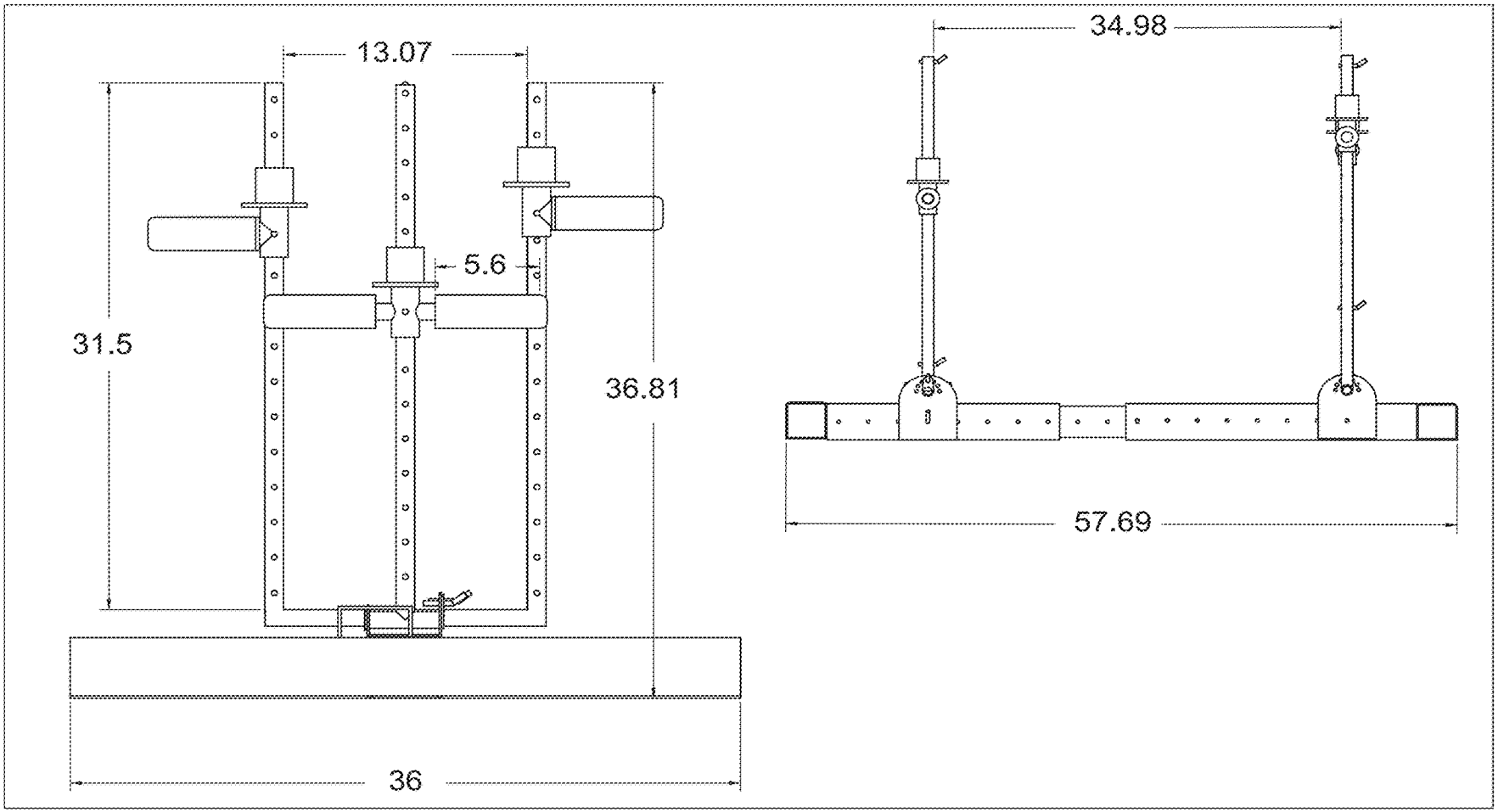
FIG. 22 is an exemplary drawing of the side and front-back views of the exercise machine outlining potential dimensions of the machine.

FIG. 22 has side and front-back views of the invention outlining potential dimensions of the exercise machine of Example 2. The exercise machine 400 can be made of any material capable of withstanding a sufficient amount of force and load from added resistance and to prevent rotation of the apparatus. The material may include but is not limited to metal, plastic, wood, or PVC. The material is preferably steel-based to allow for substantial durability.

Methods of Using the Exercise Machine of Example 2

The exercise machine 400 of Example 2 can be used to train the lumbopelvic core muscles by allowing the user to simulate a variety of core strengthening exercises including, but not limited to, a plank, a glute bridge, a bird-dog, a leg raise (single-leg or dual-leg), or other exercises specifically used to target the core muscles. The user is able to progressively improve their strength through the use of added resistance. The exercise machine 400 of Example 2 simulates the most effective exercises to strengthen these muscles by means of a guided exercise machine as described herein.

Figure 23A:
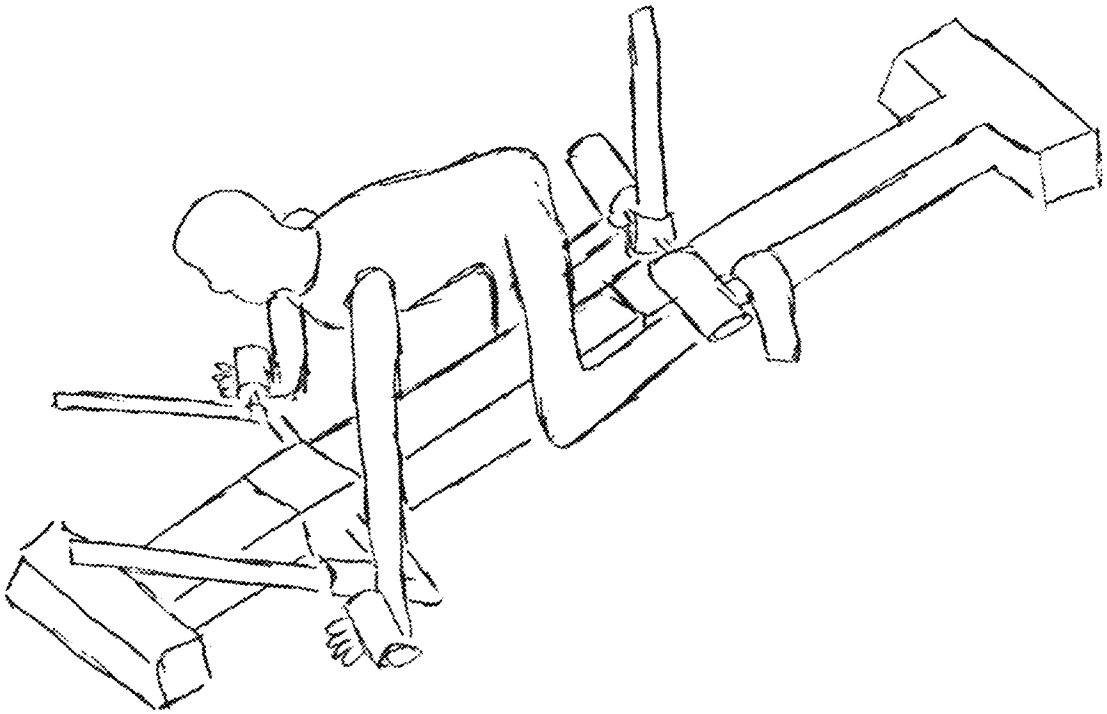
FIGS. 23A-23B are sketches of a user performing a bird-dog exercise on the exercise machine. The starting position is shown in FIG. 23A and the full bird-dog position is shown in FIG. 23B.
Figure 23B:
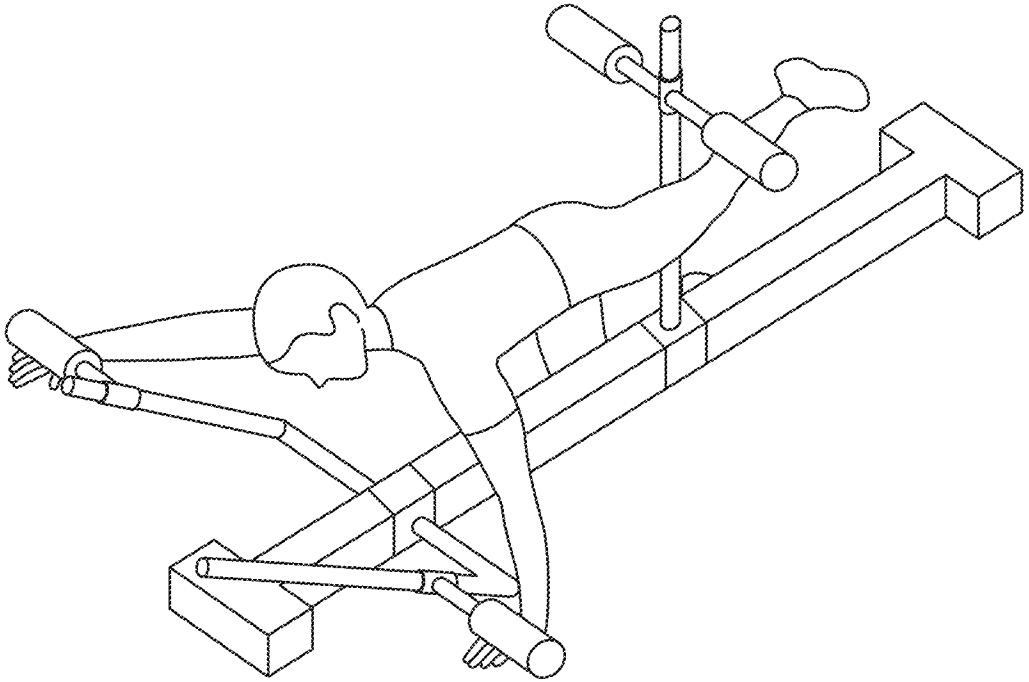

FIG. 23A-23B show a user performing one repetition of a bird-dog exercise on the exercise machine 400. The user starts in the four-point kneeling position with both knees and hips flexed to 90 degrees. The dorsum of the forearms are positioned against the front rollers 10 and the posterior legs/ankles positioned beneath the back rollers 6. The user then flexes one shoulder, translating the front slide guide 15 along the front guide rail 17; simultaneously the user extends the contralateral knee and hip, translating the back slide guide 5 along the back guide rail 16. The user holds this position (FIG. 23B) for several seconds, then returns to the starting four-point kneeling position and then repeats the motion however with the contralateral upper and lower extremities. Additional resistance can be applied over the guide rails 16, 17 and rest weights upon the slide guide resistance platforms 5, 15. The angle of the front and back guide rails 16, 17 can be adjusted for varying muscle activation via the front and back pivot locks 18, 4. The exercise can also be performed with only one extremity at a time, until the user becomes more accustomed to the required motion(s) involved for progressing the level of difficulty. The resistance can be modified to consist of a belt, strap, or other mechanism capable of applying external load.

Figure 24:
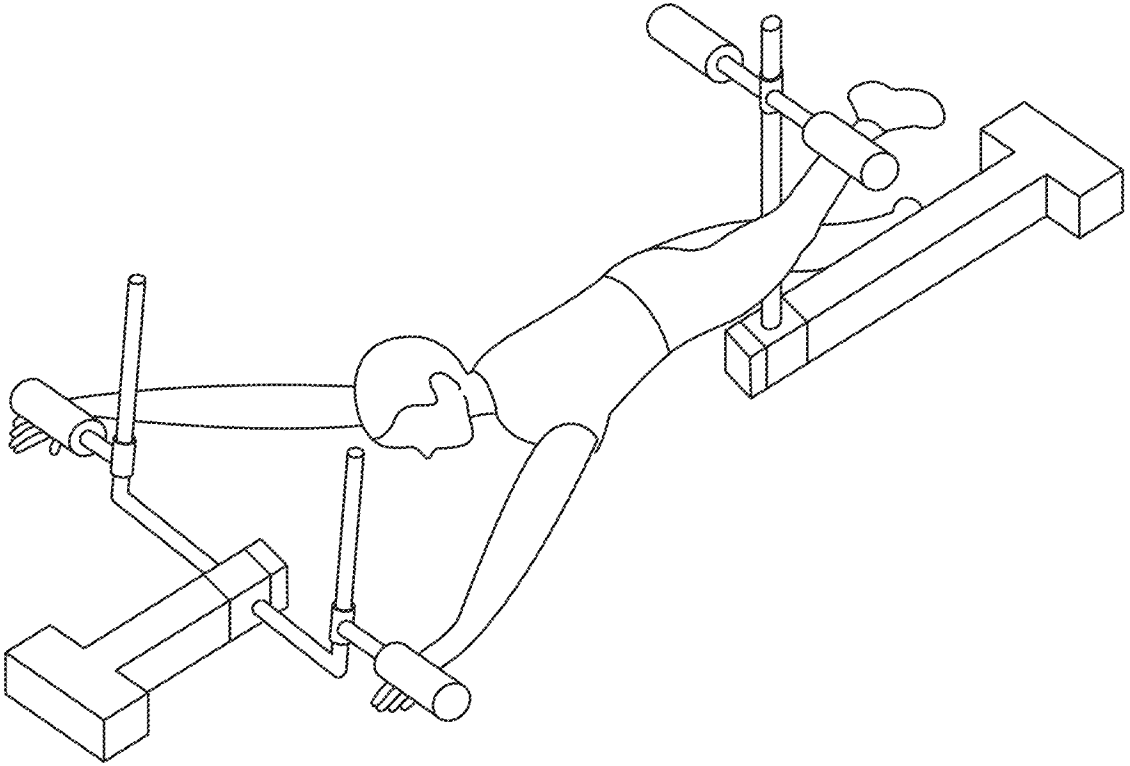
FIG. 24 is a sketch of a user performing a superman exercise on the exercise machine.

FIG. 24 shows a user performing a superman exercise on the exercise machine 400 of Example 2. The exercise machine 400 is adjusted by removing the interconnecting center base 7 so that the front base 8 and back base 1 are separate. The front and back bases 8, 1 are separated based on user height such that the user can lay prone on the ground. The front and back pivot locks 18, 4 are adjusted so that the front and back guide rails 17, 16 are oriented perpendicular to the ground. The front and back pivot locks 18, 4 can also be adjusted so that the front and back guide rails 17, 16 are at an angle. The user then places the dorsum of the forearms underneath the front rollers 10 and the posterior part of the thighs or legs beneath the back rollers 6—this is the start position. Next, the user flexes the shoulder, translating the front slide guide 15 up the front guide rail 17, holding this position (full superman position) until lowering the front slide guide 15 to the start position. To activate the lower extremity, the user extends the hip, translating the back slide guide 5 up the back guide rail 16, holding this position until lowering the back slide guide 5 to the start position. This exercise can be performed by using either one extremity, multiple extremities, or all extremities simultaneously, based on user skill and strength, This exercise can be performed with or without the addition of extra resistance through the use of weights placed upon the front and back base slide guide resistance platforms 15, 5. The resistance can be modified to consist of a belt, strap, or other mechanism capable of applying external load.

Figure 25A:
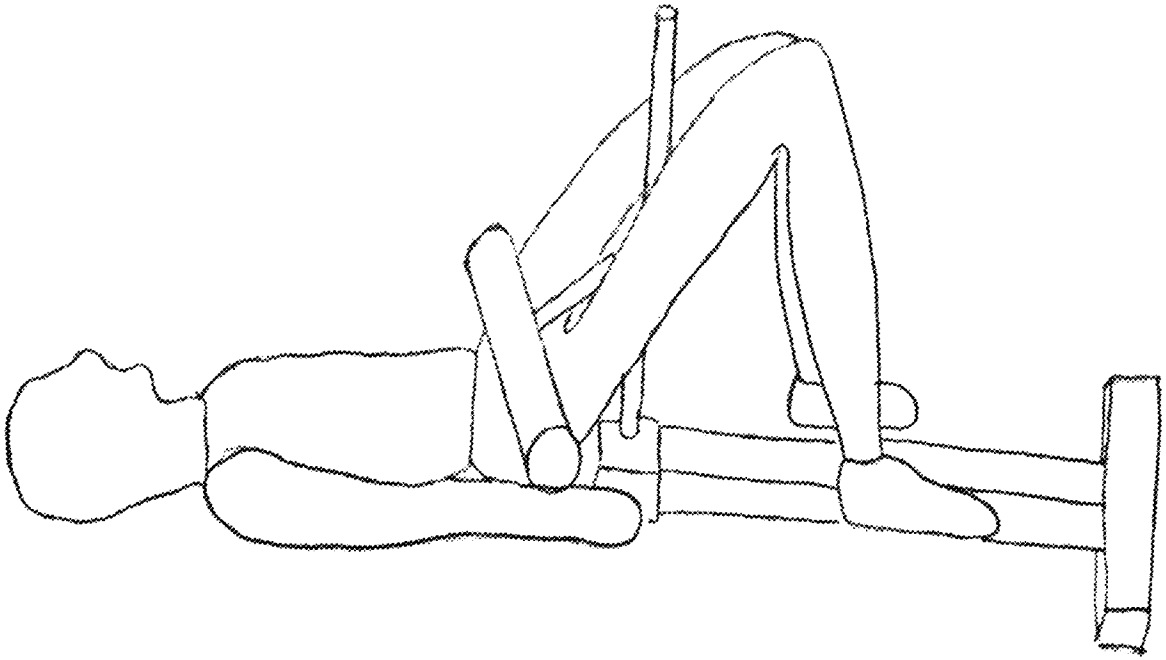
FIGS. 25A-25B are sketches of a user performing a glute bridge exercise on the exercise machine. The starting position is shown in FIG. 25A and the bridged position is shown in FIG. 25B.
Figure 25B:
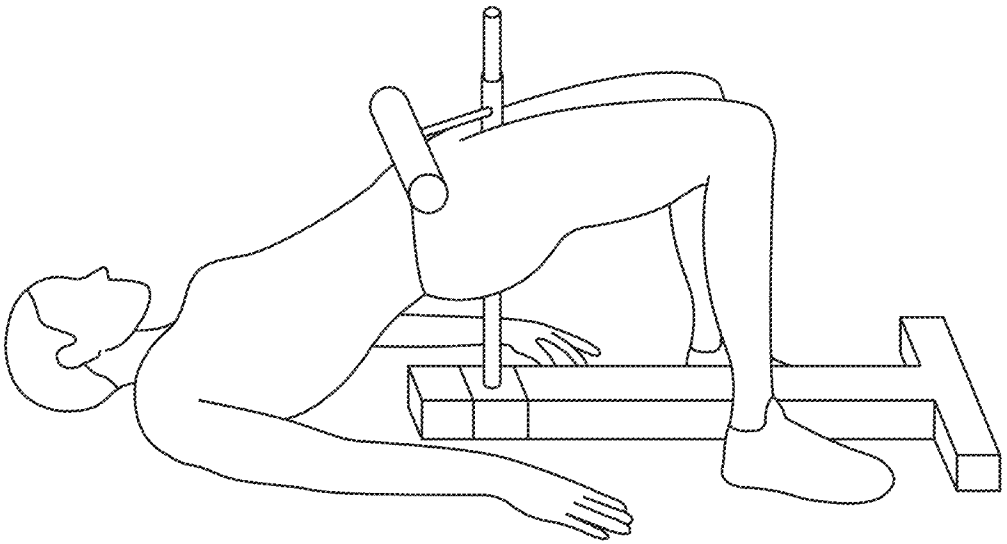

FIG. 25A-25B show a user performing a glute bridge exercise on the exercise machine 400 of Example 2. The exercise machine 400 is modified so that the back components consisting of the back base 1, back perpendicular base 2, back slide bracket 3, back pivot lock 4, and back guide rail 16 are used. The back slide guide 5 is removed and replaced by the bridge/plank accessory. The user lays on his or her back with the hips and knees flexed and positions the roller from the bridge/plank accessory over the anterior proximal thighs or near the pubic symphysis (FIG. 25A). The user then elevates the hips/pelvis off the floor while keeping the feet and shoulders/posterior torso on the floor, translating the bridge/plank accessory along the back guide rail 16 (FIG. 25B). The user then returns to the start position. Resistance can be added by applying weights to the resistance platform of the bridge/plank accessory. The resistance can be modified to consist of a belt, strap, or other mechanism capable of applying external load.

Figure 26:
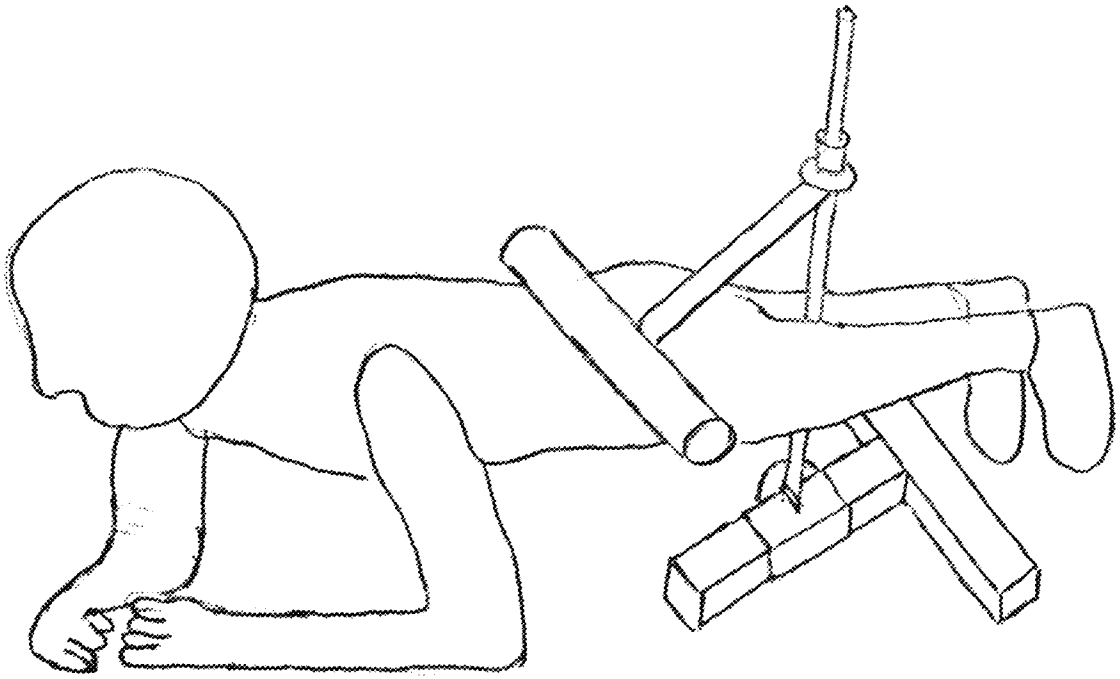
FIG. 26 is a sketch of a user performing a forearm plank exercise on the exercise machine.

FIG. 26 shows a user performing a lank on the exercise machine 400 of Example 2. The exercise machine 400 is modified so that the back components consisting of the back base 1, back perpendicular base 2, back slide bracket 3, back pivot lock 4, and back guide rail 16 are used. The back slide guide 5 is removed and replaced by the bridge/plank accessory. The user positions oneself prone with the roller from the bridge/plank accessory resting upon the lower back near the lumbosacral region (FIG. 26). The user's forearms and feet remain stationary while the user elevates the pelvis off the ground, translating the bridge/plank accessory along the back guide rail 16. The user holds this position, keeping the torso parallel to the ground, then returns to the start position. Additional resistance can be added by applying weights to the resistance platform of the bridge/plank accessory. Variations of this exercise can also be performed by rotating the user's body 90 degrees to either direction for a side plank. The resistance can be modified to consist of a belt, strap, or other mechanism capable of applying external load.

Figure 27:
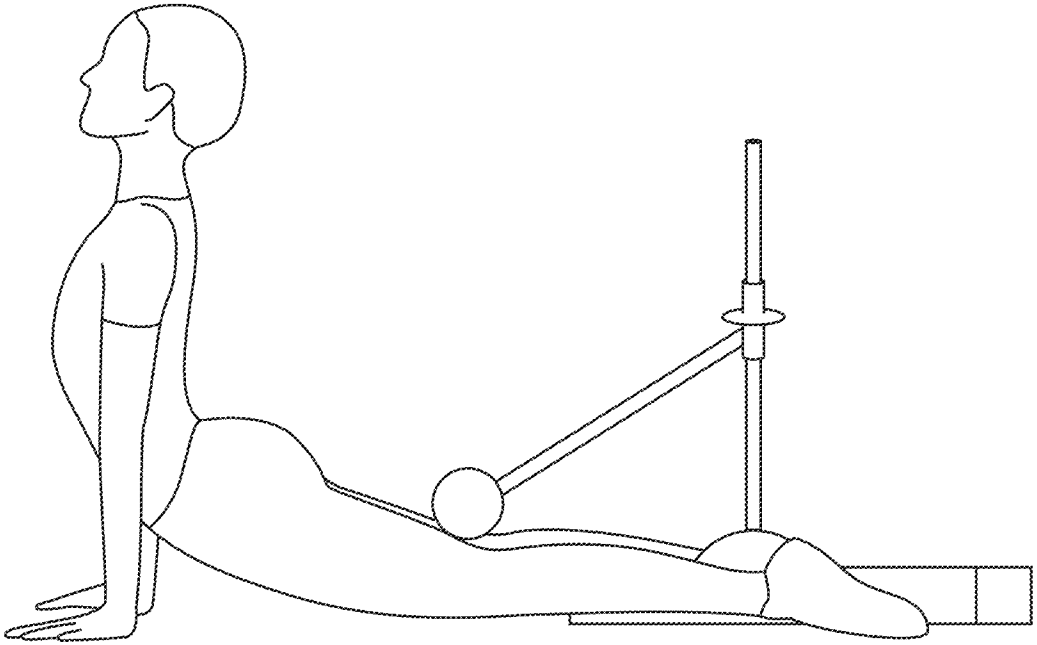
FIG. 27 is a sketch of a user performing a lumbar extension on the exercise machine.

FIG. 27 shows the user performing a lumbar extension on the exercise machine 400 of Example 2. The exercise machine 400 is modified so that the back components consisting of the back base 1, back perpendicular base 2, back slide bracket 3, back pivot lock 4, back guide rail 16, and back slide guide and rollers 5, 6 are used. The back slide guide is lowered based on user size such that there is just enough space between the back rollers 6 and the floor for the user's legs or thighs. The back slide guide 5 is fixed in position by passing a locking pin 11 through both the back slide guide 5 and back guide rail 16. The user is positioned prone and secures one's lower extremities beneath the back rollers 6. The user then extends the lumbar spine by raising the torso off the ground (FIG. 27). Further difficulty based on user skill, endurance, and training can be added by the adjusting the location of the user's lower extremities under the back rollers 6, placing one's upper extremities in front of the user, or adding resistance/weights to the front slide guides 15 and translating the front slide guides up the front guide rails 15. For this exercise, the bridge/plank accessory can also be substituted for the back slide guide and rollers 5, 6. The resistance can be modified to consist of a belt, strap, or other mechanism capable of applying external load.

Figure 28:
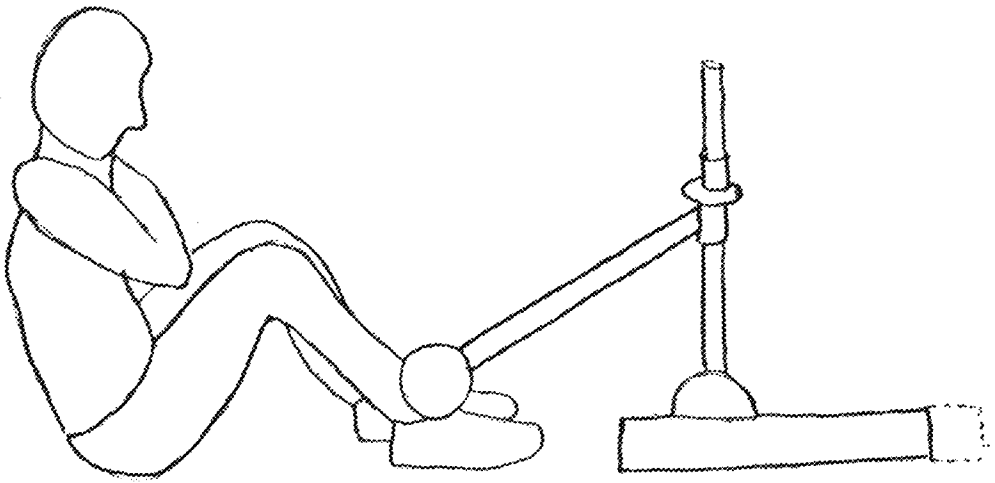
FIG. 28 is a sketch of a user performing a sit-up on the exercise machine.

FIG. 28 shows a user performing a sit-up on the exercise machine 400 of Example 2. The exercise machine 400 is modified so that the back components consisting of the back base 1, back perpendicular base 2, back slide bracket 3, back pivot lock 4, back guide rail 16, and back slide guide and rollers 5, 6 are used. The back slide guide is lowered such that there is just enough space between the back rollers 6 and the floor for the user's feet/ankles. The back slide guide 5 is fixed in position by passing a locking pin 11 through both the back slide guide 5 and back guide rail 16. The user places one's feet/ankles beneath the back rollers 6, lays flat on one's back with the hips and knees flexed. The user then raises the shoulders/torso off the ground performing either a crunch or sit-up (FIG. 28). Further difficulty based on user skill, endurance, and training can be added by the placing one's upper extremities behind the user or adding resistance/weights to the front slide guides 15 and translating the front slide guides up the front guide rails 17. For this exercise, the bridge/plank accessory can also be substituted for the back slide guide and rollers 5, 6. The resistance can be modified to consist of a belt, strap, or other mechanism capable of applying external load.

CONCLUSION

All parameters, dimensions, materials, and configurations described herein are meant to be exemplary and the actual parameters, dimensions, materials, and/or configurations will depend upon the specific application or applications for which the inventive teachings is/are used. It is to be understood that the foregoing embodiments are presented primarily by way of example and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein.

In addition, any combination of two or more such features, systems, articles, materials, kits, and/or methods, if such features, systems, articles, materials, kits, and/or methods are not mutually inconsistent, is included within the inventive scope of the present disclosure. Other substitutions, modifications, changes, and omissions may be made in the design, operating conditions and arrangement of respective elements of the exemplary implementations without departing from the scope of the present disclosure. The use of a numerical range does not preclude equivalents that fall outside the range that fulfill the same function, in the same way, to produce the same result.

Also, various inventive concepts may be embodied as one or more methods, of which at least one example has been provided. The acts performed as part of the method may in some instances be ordered in different ways. Accordingly, in some inventive implementations, respective acts of a given method may be performed in an order different than specifically illustrated, which may include performing some acts simultaneously (even if such acts are shown as sequential acts in illustrative embodiments).

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The use of the word "between" in connection with two values is intended to be construed as including the two values.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

"Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method of using an exercise machine,
wherein the exercise machine comprises:
a stationary bench that is parallel to a floor on which the machine is placed;
a rotating bench that is capable of rotating at an angle α about an axis, wherein the axis is located between the stationary bench and the rotating bench;
a resistance bar;
a load arm mechanism capable of providing at least one of linear or rotational adjustment of the resistance bar; and
a resistance means to adjust an amount of force required to move the resistance bar away from the rotating bench;
wherein α is 180 degrees when the rotating bench is parallel to the floor, and α decreases in magnitude as the rotating bench is rotated away from the floor; and
one or more suspended slings is attached to the machine by at least two vertical posts;
wherein the one or more suspended slings are suspended above the at least one of the stationary bench or the rotating bench; and
the method further comprises performing by a user an exercise selected from the group consisting of:
a glute bridge;
a single leg raise;
a dual leg raise; and
a bent leg raise;
wherein:
the user is positioned beneath the resistance bar;
the user's back is in contact with the stationary bench;
the user's legs are positioned over the rotating bench;
wherein when the selected exercise is the glute bridge or the bent leg raise, performing the glute bridge or the bent leg raise further comprises:
contacting the resistance bar against at least one thigh of the user; and
lifting the resistance bar by the user away from the rotating bench while the resistance means pushes the resistance bar against the at least one thigh; and
wherein when the selected exercise is the single leg raise or the dual leg raise, performing the single leg raise or the dual leg raise further comprises:
contacting the resistance bar against at least one leg of the user; and
lifting the resistance bar by the user away from the rotating bench while the resistance means pushes the resistance bar against the at least one leg.

2. The method of claim 1, wherein α ranges from 90 degrees to 210 degrees.

3. The method of claim 1, wherein α ranges from 110 degrees to 200 degrees.

4. The method of claim 1, wherein α ranges from 120 degrees to 190 degrees.

5. The method of claim 1, wherein α ranges from 135 degrees to 180 degrees.

6. The method of claim 1, wherein the linear adjustment is capable of providing 8 inches to 34 inches of adjustment of the resistance bar.

7. The method of claim 1, wherein the linear adjustment is capable of providing 10 inches to 30 inches of adjustment of the resistance bar.

8. The method of claim 1, wherein the linear adjustment is capable of providing 12 inches to 28 inches of adjustment of the resistance bar.

9. The method of claim 1, wherein the linear adjustment is capable of providing 14 inches to 26 inches of adjustment of the resistance bar.

10. The method of claim 1, wherein the rotational adjustment is capable of providing at least 180 degrees of adjustment of the resistance bar.

11. The method of claim 1, wherein the resistance means comprises at least one of:
a weight stack;
a resistance band;
a guided weight resistance; or
a friction-based resistance.

12. The method of claim 1, wherein at least one sliding platform is attached to at least one of the stationary bench or the rotating bench.

13. The method of claim 1, wherein one or more swivel platform is attached to at least one of the stationary bench or the rotating bench.

14. The method of claim 1, wherein a material of the exercise machine comprises:
metal;
plastic;
wood;
PVC; or
steel.

15. A method of using an exercise machine,
wherein the exercise machine comprises:
a stationary bench that is parallel to a floor on which the machine is placed;
a rotating bench that is capable of rotating at an angle α about an axis, wherein the axis is located between the stationary bench and the rotating bench;

a support structure attached to the stationary bench and the rotating bench;

a resistance bar;

a load arm mechanism attached to the support structure, wherein the load arm mechanism is capable of providing linear and rotational adjustment of the resistance bar; and a resistance means to adjust an amount of force required to move the resistance bar away from the rotating bench;

wherein $\alpha$ is about 180 degrees when the rotating bench is parallel to the floor and $\alpha$ decreases in magnitude as the rotating bench is rotated away from the floor; and one or more swivel platform is attached to at least one of the stationary bench or the rotating bench;

wherein the method further comprises performing by a user an exercise selected from the group consisting of:

a plank;

a bird-dog; and a resisted push-up;

wherein:

the user is positioned beneath the resistance bar;

the user is positioned on the exercise machine such that the user's chest points towards the floor and the user's feet are in contact with the swivel platform;

wherein when the selected exercise is the plank, performing the plank further comprises:

contacting the resistance bar against the user's back; and lifting the resistance bar by the user away from the rotating bench while the resistance means pushes the resistance bar against the user's back;

wherein when the selected exercise is the bird-dog, performing the bird-dog further comprises:

contacting the resistance bar against the user's calf or ankle; and lifting the resistance bar by the user away from the rotating bench while the resistance means pushes the resistance bar against the user's calf or ankle; and wherein when the selected exercise is the resisted push-up, performing the resisted push-up further comprises:

contacting the resistance bar against the user's back; and lifting the resistance bar by the user away from the rotating bench while the resistance means pushes the resistance bar against the user's back.

16. The method of claim 15, wherein the resistance means comprises at least one of:

a weight stack;

a resistance band;

a guided weight resistance; or a friction-based resistance.

17. The method of claim 15, wherein the method is performed while at least one sliding platform is attached to at least one of the stationary bench or the rotating bench.

* * * * *